US007448731B2

(12) United States Patent
Murata

(10) Patent No.: US 7,448,731 B2
(45) Date of Patent: Nov. 11, 2008

(54) LIQUID DROPLET EJECTING HEAD AND LIQUID DROPLET EJECTING DEVICE

(75) Inventor: Michiaki Murata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 425 days.

(21) Appl. No.: 11/221,318

(22) Filed: Sep. 7, 2005

(65) Prior Publication Data

US 2006/0176340 A1 Aug. 10, 2006

(30) Foreign Application Priority Data

Feb. 7, 2005 (JP) ..... 2005-030672

(51) Int. Cl.
*B41J 2/045* (2006.01)

(52) U.S. Cl. ..... 347/68; 347/71

(58) Field of Classification Search ..... 347/68, 347/70–72

See application file for complete search history.

(56) References Cited

U.S. PATENT DOCUMENTS 5,659,346 A * 8/1997 Moynihan et al. ..... 347/68
5,757,400 A * 5/1998 Hoisington ..... 347/40
6,382,781 B2 * 5/2002 Furuhata et al. ..... 347/68
6,808,254 B2 * 10/2004 Sakaida et al. ..... 347/71
6,986,565 B2 * 1/2006 Watanabe et al. ..... 347/71

FOREIGN PATENT DOCUMENTS

JP 2-301445 12/1990
JP 9-323414 12/1997

* cited by examiner

*Primary Examiner*—An H Do
(74) *Attorney, Agent, or Firm*—Fildes & Outland, P.C.

(57) ABSTRACT

A liquid droplet ejecting head including a channel substrate in which a nozzle and a pressure chamber, which is partitioned off by a pressure chamber dividing wall, are formed; a piezoelectric element substrate having a diaphragm that forms a part of the pressure chamber and a piezoelectric element that displaces this diaphragm; a liquid pool chamber that is formed opposite from the pressure chamber with the piezoelectric element substrate being disposed therebetween an upper substrate disposed opposite from the pressure chamber with the piezoelectric element substrate being disposed therebetween so as to be separated from and face the piezoelectric element substrate; and a dividing wall component provided, when viewing the channel substrate in plane view, along a position corresponding to the pressure chamber dividing wall between the piezoelectric element substrate and the upper substrate so as to contact the piezoelectric element substrate and the upper substrate.

17 Claims, 37 Drawing Sheets

LIQUID DROPLET EJECTING HEAD AND LIQUID DROPLET EJECTING DEVICE

CROSS-REFERENCE TO RELATED APPLICATIONS

This application claims priority under 35 USC 119 from Japanese Patent Application No. 2005-30672, the disclosure of which is incorporated by reference herein.

BACKGROUND OF THE INVENTION

1. Field of the Invention

The present invention relates to a liquid droplet ejecting head having nozzles that eject droplets, pressure chambers that are communicated with the nozzles and are filled with a liquid, a diaphragm that comprises a portion of the pressure chambers, a liquid pool chamber that pools liquid supplied through liquid channels to the pressure chambers, and piezoelectric elements that displace the diaphragm. The present invention also relates to a liquid droplet ejecting device equipped with this liquid droplet ejecting head.

2. Description of the Related Art

Conventionally, inkjet recording devices are known in which ink droplets are selectively ejected from multiple nozzles of an inkjet recording head (hereafter, there are cases where this is simply referred to as "recording head") which acts as a liquid droplet ejecting device. Such devices print text and images on a recording medium such as recording paper.

In these inkjet recording devices, there are various systems used in the recording head such as piezoelectric systems and thermal systems. In, for example, the case of a piezoelectric system, as shown in FIGS. 26 and 27, a piezoelectric element 206 (i.e., an actuator that converts electric energy into mechanical energy) is provided in a pressure chamber 204 to which ink 200 is supplied through an ink pool chamber 202 from an ink tank. The piezoelectric element 206 is configured so as to flex deform in a concave shape and make the volume of the pressure chamber 204 decrease and pressurize the ink 200 inside, thereby making it eject as an ink droplet 200A from a nozzle 208 communicated with the pressure chamber 204.

With inkjet recording heads of this kind of configuration, there has been a demand in recent years for recording heads that can provide high-resolution printing while maintaining compactness and low cost. In order to answer this need, it is necessary for the nozzles to be densely arranged. Nonetheless, as shown in the drawings, current recording heads have the ink pool chamber 202 provided next to the nozzles 208 (i.e., between each of the nozzles 208) so there has also been a limit to the degree to which the nozzles 208 can be arranged in highly dense formations.

Moreover, a drive IC that applies voltage to predetermined piezoelectric elements is provided in the inkjet recording head. As shown in FIG. 28, this is conventionally mounted with a flexible print circuit (FPC) 210. That is, bumps 212 formed at the FPC 210 are joined to the metallic electrode surface of the upper surface of the piezoelectric element 206 provided on a diaphragm 214. At this stage, the piezoelectric element 206 and the drive IC (not shown) are electrically connected since the drive IC is mounted on this FPC 210.

Further, there are methods where an electrode terminal on a mounting substrate on which the IC drive is mounted and an electrode terminal provided on the exterior surface of the recording head are connected with a wire-bonding method (see, for example, the Official Gazette of Japanese Patent Application Laid-Open (JP-A) No. 2-301445). Furthermore, there are systems where after joining and connecting a drive IC to an electrode terminal provided on the exterior surface of the recording head, an FPC is joined and connected to an electrode terminal of pullout wiring provided on the recording head (see, for example, the Official Gazette of JP-A No. 9-323414).

Nonetheless, in both of these cases, when the nozzles are set in a highly dense arrangement, the sizes of the mounting substrate and FPC increase since wiring of a minute pitch (e.g., a pitch of 10 μm or less) cannot be formed. This causes problems such as inhibiting the compactness of the device and increasing the cost. Further, there are cases where sufficient joining of the components cannot be performed in the manufacturing process since these are configured by layering many components.

SUMMARY OF THE INVENTION

In light of these problems, the present invention was made to provide a liquid droplet ejecting head that is compact and in which nozzles can be densely arranged and in which suitable joining can be performed during the manufacturing process, and a liquid droplet ejecting device provided with this liquid droplet ejecting head.

The liquid droplet ejecting head of the present invention is provided with: a channel substrate in which a nozzle, which ejects liquid droplets, and a pressure chamber, which is partitioned off by a pressure chamber dividing wall and communicated with the nozzle and filled with a liquid, are formed; a piezoelectric element substrate having a diaphragm that forms a part of the pressure chamber and a piezoelectric element that displaces this diaphragm; a liquid pool chamber that is formed opposite from the pressure chamber with the piezoelectric element substrate being disposed therebetween and which pools liquid supplied to the pressure chamber; an upper substrate disposed opposite from the pressure chamber with the piezoelectric element substrate being disposed therebetween so as to be separated from and face the piezoelectric element substrate; and a dividing wall component provided, when viewing the channel substrate in plane view, along a position corresponding to the pressure chamber dividing wall between the piezoelectric element substrate and the upper substrate so as to contact the piezoelectric element substrate and the upper substrate.

With the present invention, a liquid pool chamber is disposed opposite from the pressure chamber with the piezoelectric element substrate being disposed therebetween, so the pressure chambers can be arranged next to each other and the nozzles set at each pressure chamber can be arranged in a highly dense formation.

Typically, the space between the upper substrate and the piezoelectric element substrate is separated so after the upper substrate and the piezoelectric element substrate are joined, there are portions that cannot be pressed and the bonding of the two is inadequate when joining the channel substrate to the piezoelectric element substrate. However, with a liquid droplet ejecting head configured as described above, a dividing wall component is provided along positions corresponding to the pressure chamber dividing walls, so the channel substrate and the piezoelectric element are pressed together and a good condition of bonding can be obtained.

The liquid droplet ejecting device of the present invention uses the liquid droplet ejecting head provided with: a channel substrate in which a nozzle, which ejects liquid droplets, and a pressure chamber, which is partitioned off by a pressure chamber dividing wall and communicated with the nozzle and filled with a liquid, are formed; a piezoelectric element substrate having a diaphragm that forms a part of the pressure chamber and a piezoelectric element that displaces this diaphragm; a liquid pool chamber that is formed opposite from the pressure chamber with the piezoelectric element substrate being disposed therebetween and which pools liquid supplied to the pressure chamber; an upper substrate disposed opposite from the pressure chamber with the piezoelectric element substrate being disposed therebetween so as to be separated from and face the piezoelectric element substrate; and a dividing wall component provided, when viewing the channel substrate in plane view, along a position corresponding to the pressure chamber dividing wall between the piezoelectric element substrate and the upper substrate so as to contact the piezoelectric element substrate and the upper substrate.

High resolution images can be recorded with the liquid droplet ejecting device of the present invention because the nozzles of the liquid droplet ejecting head are densely arranged. Further, the channel substrate and the piezoelectric element substrate are pressed together via the dividing wall component providing a good bond, which in turn ensures a highly reliable liquid droplet ejecting device.

DETAILED DESCRIPTION OF THE INVENTION

First Embodiment

Figure 1:
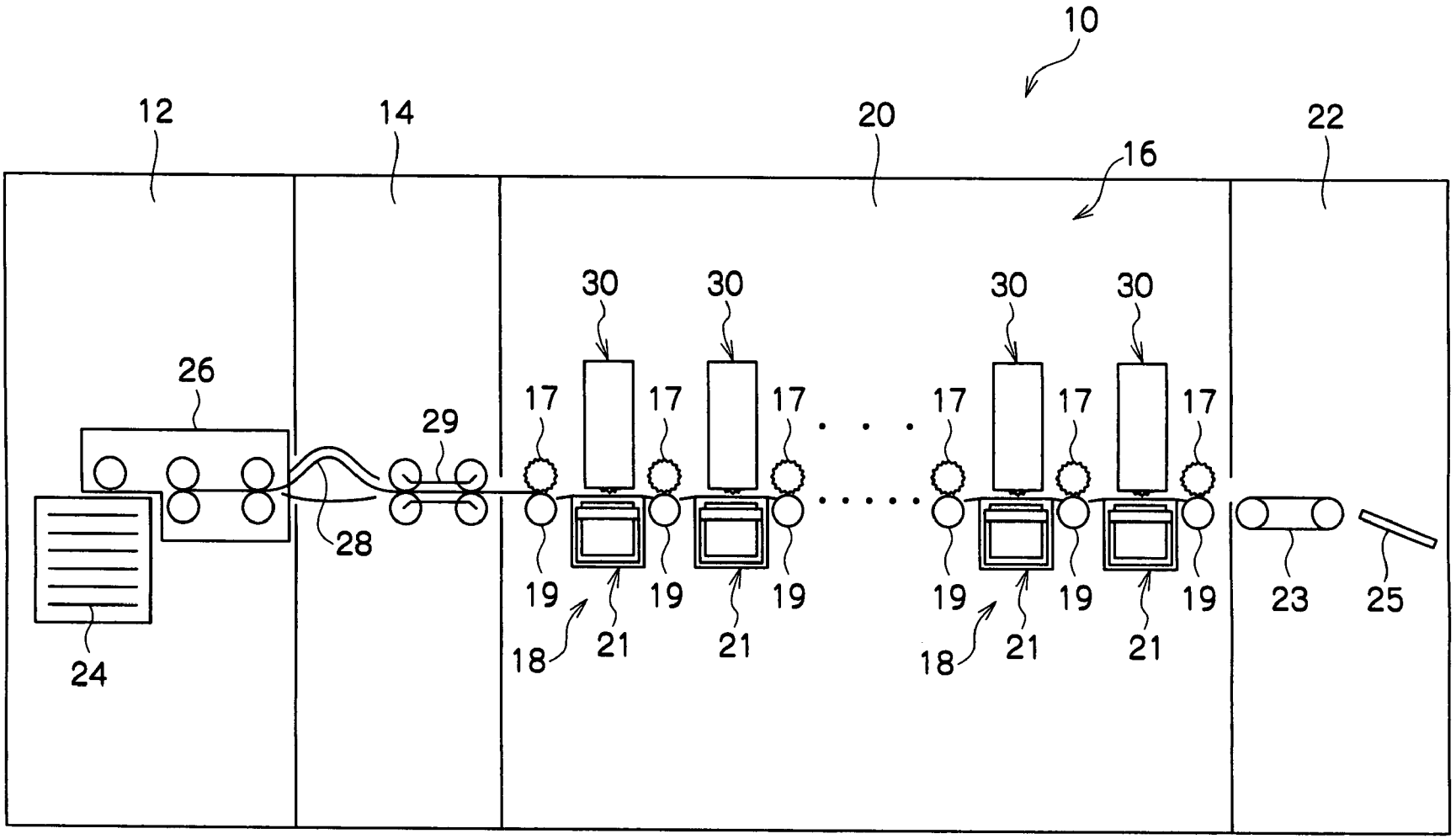
FIG. 1 is a schematic diagram showing the overall structure of an inkjet recording device of the first embodiment.

As shown in FIG. 1, an inkjet recording device 10 basically comprises a paper-supplying unit 12 that sends out paper; an adjustment unit 14 that controls the position of the paper; a recording unit 20 provided with a recording head unit 16 that ejects ink droplets and forms an image on the paper and a maintenance unit 18 that performs maintenance of the recording head unit 16; and an exit unit 22 that ejects the paper on which an image was formed at the recording unit 20.

The paper-supplying unit 12 comprises a stocker 24 in which stacked paper is stocked and a conveying device 26 that feeds paper from the stocker 24 one sheet at a time and conveys it to the adjustment unit 14.

The adjustment unit 14 is provided with a loop-forming unit 28 and a guide component 29 that guides the approach of the paper. By passing through this portion, the body of the paper is used to correct skew, the conveying timing is controlled, and the paper enters the recording unit 20.

The exit unit 22 passes paper on which an image was formed at the recording unit 20 through a paper-exiting belt 23 and stores it on a tray 25.

A paper-conveying route on which recording paper is conveyed is formed between the recording head unit 16 and maintenance unit 18. Recording paper P is continuously sandwiched and held (without stopping) by star wheels 17 and conveying rollers 19. Then ink droplets are ejected from the recording head unit 16 onto this paper and an image is formed on the appropriate recording paper.

The maintenance unit 18 comprises a maintenance device 21 arranged face an inkjet recording head 32, and the maintenance unit 18 can perform processing for the inkjet recording head 32 such as capping and wiping, and even dummy jet and vacuum processing.

Figure 2:
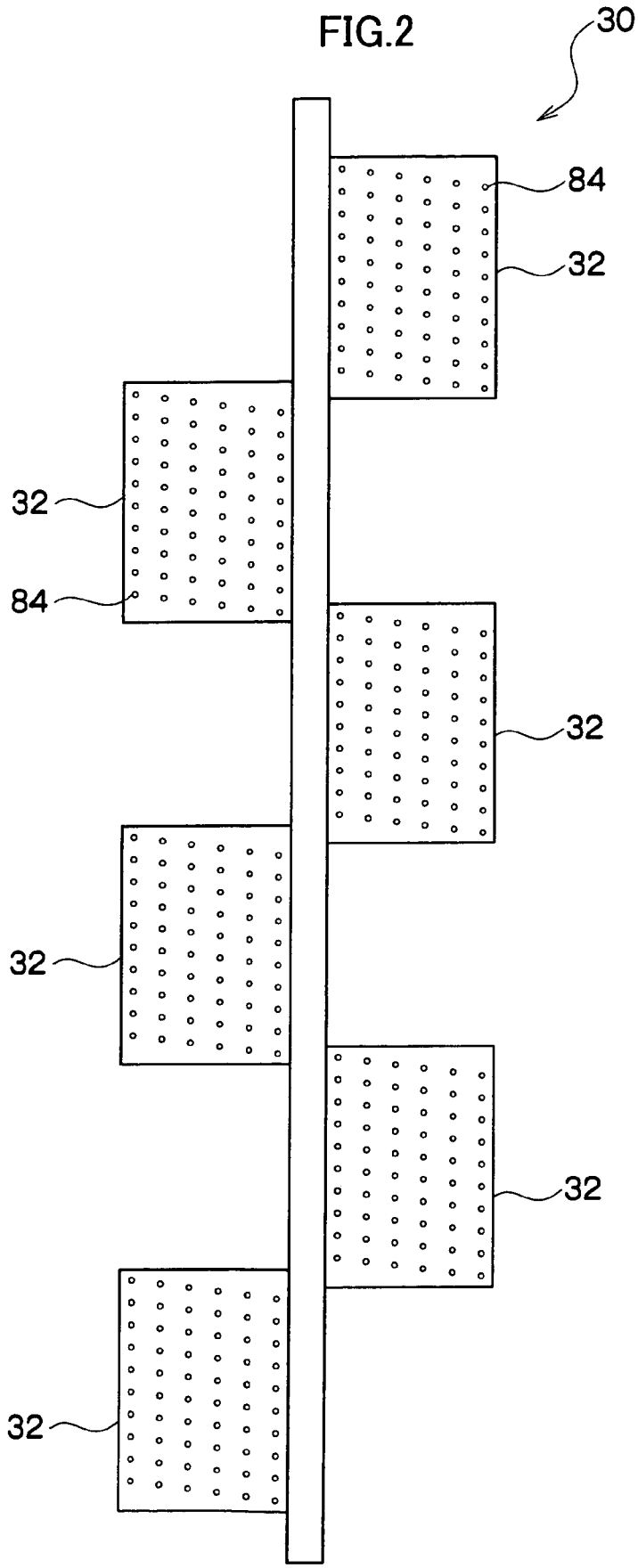
FIG. 2 is a schematic diagram showing the layout of an inkjet recording unit of the first embodiment.

As shown in FIG. 2, each inkjet recording unit 30 is provided with multiple inkjet recording heads 32 arranged in the paper conveying direction and in the direction perpendicular thereto. Multiple nozzles 84 are formed in a matrix pattern in the inkjet recording head 32. An image is recorded on the recording paper by ink droplets being ejected from the nozzles 84 on the recording paper conveyed continuously along the paper-conveying route. It should be noted that the inkjet recording unit 30 has at least four colors arranged therein corresponding to each color of YMCK for recording, for example, what is known as full-color images.

Figure 3:
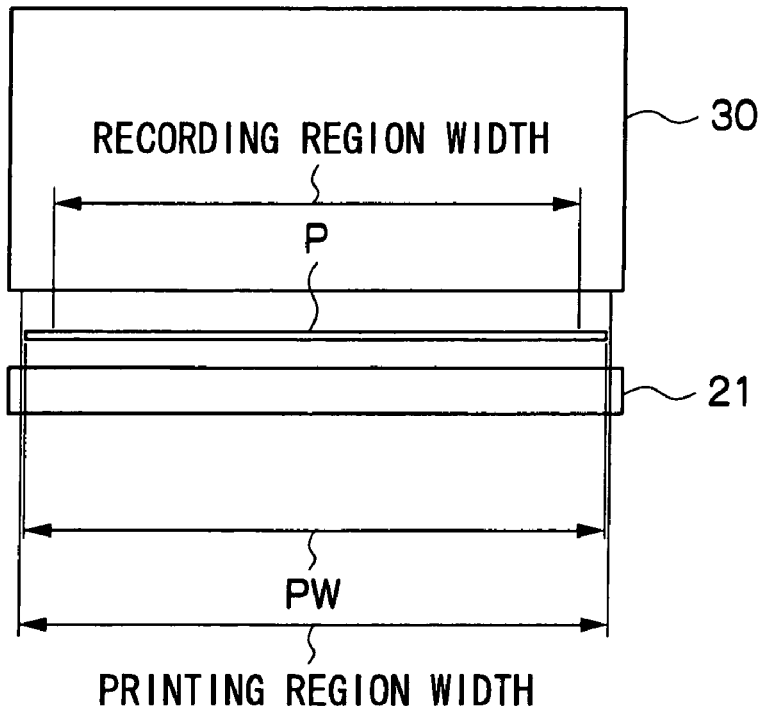
FIG. 3 is a drawing the printing region of the inkjet recording unit of the first embodiment.

As shown in FIG. 3, the width of the printing region covered by the nozzles 84 of each of the inkjet recording units 30 is made to be longer than the greatest paper width PW of the recording paper onto which it is assumed that image recording with this inkjet recording device 10 will be performed. Image recording is possible across the entire width of the recording paper P without moving the inkjet recording unit 30 in the widthwise directions of the paper (i.e., full width array (FWA) printing). Here, the basis of the printing region are the largest areas inside the recording region from which the margins, which are not printed, from both ends of the paper are excluded, but this is generally larger than the largest paper width PW that is printed. This is due to the fact that there is a danger of the paper inclining from the preset angle relative to the conveying direction (i.e., skewing) and also there is a great demand for no-edge printing.

Figure 4:
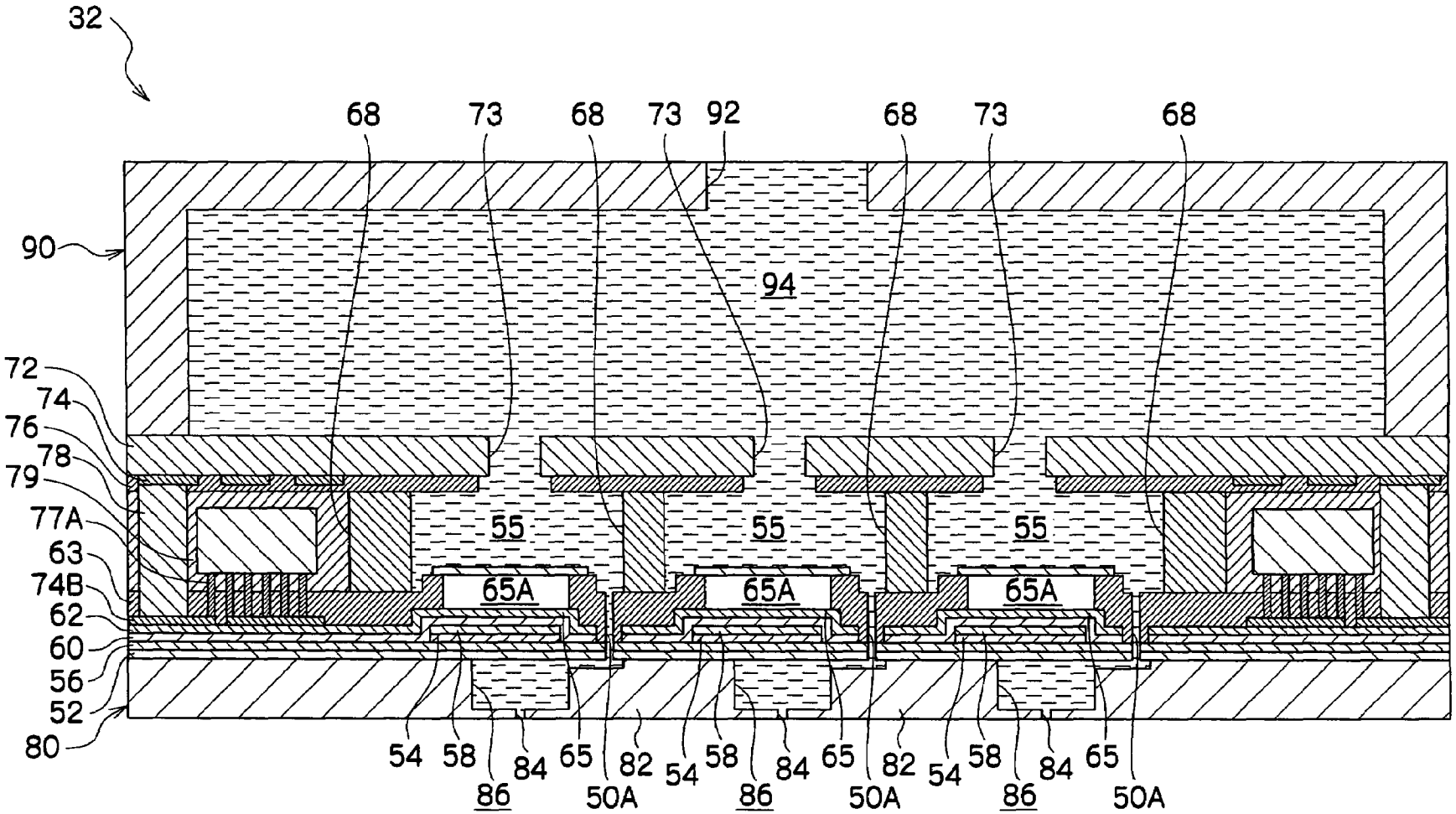
FIG. 4 is a cross-sectional drawing showing the structure of the inkjet recording head of the first embodiment.
Figure 5B:
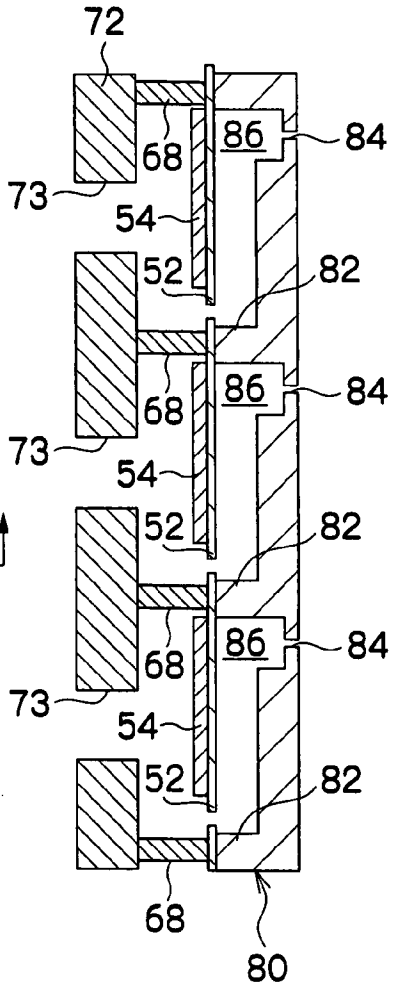
FIG. 5B and FIG. 5C are drawings showing the cross-sectional surface of parts of the inkjet recording head of the first embodiment.

Next, detailed explanations will be given regarding the inkjet recording head 32 in the inkjet recording device 10 configured as described above. FIG. 4 is a schematic diagram showing the cross-sectional structure of the inkjet recording head 32, and FIG. 5A-5C is a schematic diagram of portions of FIG. 4 from a planar view.

Figure 6:
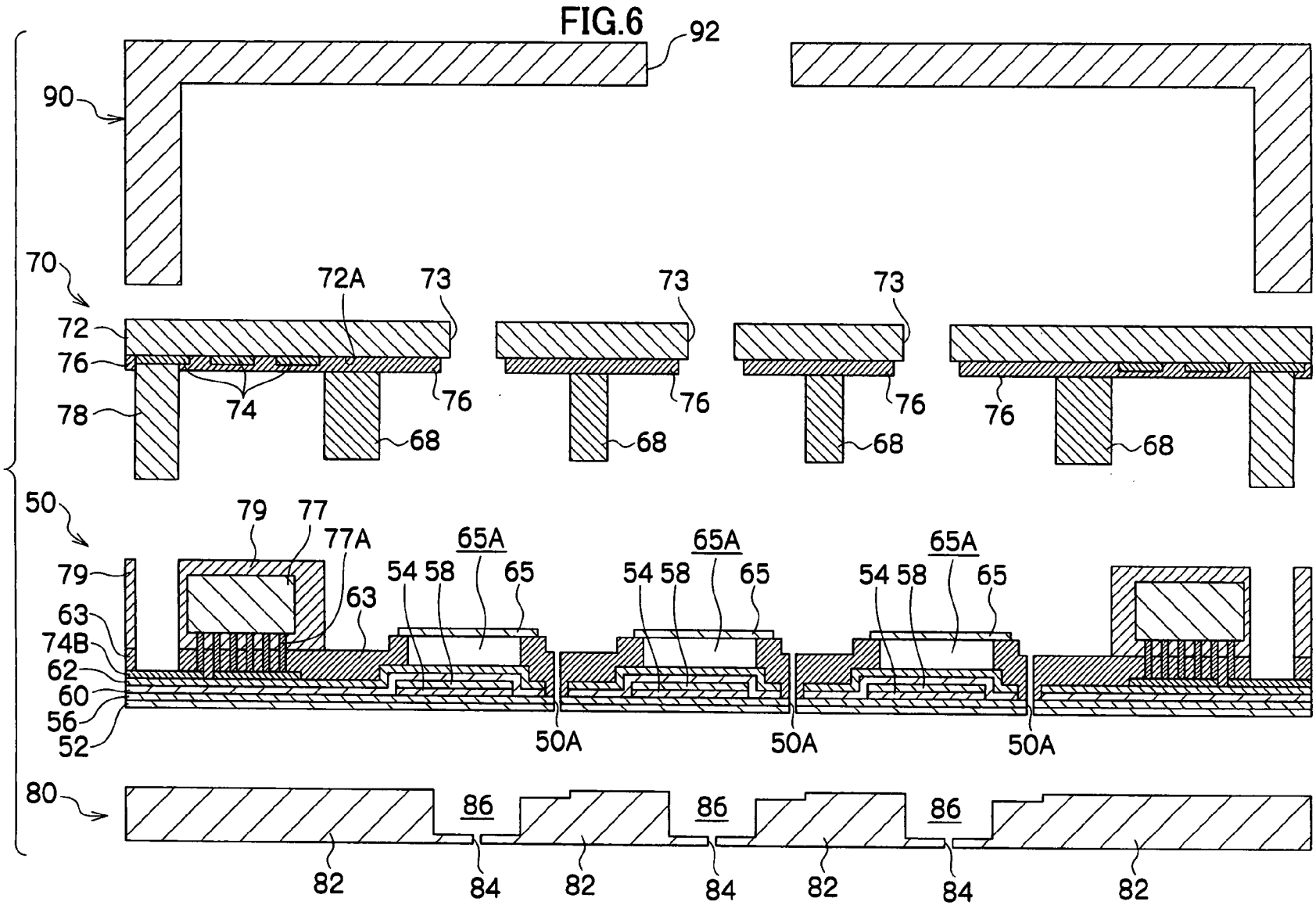
FIG. 6 is a cross-sectional drawing showing the inkjet recording head of the first embodiment exploded into each of the main parts.

As shown in FIG. 6, the inkjet recording head 32 of the present embodiment comprises a channel substrate 80, piezoelectric element substrate 50, first upper substrate 70, and an ink pool component 90 stacked and arranged in this order from the bottom side.

Figure 5A:
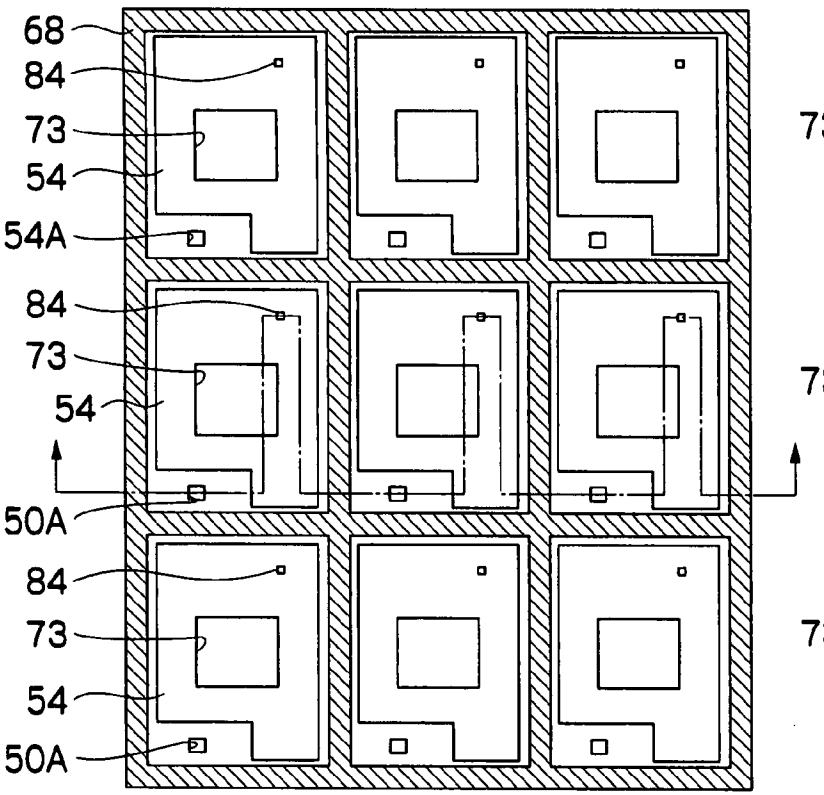
FIG. 5A is a drawing showing the planar surface of a part of the inkjet recording head of the first embodiment.
Figure 5C:
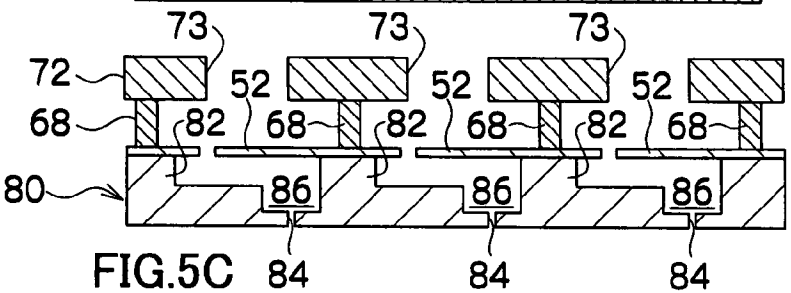

As shown in FIGS. 4, 5A, and 6, nozzles 84 that eject ink droplets are formed in a matrix pattern (refer to FIG. 2) in the channel substrate 80, and pressure chamber 86 communicated with the nozzles 84 are formed at each nozzle 84. Ink is filled in the pressure chamber 86. Each pressure chamber 86 is partitioned by a pressure chamber dividing wall 82.

An ink supply port 92 communicated with an ink tank (not shown) is provided in the ink pool component 90. The ink pool component 90 forms a common ink pool chamber 94 having a preset shape and volume between the first upper substrate 70 arranged at the bottom side thereof. Ink injected from the ink supply port 92 is accumulated in the common ink pool chamber 94.

The first upper substrate 70 is configured including a glass substrate 72 that is an insulating body having the strength to act as a supporting body. Glass is used in the present embodiment, however, this can be configured from other materials such as ceramic, silicon, resin, and the like.

Metal wiring 74 is formed at the underside surface of the glass substrate 72 (hereafter, at the "facing surface 72A") in order to pass current to a drive IC 77, which will be described later. This metal wiring 74 is covered and protected by a resin layer 76 so as to prevent its corrosion by ink.

Bumps 78 are provided at the metal wiring 74. The bumps 78 are electrically connected to an upper electrode 58 of the piezoelectric element substrate 50, which will be described later, and are made such so as to be thicker than the thickness of the drive IC 77 mounted on the glass substrate 72. The drive IC 77 and a piezoelectric element 54 are electrically connected via the metal wiring 74 due to the bumps 78.

Through-holes 73 for supplying ink accumulated in the common ink pool chamber 94 to lower ink pool chamber 55 are formed in the glass substrate 72. A through-hole 73 is formed individually for each pressure chamber 86.

The piezoelectric element substrate 50 is configured to include a diaphragm 52 and the piezoelectric element 54.

The diaphragm 52 is arranged on the upper side of the channel substrate 80 and forms the upper portion of each of the pressure chamber 86. The diaphragm 52 is formed from a metal such as SUS and has elasticity in at least the up and down directions, and is configured to flex deform (i.e., displace) in the up and down directions when current is passed to the piezoelectric element 54 (i.e., when voltage is applied thereto). It should be noted that even if the diaphragm 52 is an insulating material such as glass, there are no disadvantageous effects in this regard.

The piezoelectric elements 54 are arranged in a matrix pattern and provided one for each pressure chamber 86 and when viewed as a flat surface, cover the pressure chamber 86. A lower electrode 56 acting as a one-way polar is arranged at the undersurface of the piezoelectric element 54, and an upper electrode 58 acting as a polar in the other way is arranged at the upper surface of the piezoelectric element 54. The lower electrode 56 side is adhered to the diaphragm 52, and the upper electrode 58 side faces the first upper substrate 70. It should be noted that the diaphragm 52 made of metal (e.g., SUS) contacting the lower electrode 56 is also made to function as low-resistance GND wiring. Further, the drive IC 77 is electrically connected to the upper electrode 58 by metal wiring 74B.

Further, the piezoelectric element 54 is covered and protected by an insulating layer having low water-permeability (hereafter, simply referred to as "SiOx layer 60"). Since the SiOx film 60 that covers and protects the piezoelectric element 54 is coated thereon with the condition that moisture permeation becomes lower, penetration of moisture into the interior of the piezoelectric element 54 and the ruining of reliability (i.e., deterioration of piezoelectric qualities occurring due to reduction of oxygen within the so-called PZT coating) can be prevented.

Moreover, the upper surface of the SiOx layer 60 is covered and protected by a resin layer 62. Due to this, resistance against corrosion by ink is ensured. Further, the metal wiring 74B is arranged on the upper surface of the resin layer 62.

The upper surface of the resin layer 62 is covered by a resin component 63. The metal wiring 74B is also covered and protected by the resin component 63 so that corrosion by ink is prevented. Nonetheless, the upper part of the piezoelectric element 54 is covered and protected by the resin layer 62 and configured so as to not be covered by the resin component 63. Since the resin layer 62 is a resin layer having flexibility, configuring the device in this manner prevents displacement inhibition of the piezoelectric element 54 (and the diaphragm 52) so this lends itself particularly well to being flex-deformable in the up and down directions. That is, a thin resin layer on the upper part of the piezoelectric element 54 makes the suppression effect of displacement inhibition even higher, so this is made so as to not cover the resin component 63. A resin layer air damper 65 that alleviates pressure waves is provided on the upper surface of the resin component 63 so as to face the piezoelectric element 54. Spaces 65A are formed in the upper portion of the piezoelectric element 54 and due to this configuration, inhibition of the displacement of the piezoelectric element 54 (and diaphragm 52) is prevented.

A rib dividing wall 68 is provided between the piezoelectric element substrate 50 and the first upper substrate 70. The rib dividing wall 68 is joined to the resin component 63 and forms the lower ink pool chamber 55 between the piezoelectric element substrate 50 and the first upper substrate 70. As shown in FIG. 5A, the rib dividing wall 68, in plane view, is arranged so as to encircle the outer side of the piezoelectric element 54 along a position that corresponds to the pressure chamber dividing wall 82. As shown in FIG. 4, the lower ink pool chamber 55 is partitioned of by the rib dividing wall 68 into individual pool chambers divided into each piezoelectric element 54.

The drive ICs 77 are mounted on the piezoelectric element substrate 50. The drive IC 77 are arranged on the outer sides of the lower ink pool chamber 55 regulated by the rib dividing wall 68 and between the first upper substrate 70 and the diaphragm 52, and are configured to not be exposed (i.e., not protrude) from the diaphragm 52 and first upper substrate 70. Accordingly, the inkjet recording head 32 can be made to be more compact. The peripheries of the drive IC 77 are sealed with a resin material 79.

Figure 7:
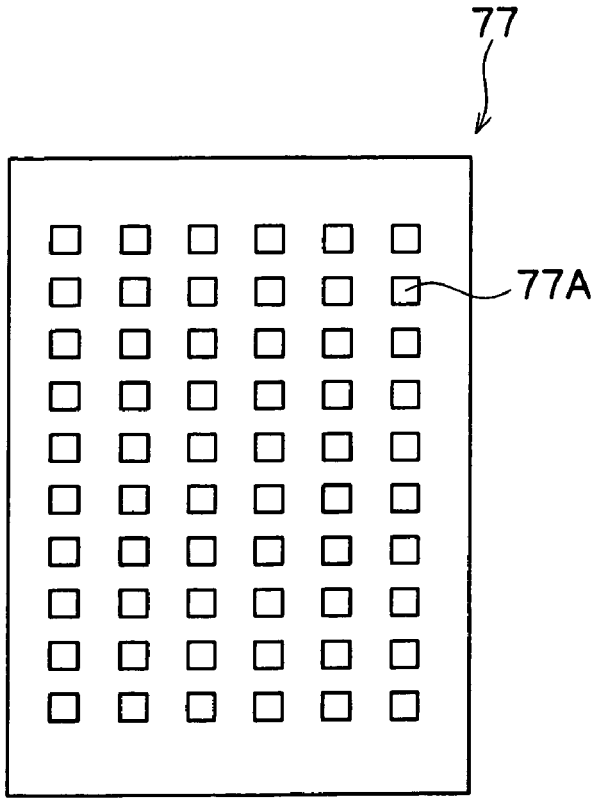
FIG. 7 is a schematic planar diagram showing the bumps of the drive IC of the first embodiment.

As shown in FIGS. 4 and 7, multiple bumps 77A are arranged on the bottom surface of the drive IC 77 in a matrix pattern so as to protrude at a preset height, and bonded by flip chips on the metal wiring 74B of the piezoelectric element substrate 50. Accordingly, connectivity at a high degree of density relative to the piezoelectric element 54 can be easily achieved and the height of the drive IC 77 can be reduced (i.e., it can be made to be thin). This also aids in making the inkjet recording head 32 more compact.

The inkjet recording device 10 has a configuration where current is passed to the metal wiring 74 of the first upper substrate 70 from the main body side, current is passed to the metal wiring 74B of the piezoelectric element substrate 50 side through the bumps 78 from the metal wiring 74, and from there, current is passed to the drive IC 77. Then voltage is applied to the piezoelectric element 54 at preset timing with the drive IC 77, ink filled in the pressure chamber 86 is pressurized due to the diaphragm 52 flex deforming in the up and down directions, and ink droplets are ejected from the nozzles 84.

Supply holes 50A communicated with the pressure chamber 86 are formed in the piezoelectric element substrate 50. The supply holes 50A are configured so as to pass through the diaphragm 52, lower electrode 56, and resin component 63. The supply holes 50A are holes that are minute and precise and which have the capability of adjusting the channel resistance of the ink. The supply holes 50A are communicated with the pressure chamber 86 due to being in communication with a horizontal channel 88 that is provided so as to extend towards the horizontal direction from the pressure chamber 86 of the channel substrate 80. This horizontal channel 88 is provided, at the time of manufacturing the inkjet recording head 32, so as to be slightly longer than the portion connecting to the actual supply holes 50A in advance so that alignment with the supply holes 50A is possible (i.e., so as to be communicated therewith with certainty).

With the inkjet recording head 32 configured as described above, the pressure chamber 86 are formed at the bottom side of the piezoelectric element substrate 50, and the common ink pool chamber 94 and lower ink pool chamber 55 are formed on the upper side of the piezoelectric element substrate 50, so these are configured such that both groups do not exist on the same horizontal plane. Accordingly, it becomes possible to arrange the pressure chamber 86 in a state where they are in close proximity with each other, and the nozzles 84 can be arranged with high density in a matrix pattern. Specifically, the nozzle resolution in electric connections with conventional FPC systems have had a limit of 600 npi (nozzles per inch), however, with the system of the present invention, a 1200 npi arrangement was easily made possible. Further, with regard to size, the present invention does not utilize FPC so in comparison to the example of a 600 npi nozzle arrangement, a size of half or less was made possible.

Moreover, the common ink pool chamber 94 is wide and there is little dead water region so bubbles can be adequately removed.

Further, the rib dividing wall 68 is provided so as to contact the piezoelectric element substrate 50 and the first upper substrate 70 along a position corresponding to the pressure chamber dividing wall 82 between the piezoelectric element substrate 50 and the first upper substrate 70, so the joining of the channel substrate 80 and the piezoelectric element substrate 50 can be performed well with the manufacturing process of the inkjet recording head 32. Further, the strength of the inkjet recording head 32 can be increased.

Next, the manufacturing process of the inkjet recording head 32 configured as described above will be explained in detail based on FIGS. 8 through 13.

Figure 8:
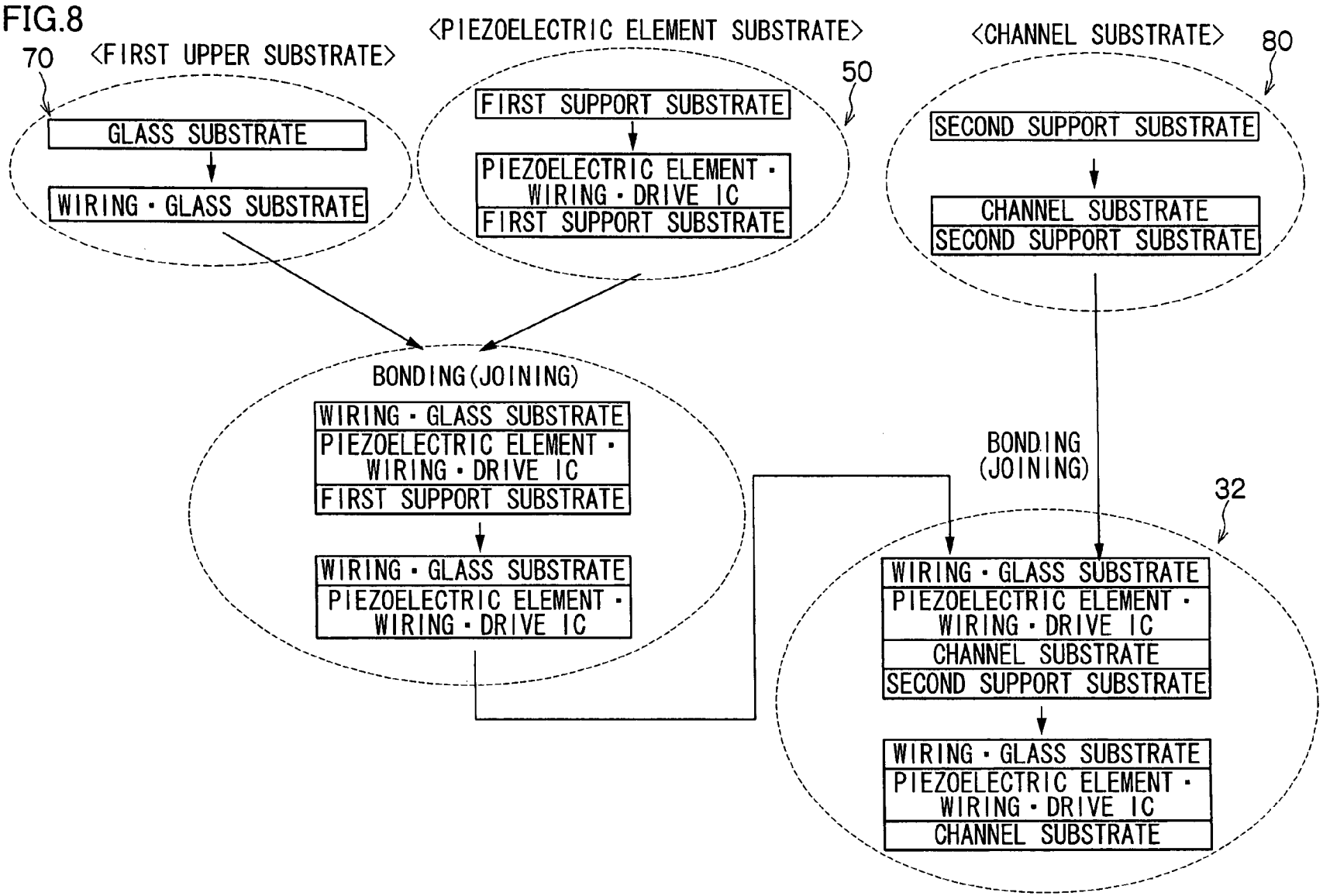
FIG. 8 is an explanatory diagram of the entire process for manufacturing the inkjet recording head of the first embodiment.

As shown in FIG. 8, this inkjet recording head 32 is manufactured by making each of the first upper substrate 70, piezoelectric element substrate 50, and channel substrate 80 separately and by attaching (i.e., joining) these. Here, the manufacturing process of the piezoelectric element substrate 50 will be explained.

Figures 9A, 9B, 9C, 9D, 9E, 9F:
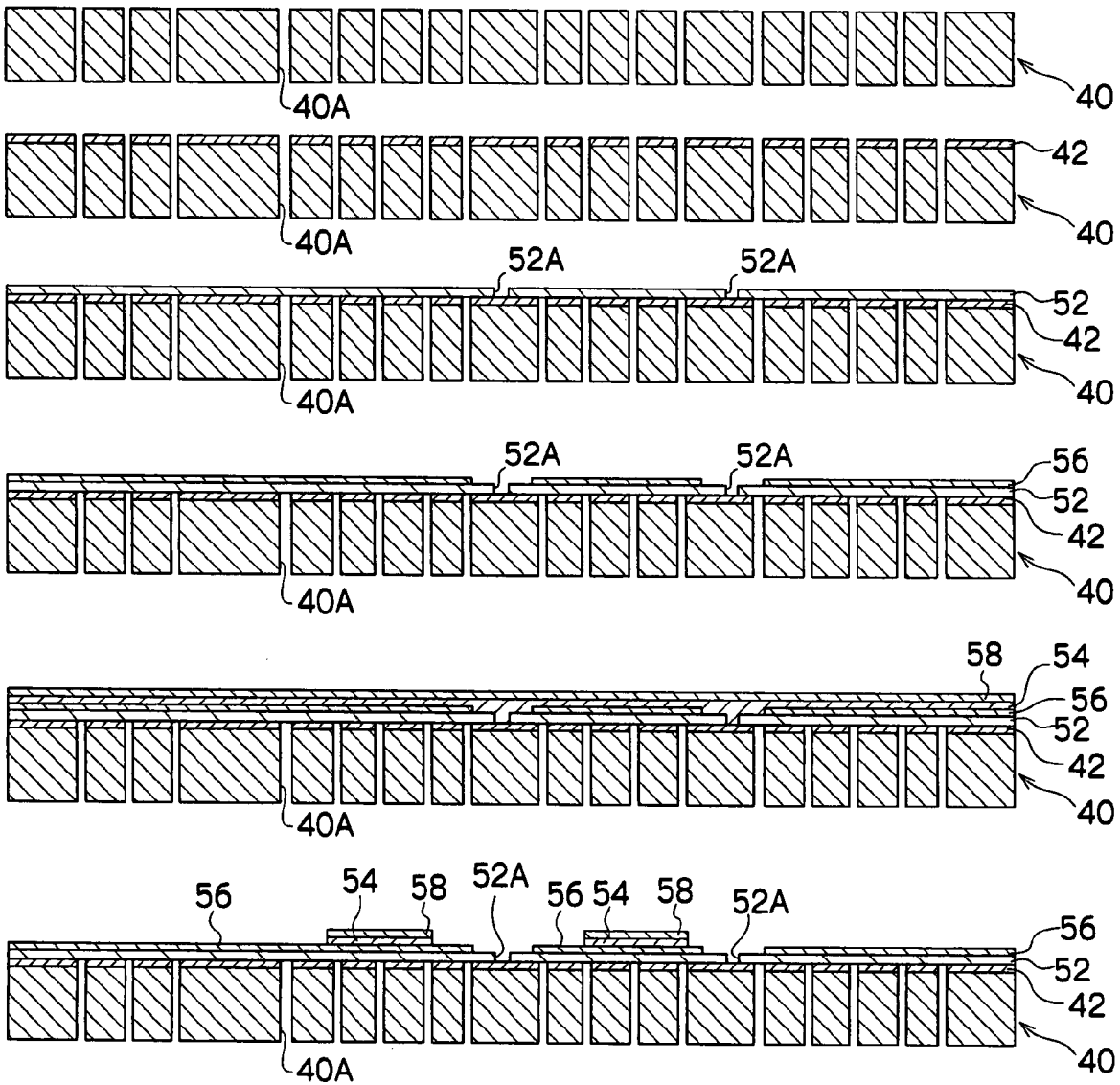
FIGS. 9A-FIG. 9K are explanatory diagrams showing the processes of manufacturing a piezoelectric substrate.

First, as shown in FIG. 9A, a first support substrate 40 made of glass in which multiple through-holes 40A are maid is prepared. The first support substrate 40 can be made from any material as long as it does not flex, and although it is not limited to glass, glass is preferable in that it is both hard and cheap. With regard to the method of making this first support substrate 40, blast processing of a glass substrate and femtosecond laser processing are known, and others as well as exposing and developing a photosensitive glass substrate (e.g., the PEG3C made by the Hoya Corporation).

Then, as shown in FIG. 9B, a resin adhesive 42 is coated on the upper surface (surface) of the first support substrate 40 and then, as shown in FIG. 9C, the diaphragm 52 made of metal (e.g., SUS) is adhered to the upper surface thereof. At this time, the through-holes 52A of the diaphragm 52 and the through-holes 40A of the first support substrate 76 are made so as to not be compounded (i.e., so as to not overlap). It should be noted that there are no adverse affects to using an insulating substrate such as glass and the like for the material of the diaphragm 52.

Here, the through-holes 52A of the diaphragm 52 are formed for the use of the supply holes 50A. Further, providing the through-holes 40A in the first support substrate 40 is for the pouring in of a chemical (i.e., solvent) at the interface of the first support substrate 40 and diaphragm 52 at a later process, and for liquefying the resin adhesive 42 and separating the first support substrate 40 thereof from the diaphragm 52. Further, the through-holes 40A of the first support substrate 40 and the through-holes 52A of the diaphragm 52 are made to not overlap so that each of the types of materials used during manufacturing do not seep from the bottom surface (i.e., back surface) of the first support substrate 40.

Next, as shown in FIG. 9AD, the lower electrode 56 layered on the upper surface of the diaphragm 52 is patterned. Specifically, this is patterned by resist formation with metal layer sputtering (with a layer thickness of between 500 Å and 3000 Å) or with a photolithographic method, or by resist peeling with patterning (RIE) or oxygen plasma. This lower electrode 56 becomes the ground potential.

Further, as shown in FIG. 9E, a PZT layer piezoelectric element 54 that is the piezoelectric element 54 and the upper electrode 58 are layered in this order with a sputtering method, and as shown in FIG. 9F, the piezoelectric element 54 (PZT layer) and the upper electrode 58 are patterned.

Specifically, resist formation is performed with PZT layer sputtering (with a layer thickness of 3 μm to 15 μm), metal layer sputtering (with a layer thickness of between 500 Å and 3000 Å) or with a photolithographic method, or resist peeling is performed with patterning (i.e., etching) or oxygen plasma.

It should be noted that for the electrode material of the upper and lower portions, materials having heat resistance and high compatibility with the PZT material, which is the piezoelectric element, can be used, such as Au, Ir, Ru, and Pt.

Figure 9G:
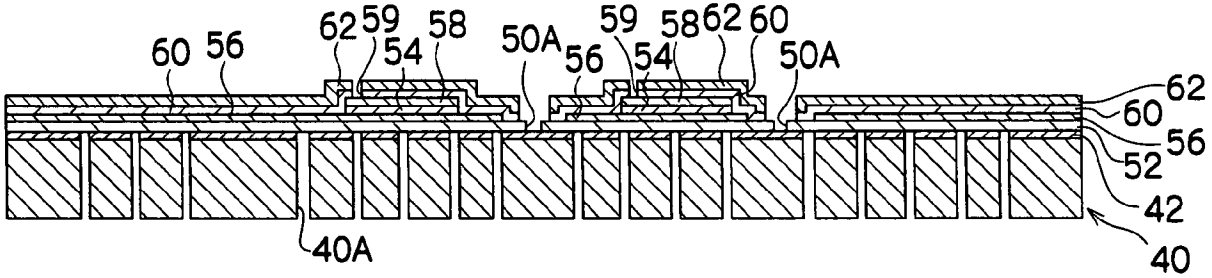

After that, as shown in FIG. 9G, the SiOx layer 60 is layered on the upper surface of the exposed lower electrode 56 and the upper surface of the upper electrode 58 and further, the resin layer 62 having ink resistance and flexibility, for example, a resin layer of polyimide, polyamide, epoxy, polyurethane, or silicon and the like, is layered on the upper surface of the SiOx layer 60. By patterning these, openings 59 (contact holes) for connecting the piezoelectric element 54 and the metal wiring 74B are formed.

Specifically, processing is carried out where the SiOx layer 60 having a high degree of dangling bond density is coated on with chemical vapor deposition (CVD); patterning is performed where a photosensitive polyimide (e.g., the photosensitive polyimide Durimide 7520 made by FUJIFILM Arch Co., Ltd.) is coated, exposed, and developed; and etching of the SiOx layer with above photosensitive polyimide as a mask is performed with a reactive ion etching (RIE) method using $CF_4$ gas. It should be noted that although a SiOx layer was used as the insulating layer having low water-permeability, another layer such as a SiNx layer or SiOxNy layer can also be used.

Figure 9H:
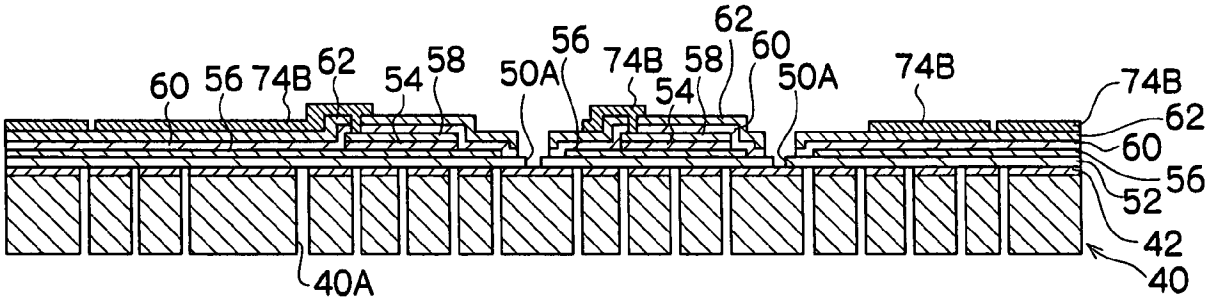

Next, as shown in FIG. 9H, a metal layer is layered on the upper electrode 58 of within the openings 59 and on the upper surface of the resin layer 62, and the metal wiring 74B is patterned. Specifically, processing is performed where an Al layer (with a thickness of 1 μm) is coated with a sputtering method, a resist is formed with a photolithographic method, the Al layer is etched with an RIE method using a chlorine-based gas, and the resist layer is peeled with oxygen plasma, and the upper electrode 58 and metal wiring 74B (Al layer) are joined. It should be noted that, although not shown, openings are provided on the lower electrode 56, and the metal wiring 74B is connected to the upper electrode 58 in the same manner.

Figure 9I:
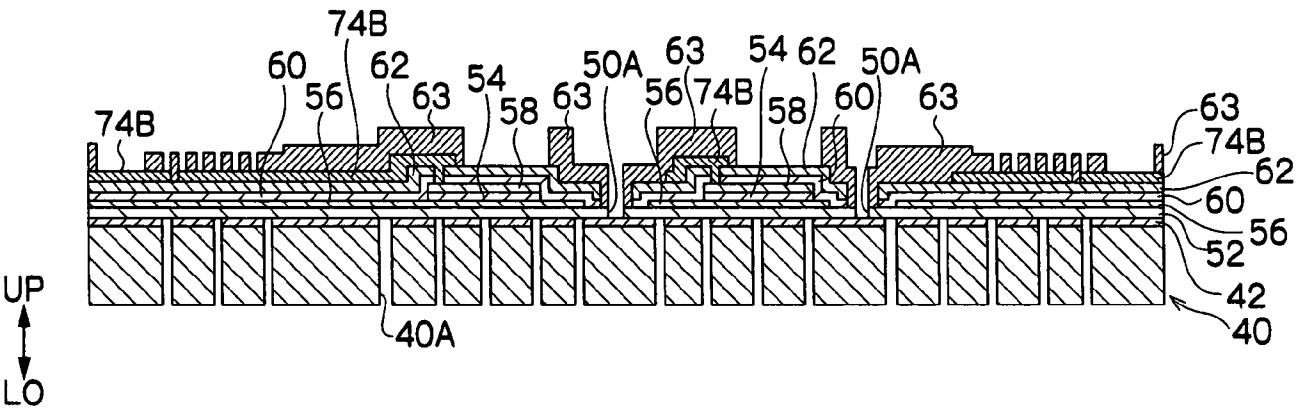

Further, as shown in FIG. 9I, the resin component 63 (e.g., the photosensitive polyimide Durimide 7320 made by FUJIFILM Arch Co., Ltd.) is layered on the upper surfaces of the metal wiring 74B and resin layer 62 and then patterned. Further, at this time, the resin component 63 is made so as to not be layered on regions where the metal wiring 74B is not patterned on the upper side of the piezoelectric element 54 (i.e., so that only the resin layer 62 is layered on).

Here, not layering the resin component 63 on the upper portion of the piezoelectric element 54 (i.e., on the upper surface of the resin layer 62) is to prevent inhibition of displacement (i.e., flex deformation in the up and down directions) of the diaphragm 52 (i.e., piezoelectric element 54). Further, covering the metal wiring 74B derived out from the upper electrode 58 of the piezoelectric element 54 (i.e., connected to the upper electrode 58) with the resin component 63 made of resin is for configuring the resin component 63 from a resin material that is of the same type as the resin layer 62 layered on the metal wiring 74B. The joining strength of these covering the metal wiring 74B becomes stronger, and corrosion of the metal wiring 74B due to ink penetrating from the interfaces can be prevented.

Notably, this resin component 63 is made from the same type of resin material as the rib dividing wall 68 as well, so the joining strength relative to the rib dividing wall 68 also becomes stronger. Accordingly, this is a configuration where the penetration of ink from the interfaces can be better prevented. Further, by configuring this with the same type of resin material, the thermal expansion coefficients of the resin component 63 and rib dividing wall 68 are substantially equal, so this is beneficial in that little heat stress is generated.

Figure 9J:
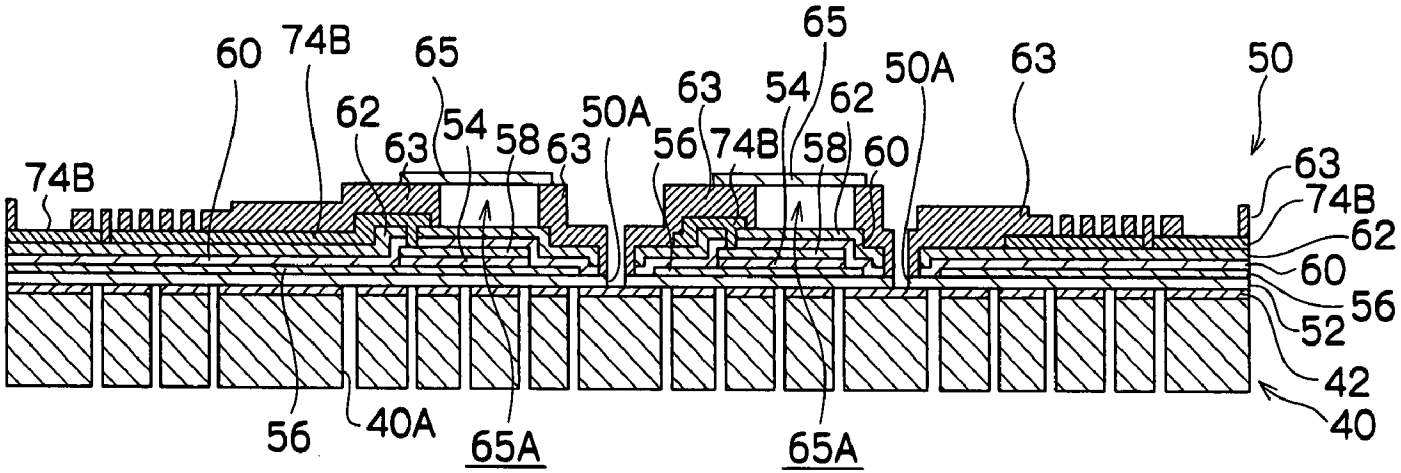

As shown in FIG. 9J, patterning (i.e., installation) is performed on the upper surface of the resin component 63 by exposing and developing the air damper 65 (e.g., Raytec FR-5025 photosensitive dry film made by Hitachi Chemical Co., Ltd., thickness of 25 μm) set to face each piezoelectric element 54 arranged in a matrix pattern.

Figure 9K:
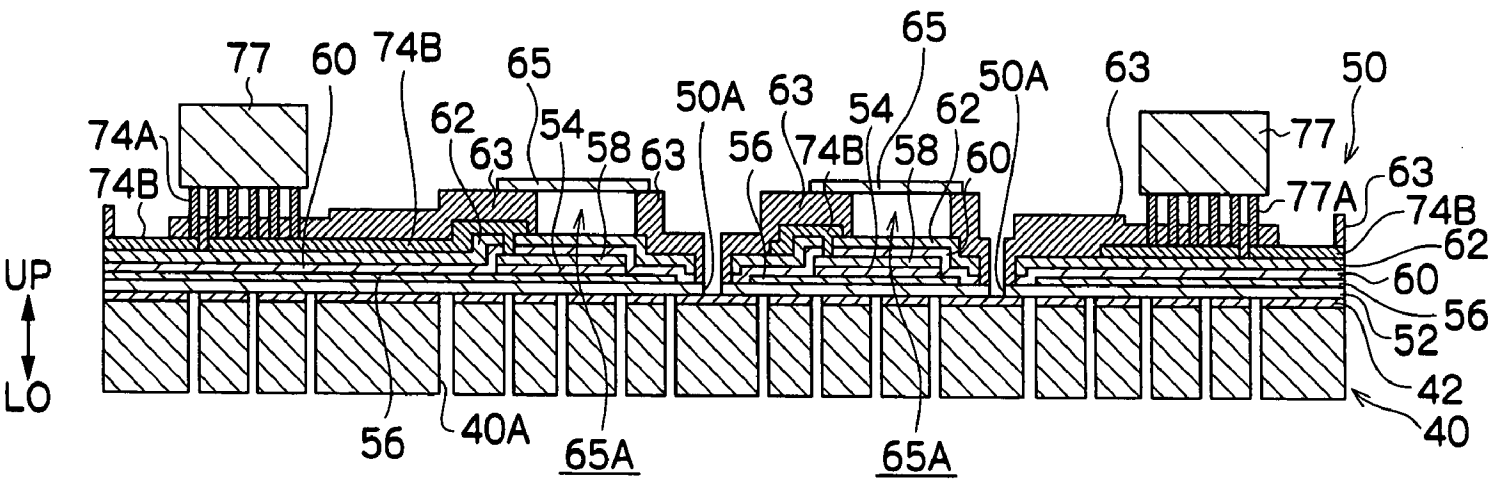

Next, as shown in FIG. 9K, the drive IC 77 are flip chip mounted on the metal wiring 74B via the bumps 77A. At this time, the drive IC 77 is processed to a preset thickness (70 μm to 300 μm) with grind processing executed at the end of semiconductor wear processing performed in advance. When the drive IC 77 is too thick, problems occur such as it becomes difficult to pattern the rib dividing wall 68 and to form the bumps 78.

Processes such as electrical plating, non-electrical plating, ball bump processing, screen printing and the like can be applied as the method of forming the bumps 77A in order to flip chip mount the drive IC 77 to the metal wiring 74B. The piezoelectric element substrate 50 is manufactured in this manner.

Next, the method of manufacturing the first upper substrate 70 will be explained. It should be noted that for the sake of convenience of explanation hereafter regarding FIGS. 10A and 10B, the wiring formation surface will be explained as the bottom surface, however, in the actual process, the surface is the upper surface.

Figures 10A, 10B, 10C, 10D:
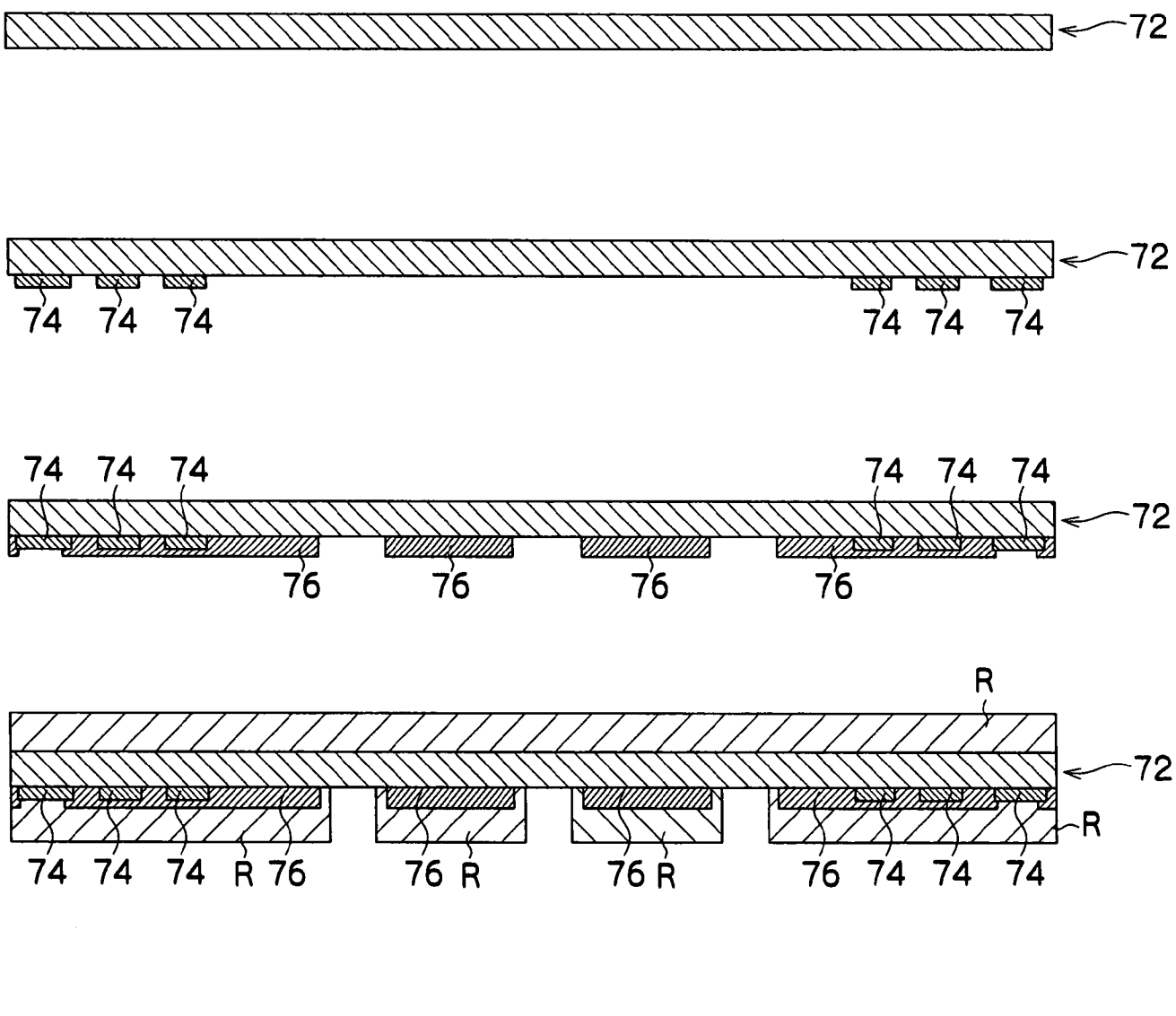
FIGS. 10A-FIG. 10G are explanatory diagrams showing the processes of manufacturing an upper substrate.

In the manufacturing method of the first upper substrate 70, as shown in FIG. 10A, a glass substrate 72 made from glass is prepared. This is not limited to being made of glass, as long as the glass substrate 72 does not flex and is thick enough to act as a support, however glass is preferable in that it is both hard and cost-effective. Notably, in the manufacturing of the first upper substrate 70, the glass substrate 72 itself is thick enough to ensure the degree of strength necessary to serve as a support, so it is unnecessary to provide a separate support.

Next, as shown in FIG. 10B, metal wiring 74 is layered on the bottom surface (surface) of the glass substrate 72 and the metal wiring 74 is patterned. Specifically, processing is performed where an Al layer (thickness of 1 μm) is coated with a sputter method, a resist is formed with a photolithographic method, the Al layer is etched with an RIE method using a chlorine-based gas, and the resist layer is peeled with oxygen plasma.

Next, as shown in FIG. 10C, a resin layer 76 is formed on the surface on which the metal wiring 74 is formed. The resin layer 76 is layered thereon so as to not cover the portions that join the bumps 78 for connection with the upper electrode 58 and the portions that join the bumps 77A for mounting the drive IC 77. Specifically, a photosensitive resin such as a polyimide, polyamide, epoxy, polyurethane, or silicon and the like having resistance to ink (e.g., the photosensitive polyimide Durimide 7320 made by FUJIFILM Arch Co., Ltd.) is layered as the resin layer 76 and formed by patterning with exposure and developing.

Next, through-holes 73 are formed in the glass substrate 72 so as to let ink pass through. As shown in FIG. 10D, formation of the through-holes 73 is performed by patterning a resist with a photolithographic method on the surface on which the metal wiring 74 of the glass substrate 72 is formed. A protective resist R is covers the entire surface on which the metal wiring 74 is not formed. Here, the reason behind coating the protective resist R is to prevent etching from the back surface of the surface on which the metal wiring 74 of the glass substrate 72 is formed with the next process of wet ($SiO_2$) etching. It should be noted that when using a photosensitive glass for the glass substrate 72, the coating process for this protective resist R can be omitted.

Figures 10E, 10F, 10G:
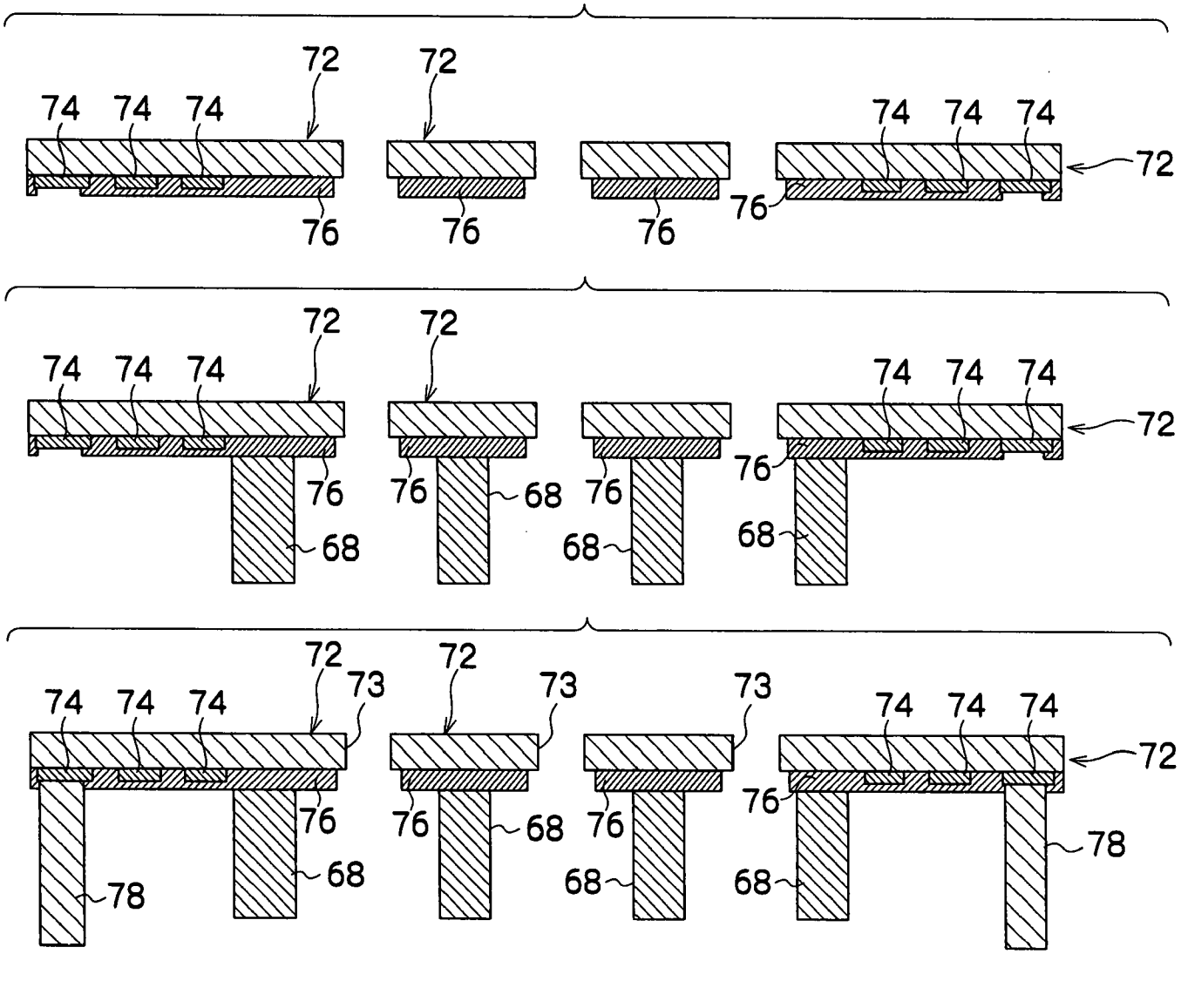

Next, as shown in FIG. 10E, wet ($SiO_2$) etching is performed on the glass substrate 72 with an HF solution, after which the protective resist R is removed with oxygen plasma.

Next, as shown in FIG. 10F, a photosensitive dry film (thickness of 100 μm) is layered on the resin layer 76, and patterning is performed with exposure and development. This photosensitive dry film becomes the rib dividing wall 68 that divides the lower ink pool chamber 55. It should be noted that the rib dividing wall 68 is not limited to a photosensitive dry film and that it can be a resin coating layer (e.g., the SU-8 resist of Kayaku Microchem). At this time, this can be coated with a spray coating device and exposed and developed.

Then at the end, as shown in FIG. 10G, bumps 78 are formed at the metal wiring 74 at which the resin layer 76 is not layered. Electrical plating, non-electrical plating, ball bump processing, screen printing and the like can be applied to forming the bumps 78. These bumps 78 are formed, as shown in the drawing, so as to be taller than the rib dividing wall 68 in order to electrically connect to the metal wiring 74B on the side of the drive IC 77.

Figure 11A:
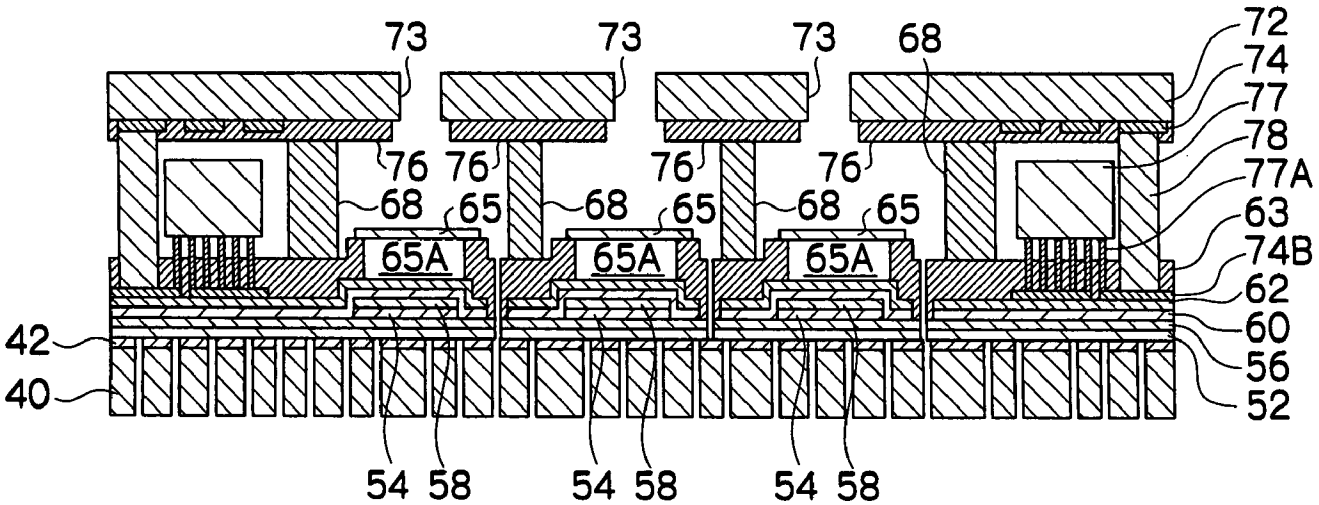
FIGS. 11A-FIG. 11D are explanatory diagrams showing the processes of joining the piezoelectric substrate to the first upper substrate.

In this manner, when the manufacturing of the first upper substrate 70 is completed, as shown in FIG. 11A, the first upper substrate 70 is overlayed on the piezoelectric element substrate 50, and these are both connected (i.e., bonded together) with thermocompression. That is, the rib dividing walls 68 are bonded to the resin component 63 that is a photosensitive resin layer and the bumps 78 are bonded to the metal wiring 74B.

At this time, the bumps 78 are taller than the rib dividing walls 68 so by joining the rib dividing walls 68 to the resin component 63, the bumps 78 are automatically joined to the metal wiring 74B. Stated differently, height adjustment of the solder bumps 78 is simple (i.e., they are easily deformed) so the sealing of the lower ink pool chamber 55 with the rib dividing walls 68 and connecting of the bumps 78 can be easily achieved.

Figure 11B:
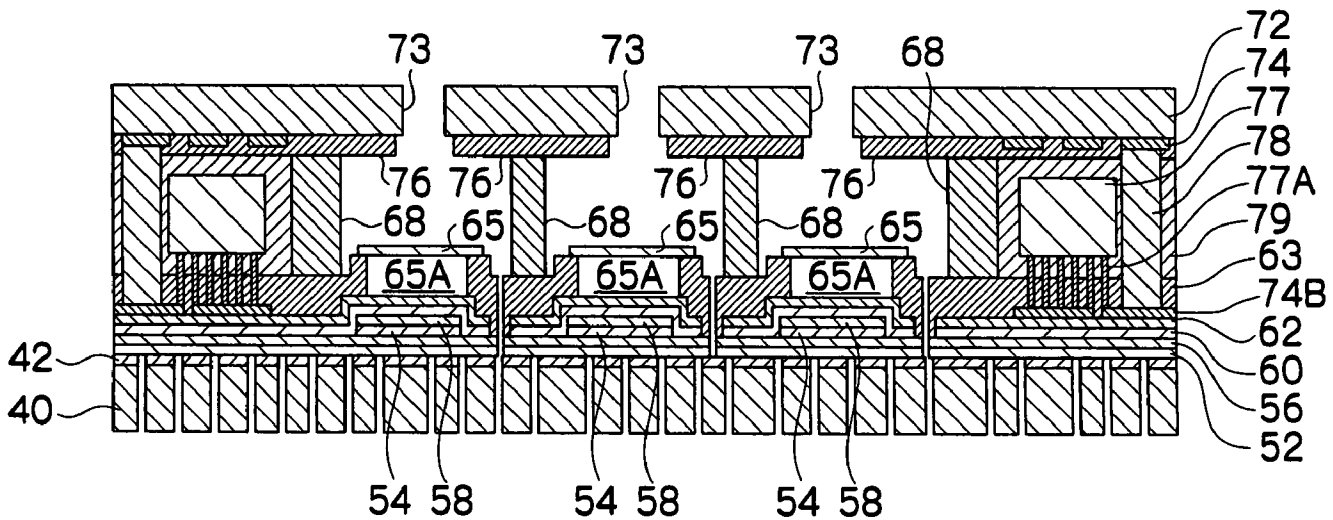

When the joining of the rib dividing walls 68 and first upper substrate 70 is completed, as shown in FIG. 11B, the resin material 79 for sealing (e.g., an epoxy resin) is injected to the drive IC 77. The injection is performed by pouring resin material 79 in from a fill port (not shown) opened in the glass substrate 72. By injecting the resin material 79 in this manner and sealing the drive IC 77, the adhesion strength between the piezoelectric element substrate 50 and the first upper substrate 70 can be improved, while the drive IC 77 can be protected from moisture and the like from the exterior environment. Further, damage due to later processes such as damage from water or grinding pieces to the completed substrate due to dicing when dividing the inkjet recording head 32 can be avoided.

Figure 11C:
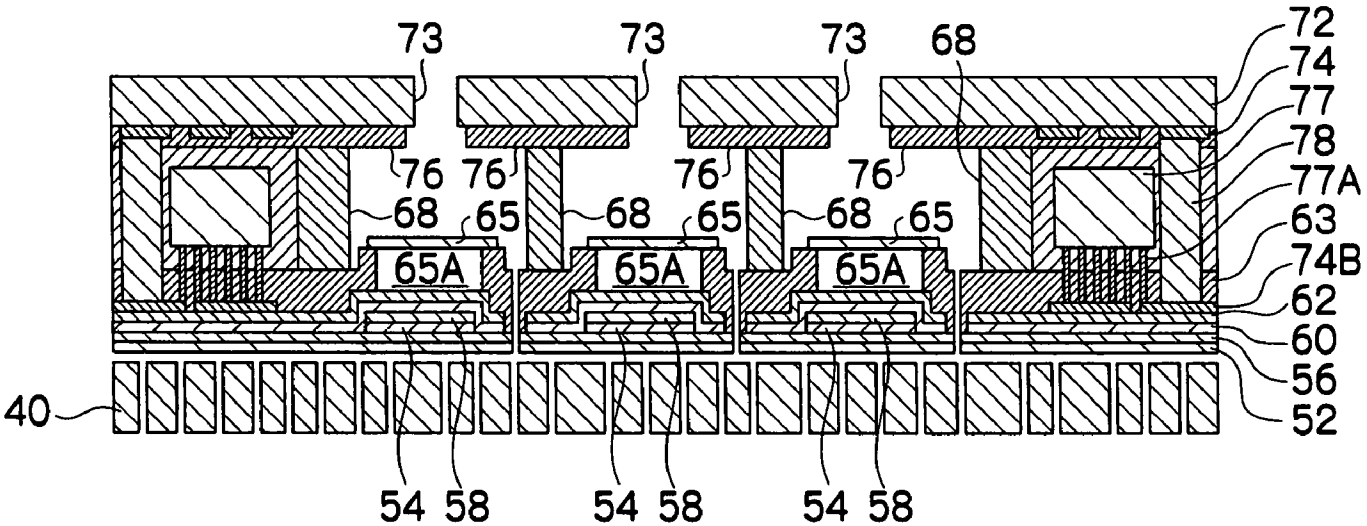
Figure 11D:
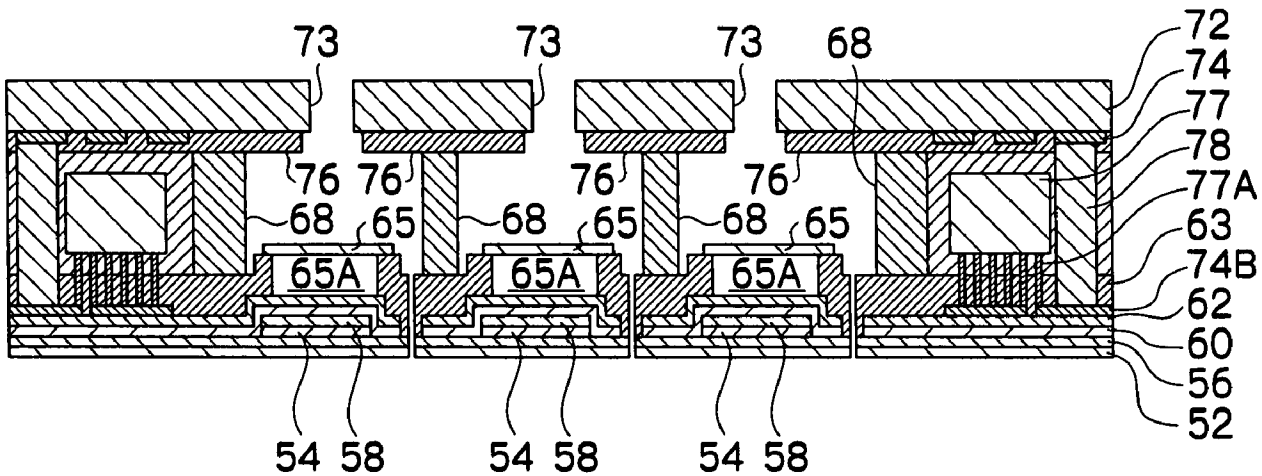

Next, as shown in FIG. 11C, a removable adhesive solution (e.g., an organic ethanol amine solvent) is injected from the through-holes 40A of the first support substrate 40, and removing processing of the first support substrate 40 from the piezoelectric element substrate 50 is performed by selectively dissolving the resin adhesive 42. Due to this, as shown in FIG. 11D, the first upper substrate 70 and the piezoelectric element substrate 50 are joined. From this state, the glass substrate 72 becomes a supporting body.

Next, the manufacturing process of the channel substrate 80 will be explained.

Figure 12A:
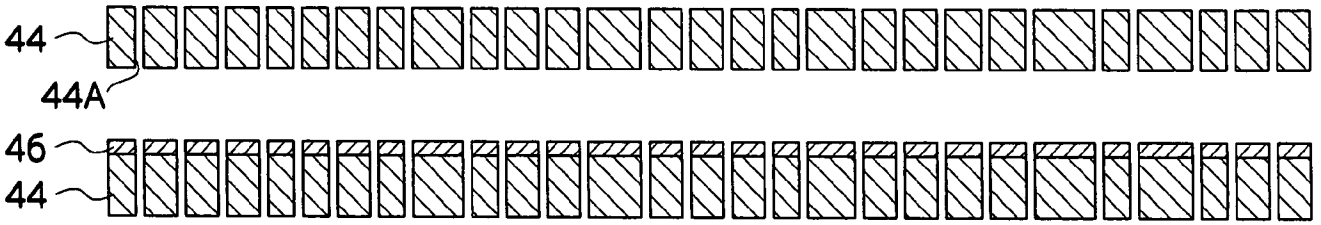
FIGS. 12A-FIG. 12D are explanatory diagrams showing the processes of manufacturing a channel substrate.

First, as shown in FIG. 12A, a glass second support substrate 44 in which multiple through-holes 44A are maid is prepared. The second support substrate 44, as with the first support substrate 40, is not limited to glass as long as it does not flex, however, glass is preferable in that it is both hard and cost-effective. With regard to methods of making this second support substrate 44, blast processing of a glass substrate and femtosecond laser processing are known, and other processes as well such as exposing and developing a photosensitive glass substrate (e.g., the PEG3C made by the Hoya Corporation).

Figure 12B:
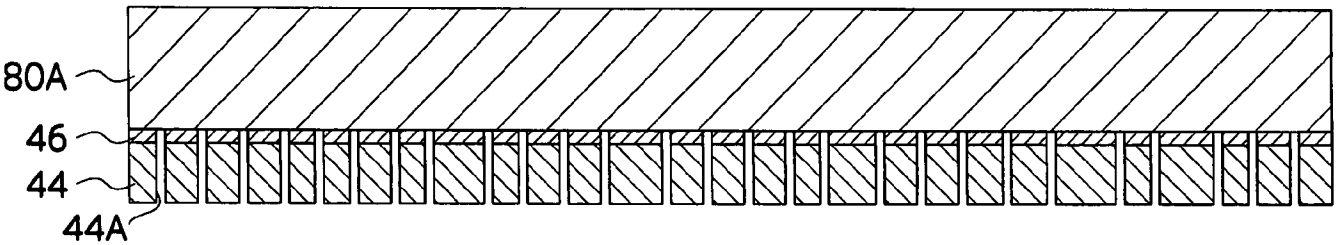
Figure 12C:
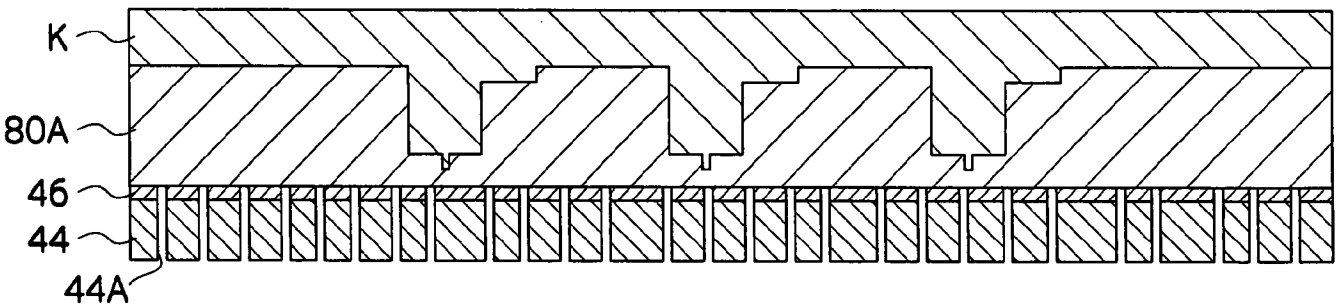
Figure 12D:
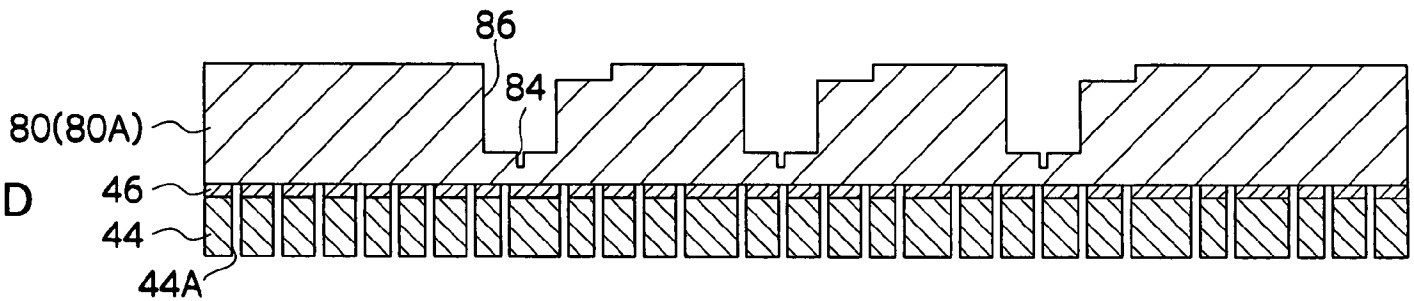

Next, as shown in FIG. 12B, a resin adhesive 46 is coated on the upper surface (surface) of this second support substrate 44, and as shown in FIG. 12C, a resin substrate 80A (e.g., an amide imide substrate with a thickness of 0.1 mm to 0.5 mm) is adhered on the upper surface (surface) thereof. Next, as shown in FIG. 12D, a metal mold K is pressed against the upper surface of the resin substrate 80A and heat/pressure processing is performed. After that, as shown in FIG. 12E, portions such as the pressure chamber 86 and the nozzles 84 are formed due to the removal of the metal mold from the resin substrate 80A, and the channel substrate 80 (attached to the second support substrate 44) is completed.

Figure 13A:
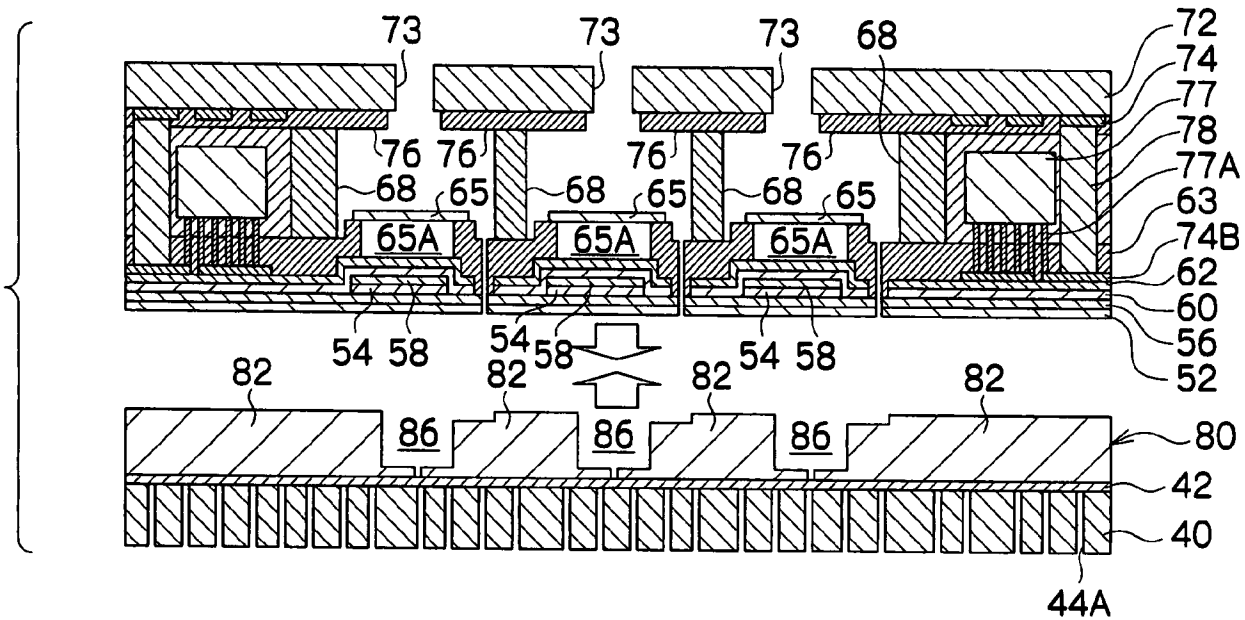
FIGS. 13A-FIG. 13F are explanatory diagrams showing the processes of joining the channel substrate to the joined bodies of the piezoelectric substrate and the first upper substrate.
Figure 13B:
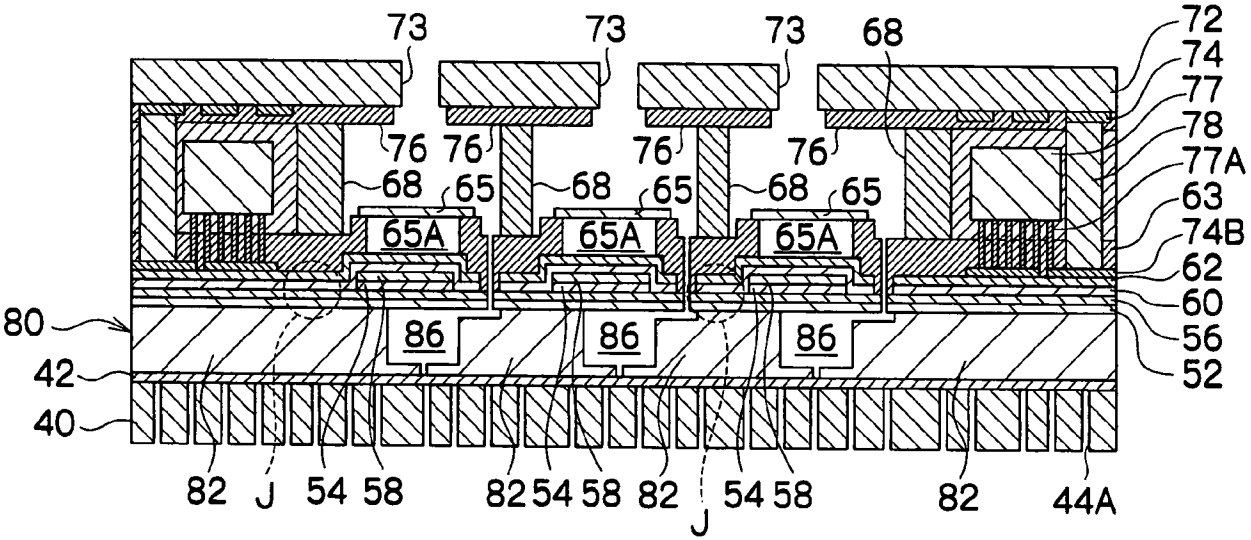

When the channel substrate 80 is completed in this manner, as shown in FIG. 13A, the side of the diaphragm 52 of the piezoelectric element substrate 50 and the side at which the pressure chamber 86 of the channel substrate 80 were formed are bonded (i.e., joined) with thermocompression. At this time, the rib dividing walls 68 are provided between the first upper substrate 70 and the piezoelectric element substrate 50 so as to be in contact with both of these so the channel substrate 80 of the pressure chamber dividing wall 82 and the diaphragm 52 of the piezoelectric element substrate 50 are pressed together. When compared to a case where the rib dividing walls 68 are left out, a good state of joining in the joined portion J in FIG. 13B can be obtained.

Figure 13C:
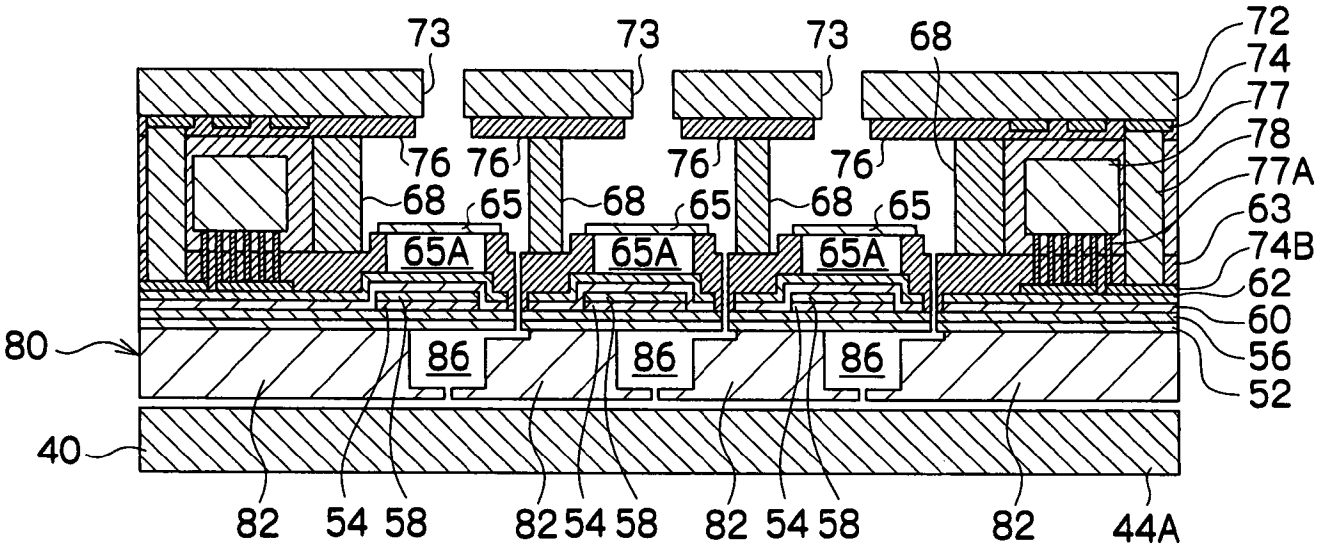

Then, as shown in FIG. 13C, a removable adhesive solution is injected in from the through-holes 44A of the second support substrate 44, and removing processing of the second support substrate 44 from the channel substrate 80 is performed by selectively dissolving the resin adhesive 46.

Figure 13D:
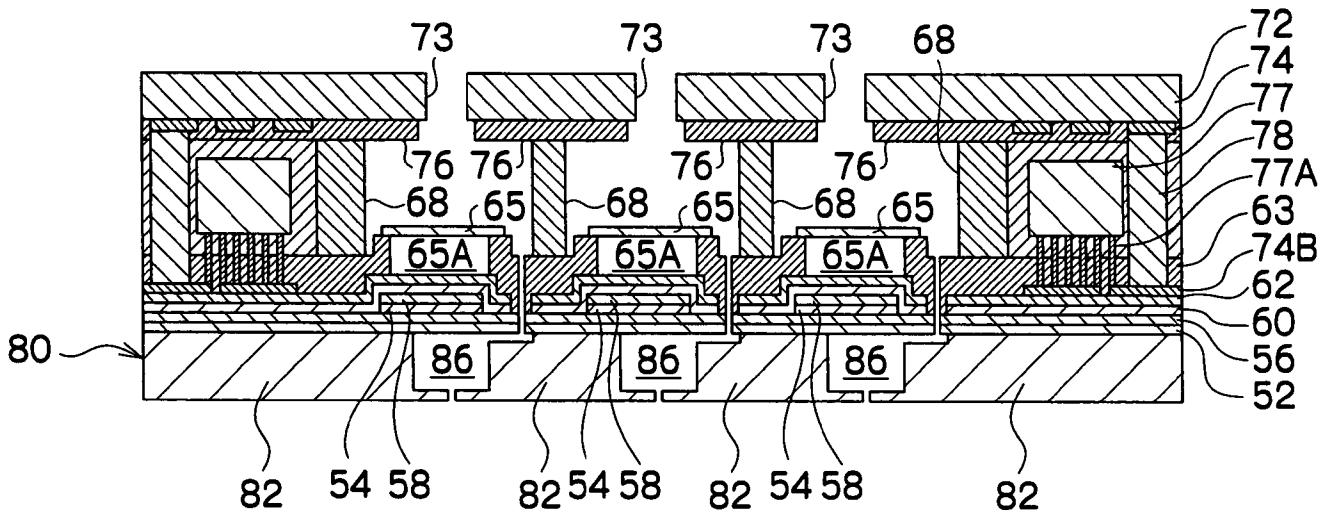
Figure 13E:
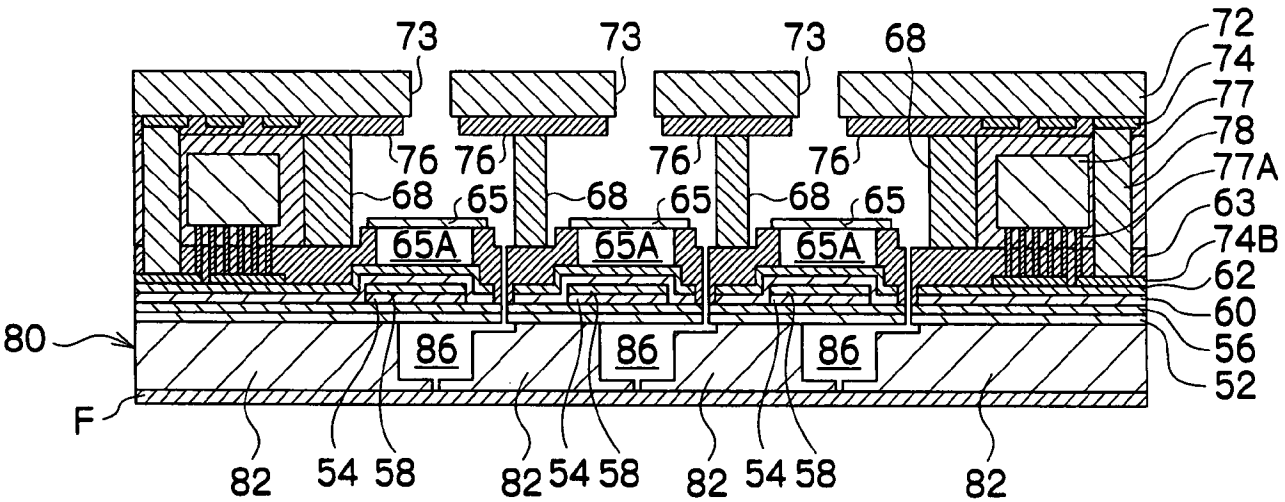

After that, as shown in FIG. 13D, a surface layer of the surface from which the second support substrate 44 was removed is removed with grinding processing using a grinding material having alumina as its principal component, or with RIE processing using oxygen plasma, whereby the nozzles 84 are opened. Then, as shown in FIG. 13E, a fluorine material F (e.g., Cytop produced by the Asahi Glass Co., Ltd.) is coated as a water repellent on the bottom surface where the nozzles 84 were opened.

Figure 13F:
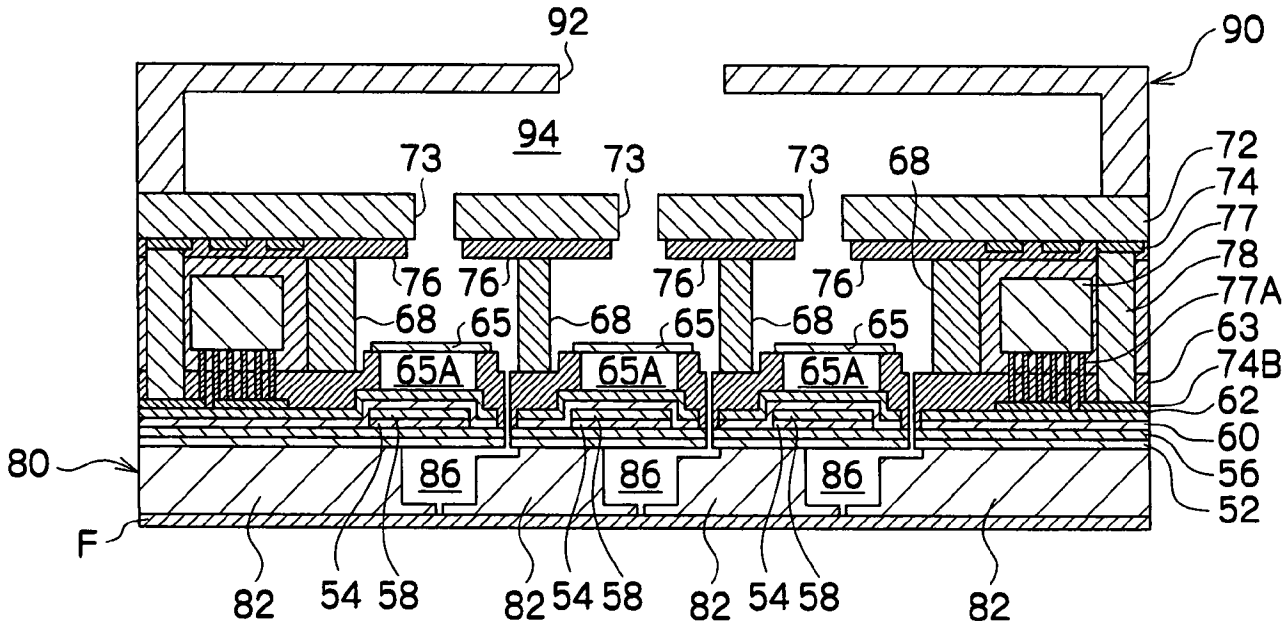

Next, as shown in FIG. 13F, by joining the ink pool component 90 to the upper surface of the first upper substrate 70, the inkjet recording head 32 is completed and ink can be filled inside the ink pool component 90 and the pressure chamber 86.

Figure 14B:
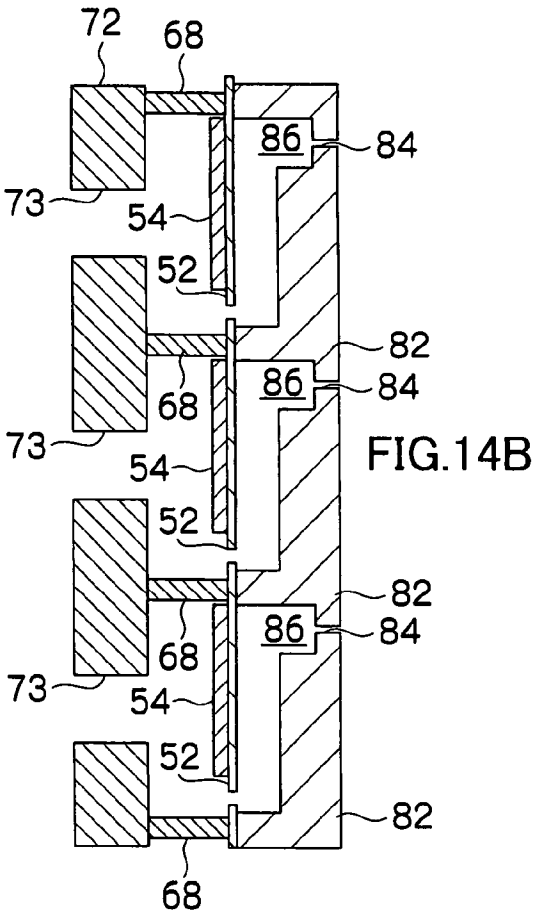
FIGS. 14A-FIG. 14C are schematic diagrams showing the structure of an alternate example of the dividing wall of an inkjet recording head of the first embodiment.
Figure 14A:
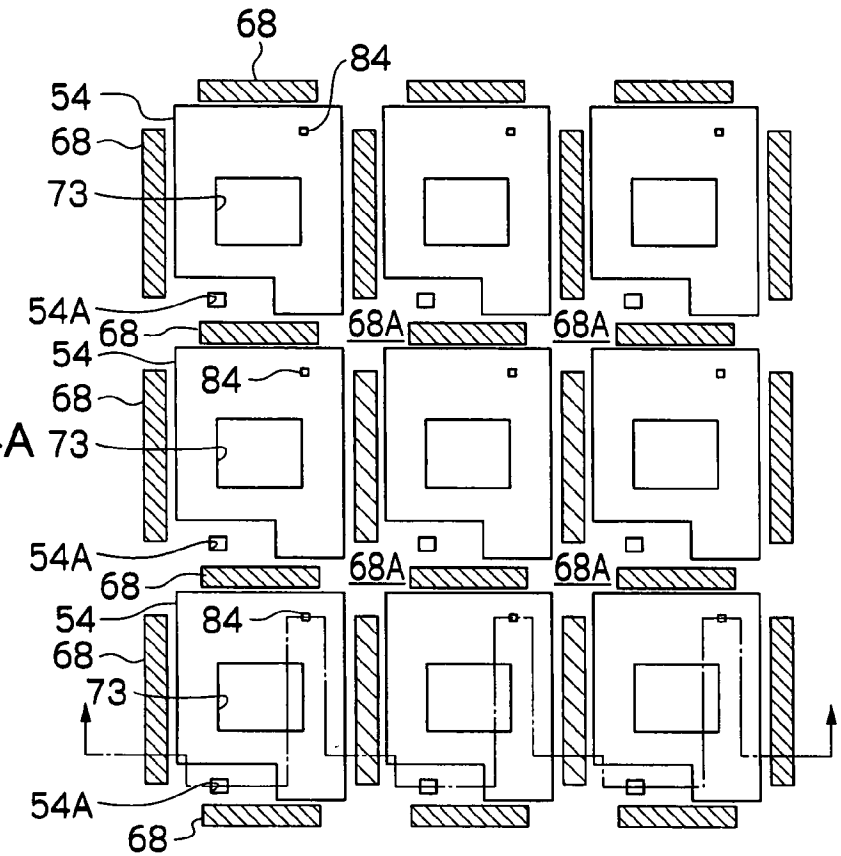
Figure 14C:
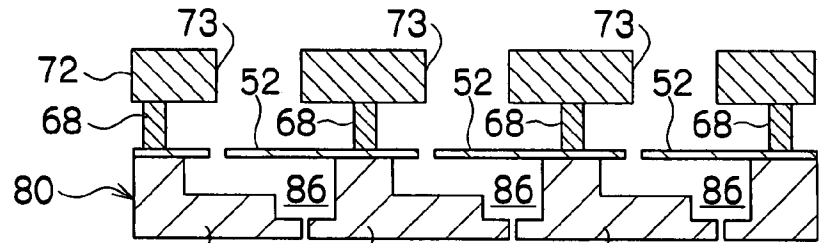
Figure 15B:
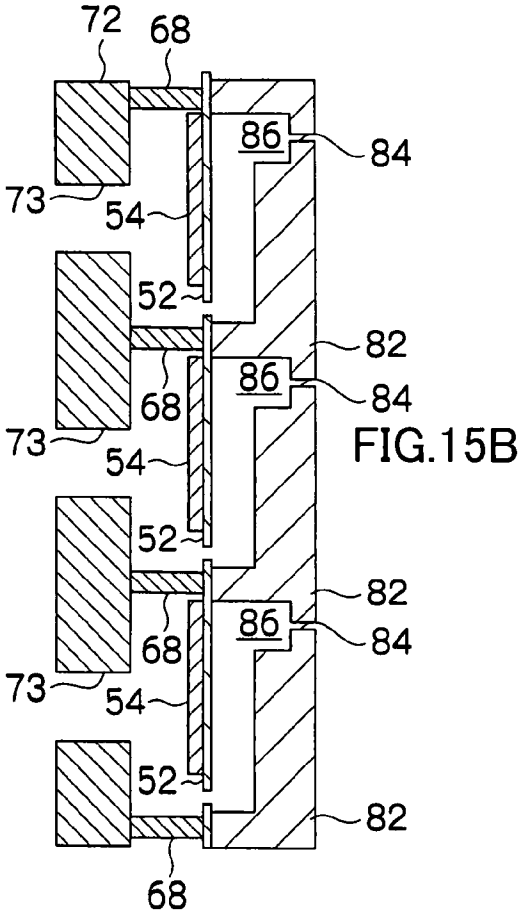
FIGS. 15A-FIG. 15C are schematic diagrams showing the structure of another alternate example of the dividing wall of an inkjet recording head of the first embodiment.
Figure 15A:
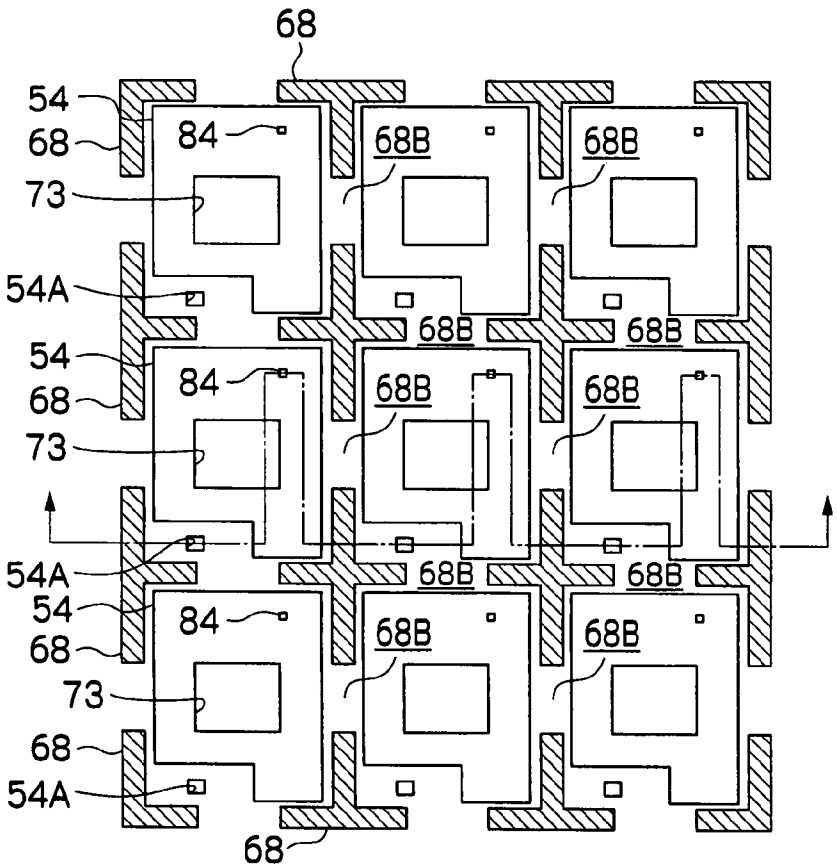
Figure 15C:
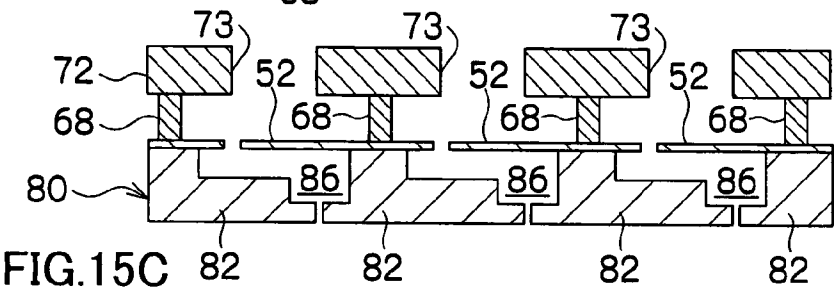

It should be noted that in the above-described embodiment, an example was explained where the rib dividing walls 68, when viewed as a planar surface, were arranged so as to surround the outer side of the piezoelectric element 54, and where the lower ink pool chamber 55 was partitioned off into individual pool chambers divided for each of the piezoelectric element 54. Nonetheless, as shown in FIG. 14A-14C, this can be configured so that intersecting dividing spaces 68A are provided at positions that intersect with the rib dividing walls 68 and the entire region of the lower ink pool chamber 55 is communicated (i.e., an intersecting portion dividing configuration). Further, as shown in FIG. 15A-15C, this can also be configured so that the rib dividing walls 68 are provided at the aforementioned positions of intersection, and interval separating portions 68B are provided in the middle between one intersecting position and another intersecting position and the entire region of the lower ink pool chamber 55 is communicated (i.e., a middle portion dividing configuration). Due to this, the flow of ink within the lower ink pool chamber 55 can be ensured and bubbles can be adequately extracted.

Figure 16B:
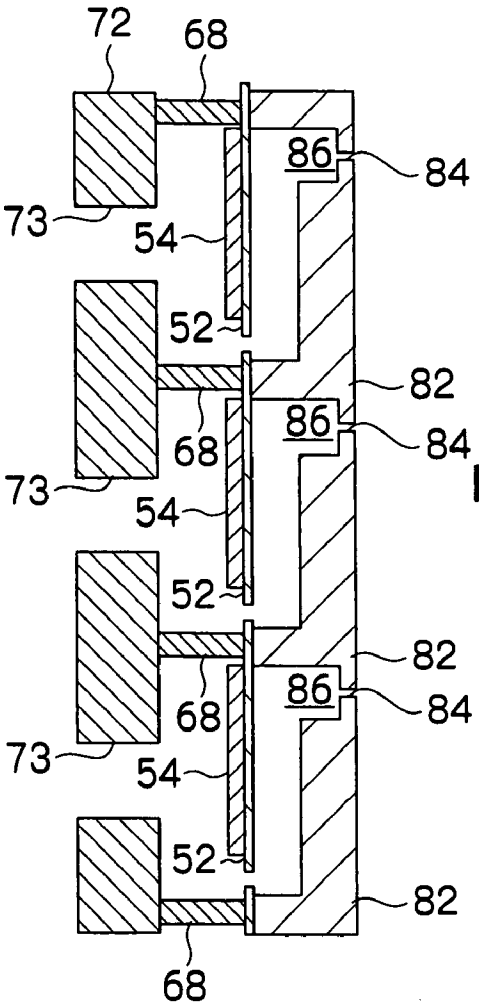
FIG. 16A and FIG. 16B are schematic diagrams showing an alternate example of a through-hole of an inkjet recording head of the first embodiment.
Figure 16A:
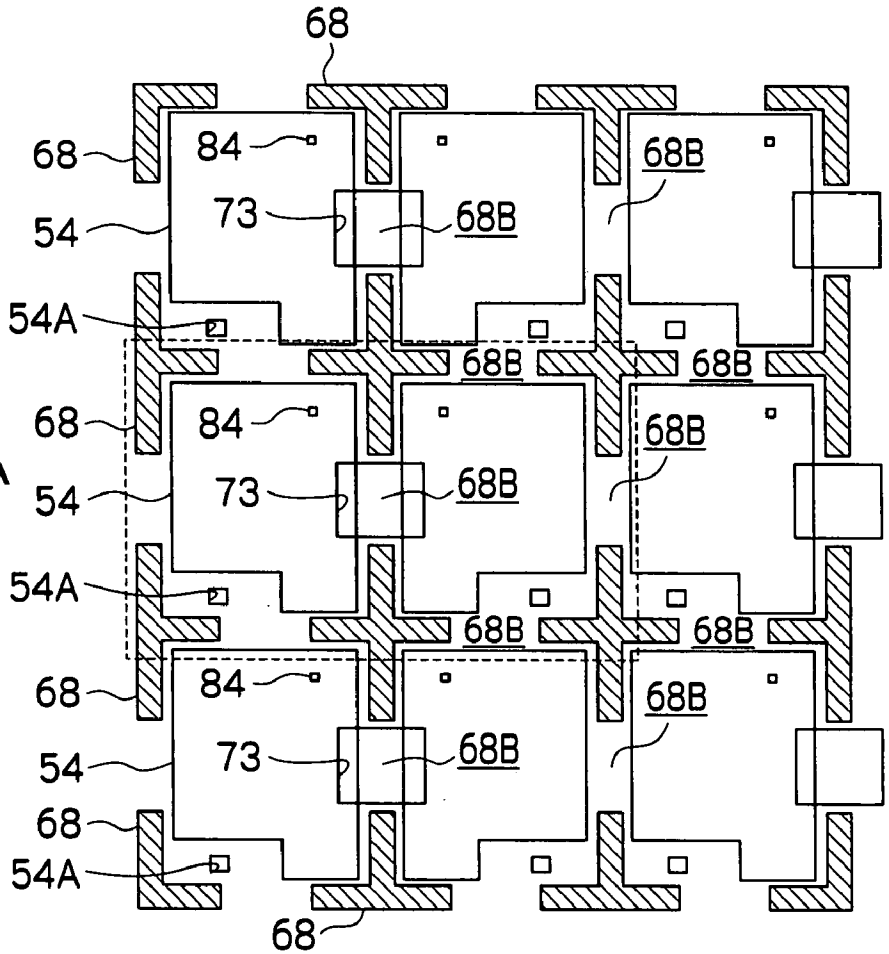
Figure 17B:
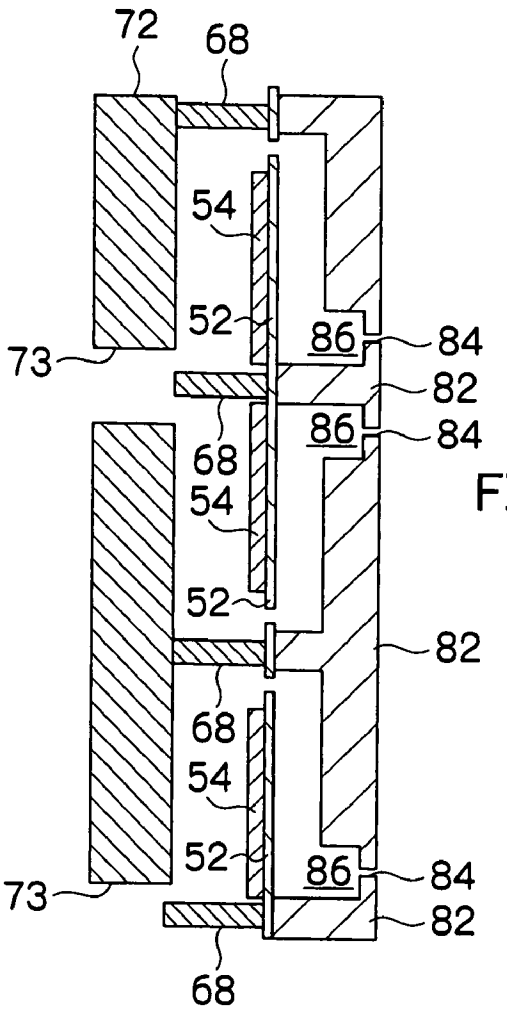
FIG. 17A and FIG. 17B are schematic diagrams showing another alternate example of a through-hole of an inkjet recording head of the first embodiment.
Figure 17A:
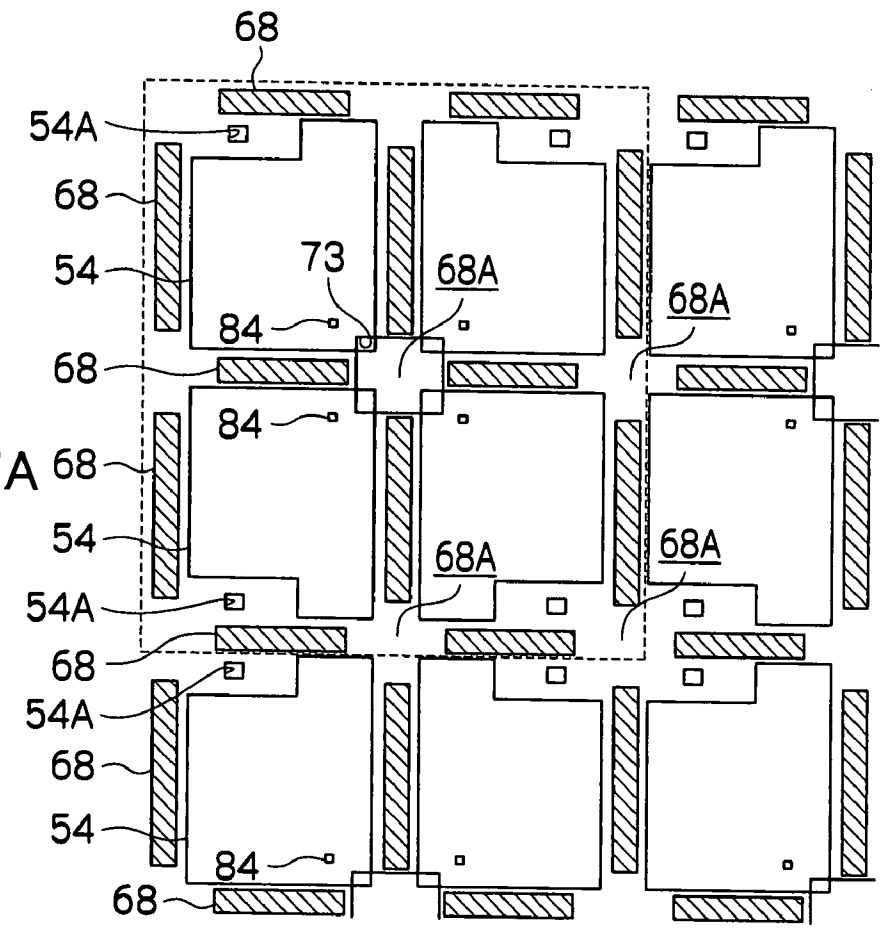

Further, in the above-described embodiment, one through-hole 73 was maid per piezoelectric element 54, however, in a case as just described above where the entire region of the lower ink pool chamber 55 is in communication, it is not absolutely necessary to form one through-hole 73 per one piezoelectric element 54. A through-hole 73 can be formed for multiple piezoelectric elements 54. For example, as shown in FIG. 16A-16B, when one through-hole 73 is formed per two piezoelectric elements 54, this can be configured such that, when viewed as a flat surface, the through-hole 73 is arranged at the upper portion of the interval separating portions 68B, and the rib dividing walls 68 act as a middle portion dividing structure. Further, as shown in FIG. 17A-17B, when one through-hole 73 is formed per four piezoelectric elements 54, this can be configured such that, when viewed as a flat surface, the through-hole 73 is arranged at the upper portion of the intersecting dividing spaces 68A and the rib dividing walls 68 act as an intersecting portion dividing structure.

In this manner, by forming one through-hole 73 per multiple piezoelectric element 54, the liquid resistance of the ink can be equalized.

Next, the operation of the inkjet recording device 10 provided with the inkjet recording head 32 manufactured as described above will be explained. First, an electric signal instructing to print is sent to the inkjet recording device 10 and one sheet of recording paper P is picked up from the stocker 24 and conveyed to the recording unit 20 with the conveying device 26.

Meanwhile, at the inkjet recording unit 30, ink is already injected (i.e., filled) into the common ink pool chamber 94 of the inkjet recording head 32 via the ink supply port 92 from the ink tank. The ink filled in the common ink pool chamber 94 is supplied to the lower ink pool chamber 55 through the through-hole 73 and supplied (i.e., filled) to the pressure chamber 86 from the lower ink pool chamber 55 through the supply holes 50A. At this time, a slightly indented meniscus forms on the surface of the ink on the side of the pressure chamber 86 at the ends (i.e., the eject openings) of the nozzles 84.

Next the recording paper P is conveyed at a preset conveying speed while ink droplets are selectively ejected from the multiple nozzles 84 of the inkjet recording head 32 whereby, based on image data, an image is recorded on the recording paper P. That is, voltage is applied to preset piezoelectric elements 54 at preset timing due to the drive IC 77, the lower electrode 56 is made to flex deform in the up and down directions (i.e., made to vibrate out-of-plane), the ink within the pressure chamber 86 is pressurized and ejected as ink droplets from preset nozzles 84, and image formation is executed.

The recording paper P is conveyed in the direction of the exit unit 22 during image formation and exited to the tray 25 by the paper-exiting belt 23. Due to this, print processing (i.e., image recording) on the recording paper P is completed.

It should be noted that with the present embodiment, an example was explained of an FWA of paper width correspondence, however, the inkjet recording head of the present invention is not limited thereto. The present invention can also be applied to a partial width array (PWA) device that has a main scanning mechanism and a sub-scanning mechanism. Since the present invention is particularly effective at realizing highly dense nozzle arrangements, it is quite suitable for FWA, which requires 1-pass printing.

Furthermore, the inkjet recording device 10 of the above-described embodiment was made such that an inkjet recording unit 30 each for black, yellow, magenta, and cyan, were mounted on a carriage 12, and recording was performed by selectively discharging ink droplets from each color of inkjet recording head 32, whereby a full-color image was recorded on the recording paper P based on image data. Nonetheless, the inkj et recording in the present invention is not limited to recording characters and images on a recording paper P.

In other words, the recording medium is not limited to paper and the ejected liquid is not limited to ink. The inkjet recording head 32 of the present invention can be applied to, for example, general liquid-ejecting (i.e., spraying) devices used industrially, such as those used when ejecting ink onto polymer films and glass when making color filters for displays, or for when ejecting solder in a molten state on a substrate when forming bumps for mounting parts.

Second Embodiment

Next, the second embodiment of the present invention will be explained. It should be noted that portions that are the same as in the first embodiment have been given the same part numbers and detailed explanations thereon have been omitted.

The schematic structure of the inkjet recording device 100 of the present embodiment is the same as the inkjet recording device 10 of the first embodiment shown in FIGS. 1 and 2, so detailed explanations thereon have been omitted.

Figure 18:
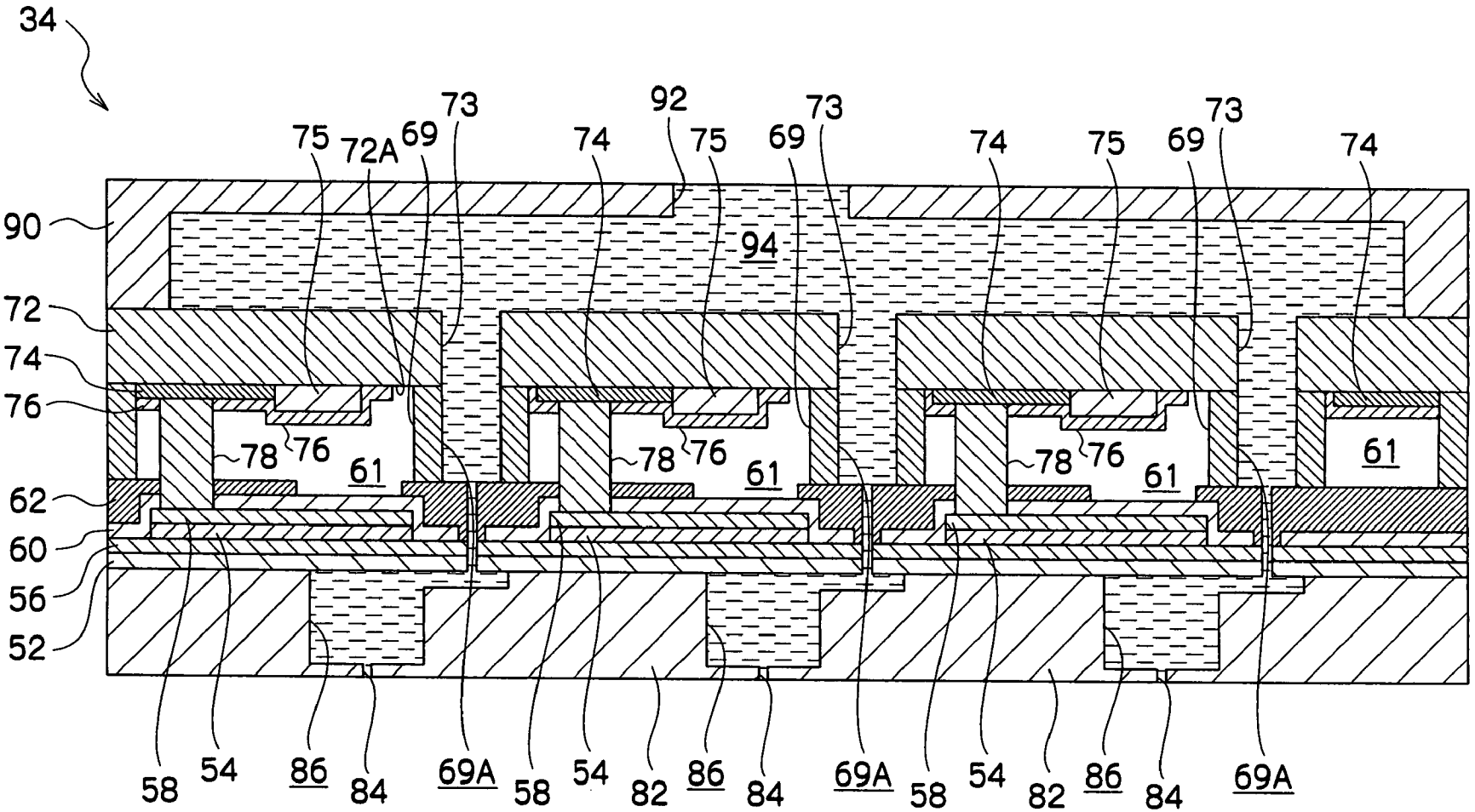
FIG. 18 is a cross-sectional drawing showing the structure of the inkjet recording head of the second embodiment.
Figure 19:
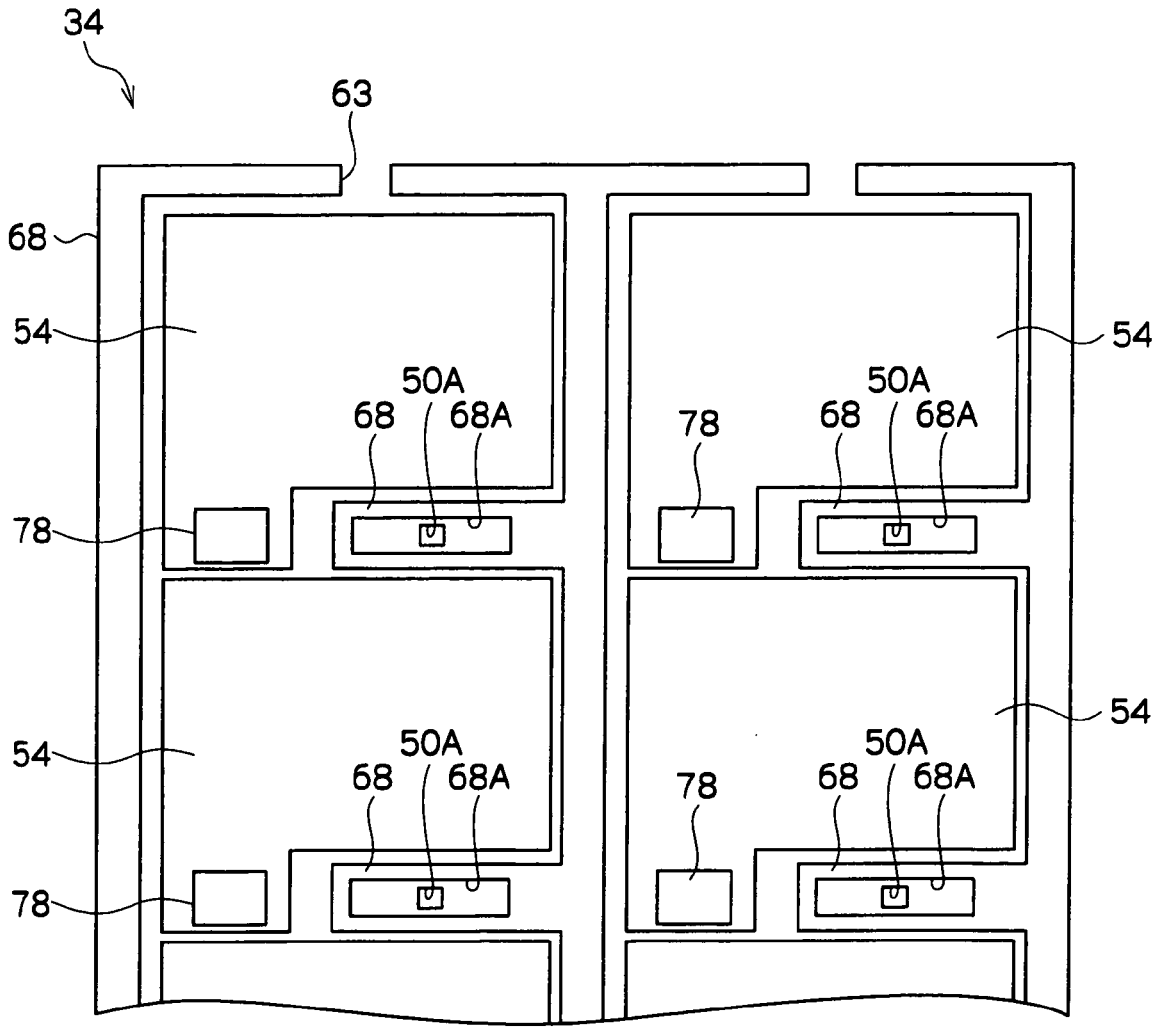
FIG. 19 is a planar drawing showing the a part of the inkjet recording head of the second embodiment.
Figure 20:
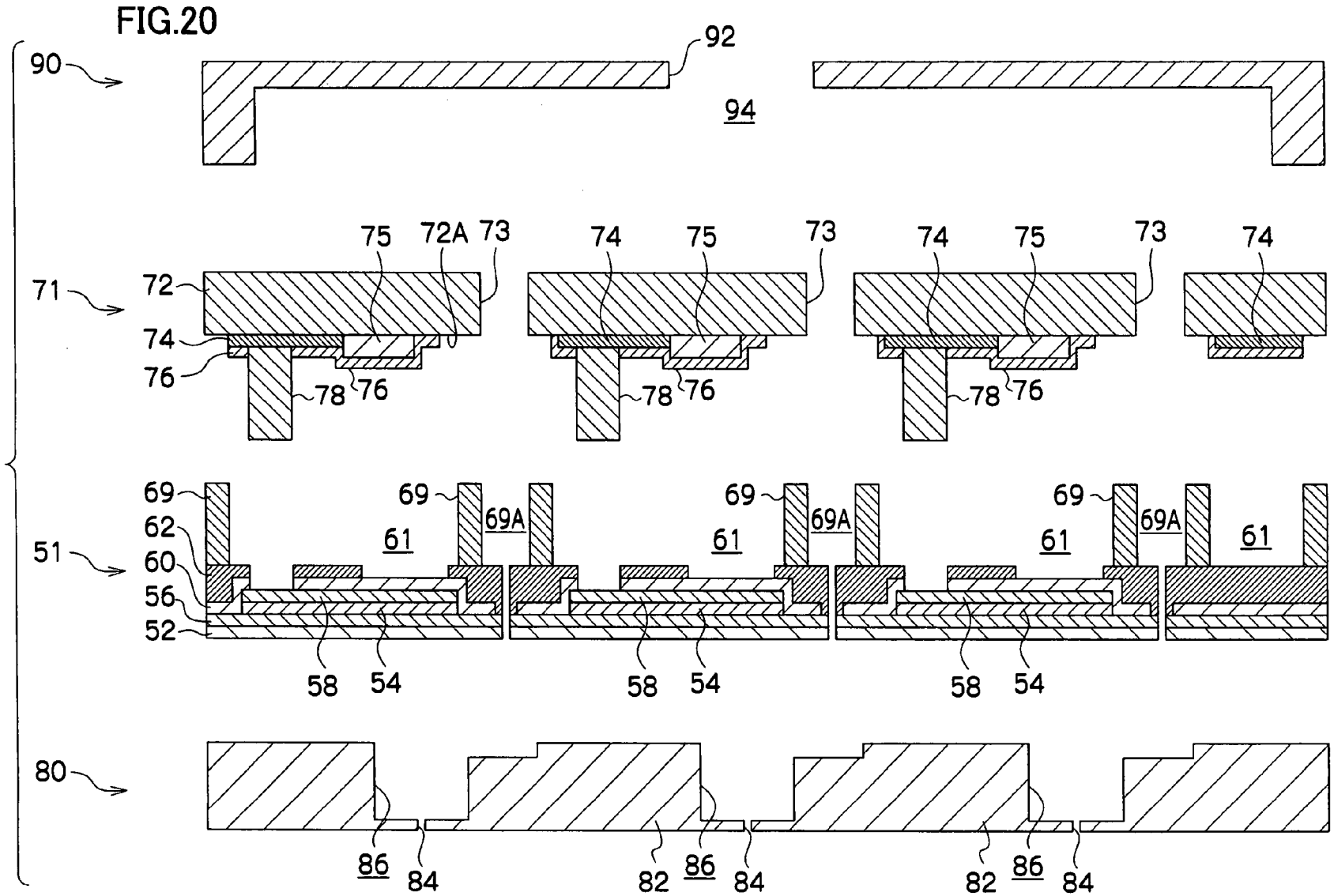
FIG. 20 is a cross-sectional drawing showing the inkjet recording head of the second embodiment exploded into each of the main parts.

As shown in FIGS. 18, 19, and 20, the inkjet recording head 34 set in the inkjet recording device 100 comprises a channel substrate 80, a second piezoelectric element substrate 51, a second upper substrate 71, and an ink pool component 90 stacked and arranged in this order from the bottom side. The channel substrate 80 and the ink pool component 90 are configured the same as in the first embodiment.

The second upper substrate 71 is configured to include a glass substrate 72 that is an insulating body having the strength to act as a supporting body. Glass is used in the present embodiment as well, however, this can be configured from other materials such as ceramic, silicon, resin, and the like.

Metal wiring 74 is formed on the facing surface 72A of the glass substrate 72. This metal wiring 74 is formed on the flat glass substrate 72 with no step (i.e., bump). Further, thin film transistors 75 are formed at the facing surface 72A for each piezoelectric element 54 and connected to the metal wiring 74. The second upper substrate 71 is what is known as a system on glass (SOG) substrate. The metal wiring 74 and thin film transistor 75 are covered and protected by a resin layer 76. Bumps 78 are provided at the metal wiring 74. The bumps 78 are electrically connected to a piezoelectric element substrate 50 and an upper electrode 58. Due to these bumps 78, the thin film transistor 75 and the piezoelectric element 54 are electrically connected through the metal wiring 74.

Through-holes 73 for supplying ink accumulated in the common ink pool chamber 94 to the pressure chambers 86 are formed in the glass substrate 72. A through-hole 73 is formed for each pressure chamber 86.

The second piezoelectric element substrate 51 is configured to include an diaphragm 52 and piezoelectric element 54. The diaphragm 52 is arranged on the upper side of the channel substrate 80 and forms the upper portion of each of the pressure chambers 86. The diaphragm 52 is formed from a metal such as SUS and has elasticity in at least the up and down directions, and is configured to flex deform (i.e., displace) in the up and down directions when current is passed to the piezoelectric element 54 (i.e., when voltage is applied thereto). It should be noted that even if the diaphragm 52 is made from an insulating material such as glass, there are no particular disadvantages.

The piezoelectric elements 54 are arranged in a matrix pattern and provided one each per pressure chamber 86 and, when viewed as a flat surface, these cover each of the pressure chambers 86. A lower electrode 56 acting as a one-way polar is arranged at the undersurface of the piezoelectric element 54, and an upper electrode 58 acting as polar in the other way is arranged on the upper surface of the piezoelectric element 54. The side of the lower electrode 56 is adhered to the diaphragm 52, and the side of the upper electrode 58 faces the second upper substrate 71. It should be noted that the diaphragm 52 made of metal (e.g., SUS) contacting the lower electrode 56 is also made to function as low-resistance GND wiring.

A SiOx layer 60 is stacked on the exposed portions of the piezoelectric element 54 and the lower electrode 56. A resin layer 62 is arranged at the upper side of the SiOx layer 60. Contact holes 64 for connecting the bumps 78 and the upper electrode 58, and free spaces 66 that ensure that displacement of the diaphragm 52 is not inhibited, are formed on the resin layer 62.

Bumps 78 are connected on the upper electrode 58. The thin film transistor 75 and piezoelectric element 54 are electrically connected through the metal wiring 74 due to these bumps 78. Due to this, individual wiring on the second piezoelectric element substrate 51 becomes unnecessary.

Supply holes 50A communicated with the pressure chamber 86 are made in the second piezoelectric element substrate 51. The supply holes 50A are configured so as to pass through the diaphragm 52, lower electrode 56, and resin layer 62. The supply holes 50A are holes that are minute and precise and which have the capability of adjusting the channel resistance of the ink. The supply holes 50A are communicated with the pressure chamber 86 due to being in communication with a horizontal channel 88 that is provided so as to extend towards the horizontal direction from the pressure chamber 86 of the channel substrate 80. When manufacturing the inkjet recording head 32, this horizontal channel 88 is provided in advance so as to be slightly longer than the portion connecting to the actual supply holes 50A so that alignment with the supply holes 50A is possible (i.e., so as to be communicated therewith with certainty).

As shown in FIG. 18, rib dividing walls 69 forming supply channel 69A communicated with the supply holes 50A and also with the through-holes 73 of the second upper substrate 71 are provided on the supply holes 50A. The bore diameter of the supply channel 69A formed by the rib dividing walls 69 is almost the same as the through-holes 73, and the bore diameter of the supply holes 50A is, when compared with the supply channel 69A, a small bore diameter. The bore diameter is made such that the channel resistance of the supply channel 69A relative to the channel resistance of the supply holes 50A is negligible.

The rib dividing walls 69, as shown in FIG. 19, are arranged not only at positions that form the supply channel 69A but also at the periphery of the piezoelectric element 54. Due to the rib dividing walls 69, spaces 61 are formed between the second piezoelectric element substrate 51 and second upper substrate 71. These spaces 61, as shown in FIG. 19, are communicated with the air due to resin component 63. Changes in pressure within the spaces 61 by displacement of the diaphragm 52 are prevented because the spaces 61 are in an airtight state, and this is to avoid air in the interior expanding due to heat during the manufacturing process.

With the inkjet recording head 34 configured as described above, the pressure chamber 86 are formed at the bottom side of the piezoelectric element substrate 50, and the common ink pool chamber 94 is formed on the upper side of the second upper substrate 71, so these are configured such that both groups do not exist on the same horizontal plane. Accordingly, it becomes possible to arrange the pressure chamber 86 in a state where they are in close proximity with each other, and the nozzles 84 can be arranged with high density in a matrix pattern.

Moreover, the common ink pool chamber 94 is wide and there is little dead water region so bubbles can be adequately removed.

Further, the wiring from the individual piezoelectric element 54 is lifted up to the second upper substrate 71 side due to the bumps 78 so the metal wiring 74 can be formed on a level second upper substrate 71. When compared to when metal wiring is formed on the second piezoelectric element substrate 51, the wiring can be easily formed (this is due to the fact that if it is on the side of the second piezoelectric element substrate 51, it is necessary to form wiring that has a step due to the piezoelectric element 54).

Furthermore, the thin film transistor 75 is formed on the second upper substrate 71, so the large sized drive IC and the large bumps for connecting the drive IC to the second upper substrate 71 necessary when mounting the drive IC on the second piezoelectric element substrate 51 becomes unnecessary, so the inkjet recording head 34 can be made more compact.

The thin film transistor 75, which becomes a heat source, is mounted on the second upper substrate 71 so, when compared to when it is mounted on the second piezoelectric element substrate 51, increases in the temperature of the ink within the pressure chamber 86 can be suppressed. Due to this, ink droplet volume variations due to ink temperature irregularities inside the pressure chamber 86 can be suppressed.

Further, with the inkjet recording head 32 configured as described above, the spaces 61 are formed by the rib dividing walls 69 so, when compared to when no spaces 61 are formed (i.e., when ink is filled in the hollow portions), different types of interfaces that contact the ink can be lessened and the choices of the interior processing can be increased (e.g., Au sputtering can be utilized).

Furthermore, since the spaces 61 are formed, the ink can be easily separated from the piezoelectric element 54, thus preventing inhibition of the deformation of the diaphragm 52.

Next, the manufacturing process of the inkjet recording head 34 configured as described above will be explained in detail based on FIGS. 21 through 25.

Figure 21:
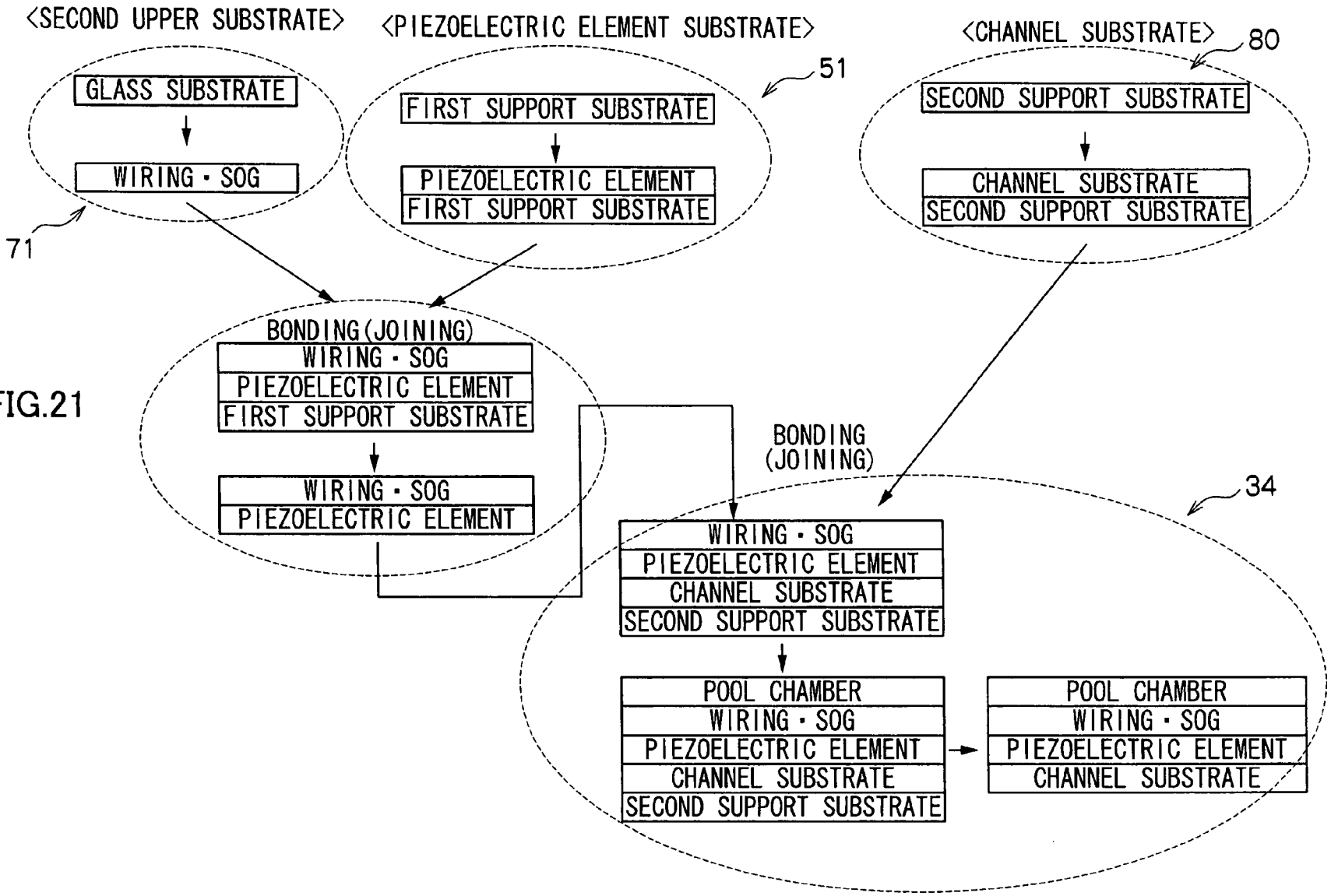
FIG. 21 is an explanatory diagram of the entire process for manufacturing the inkjet recording head of the second embodiment.

As shown in FIG. 21, this inkjet recording head 34 is manufactured by making each of the second upper substrate 71, second piezoelectric element substrate 51, and channel substrate 80 separately and then attaching (i.e., joining) these.

First, the manufacturing process of the second piezoelectric element substrate 51 will be explained.

Figures 22A, 22B, 22C, 22D, 22E, 22F:
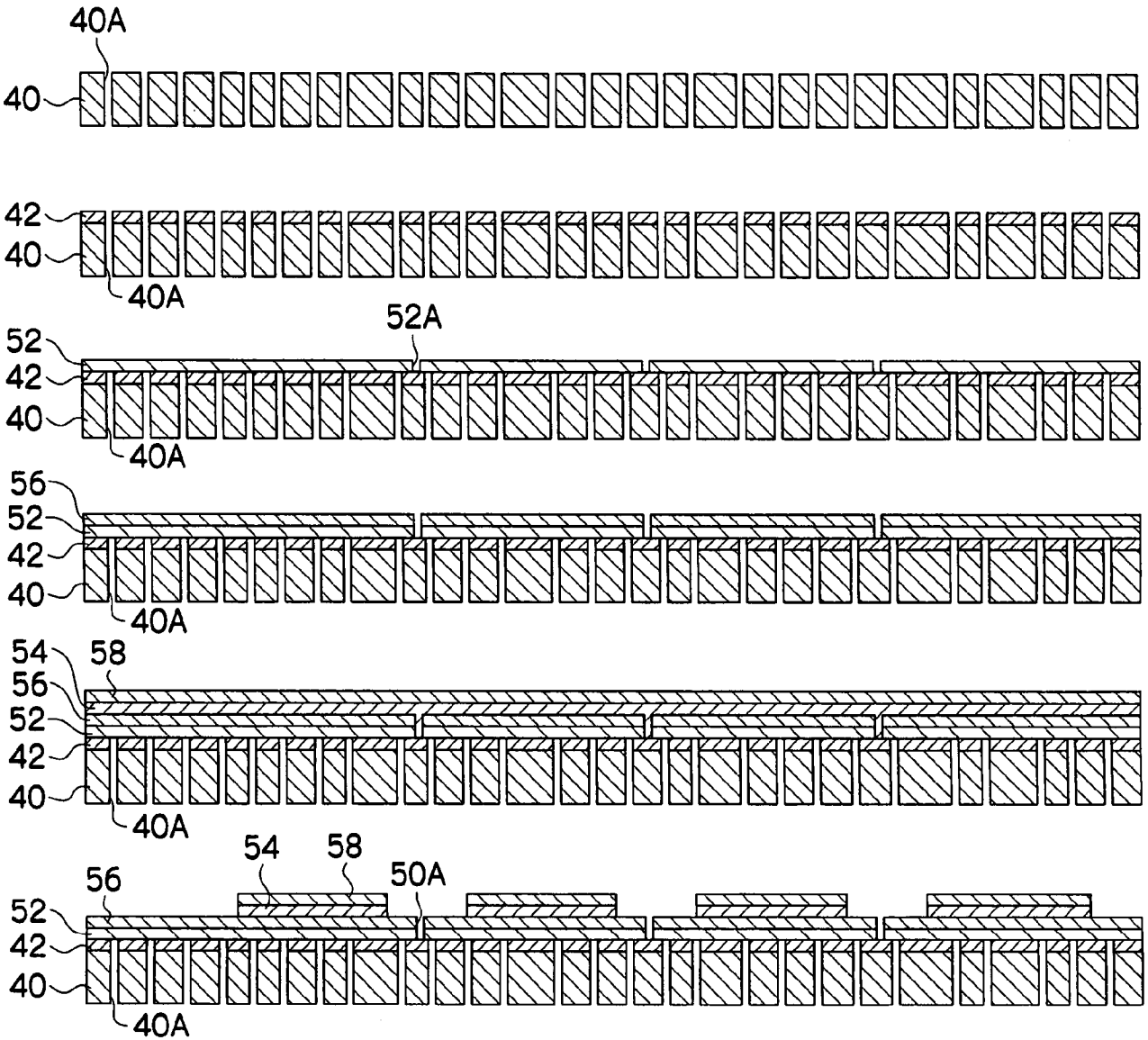
FIGS. 22A-FIG. 22I are explanatory diagrams showing the processes of manufacturing a piezoelectric substrate.

First, as shown in FIG. 22A, a first support substrate 40 made of glass in which multiple through-holes 40A are provided is prepared. The first support substrate 40 can be made from any material as long as it does not flex, and although it is not limited to glass, glass is preferable in that it is both hard and cost-effective. With regard to the methods of making this first support substrate 40, blast processing of a glass substrate and femtosecond laser processing are known, and others as well such as the exposure and developing of a photosensitive glass substrate (e.g., the PEG3C made by the Hoya Corporation).

Then, as shown in FIG. 22B, a resin adhesive 42 is coated on the upper surface ((i.e., on the surface) of the first support substrate 40 and then, as shown in FIG. 22C, the diaphragm 52 made of metal (e.g., SUS) is adhered to the upper surface thereof. At this time, the through-holes 52A of the diaphragm 52 and the through-holes 40A of the first support substrate 40 are made so as to not be compounded (i.e., so as to not overlap). It should be noted that there are no adverse affects to using an insulating substrate such as glass and the like for the material of the diaphragm 52.

Here, the through-holes 52A of the diaphragm 52 are formed for the use of the supply holes 50A. Further, the reason behind providing the through-holes 40A in the first support substrate 40 is to pour in a chemical (i.e., solvent) at the interface of the first support substrate 40 and diaphragm 52 at a later process, and for liquefying the resin adhesive 42 and separating the first support substrate 40 thereof from the diaphragm 52. Further, the through-holes 40A of the first support substrate 40 and the through-holes 52A of the diaphragm 52 are made to not overlap so that each of the types of materials used during manufacturing do not seep from the bottom surface (i.e., back surface) of the first support substrate 40.

Next, as shown in FIG. 22D, a lower electrode 56 layered on the upper surface of the diaphragm 52 is subjected to patterning. Specifically, this is patterned by resist formation with metal layer sputtering (with a layer thickness of between 500 Å and 3000 Å) or with a photolithographic method, or by resist peeling with patterning (RIE) or oxygen plasma. This lower electrode 56 becomes the ground potential.

Next, as shown in FIG. 22E, a PZT layer that is the material of the piezoelectric element 54 and the upper electrode 58 are layered in this order with a sputtering method on the upper surface of the lower electrode 56, and as shown in FIG. 22F, the piezoelectric element 54 (PZT layer) and the upper electrode 58 are patterned.

Specifically, resist formation is performed with PZT layer sputtering (with a layer thickness of 3 μm to 15 μm), metal layer sputtering (with a layer thickness of between 500 Å and 3000 Å) or with a photolithographic method, and resist removing is performed with patterning (RIE) or oxygen plasma.

It should be noted that for the electrode material of the upper and lower portions, materials having heat resistance and high compatibility with the PZT material that is the piezoelectric element can be used, such as Au, Ir, Ru, and Pt.

Figure 22G:
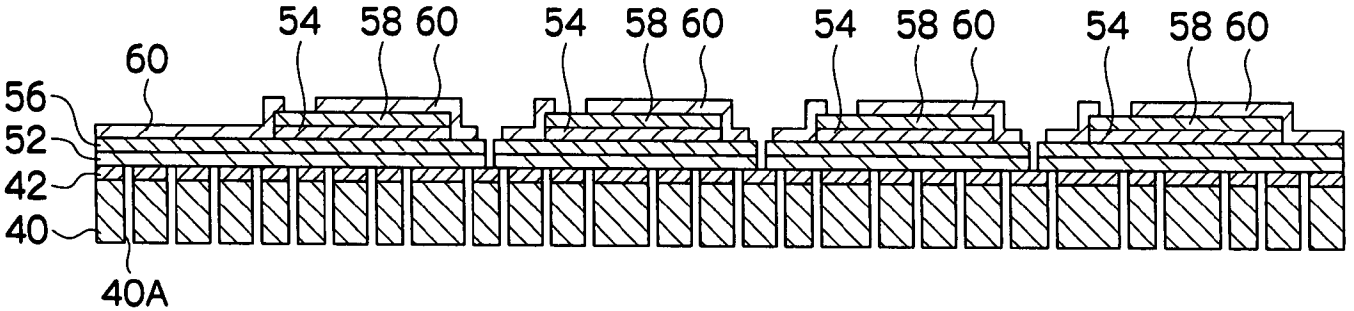

After that, as shown in FIG. 22G, the SiOx layer 60 is layered on the upper surface of the exposed lower electrode 56 and the upper surface of the upper electrode 58. Specifically, processing is carried out where the SiOx layer 60, which has a high degree of dangling bond density, is coated on with CVD; patterning is performed where a photosensitive polyimide (e.g., the photosensitive polyimide Durimide 7520 made by FUJIFILM Arch Co., Ltd.) is coated, exposed, and developed; and etching of the SiOx layer with above photosensitive polyimide as a mask is performed with a reactive ion etching (RIE) method using $CF_4$ gas. It should be noted that although a SiOx layer was used for the insulating layer having low water-permeability, another layer such as a SiNx layer or SiOxNy layer can also be used.

Figure 22H:
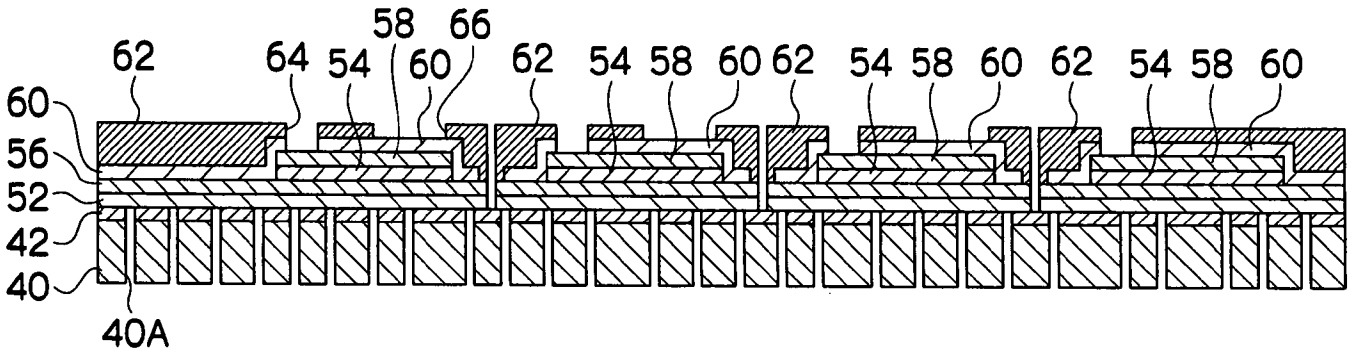

Next, as shown in FIG. 22H, an ink-resistant and flexible resin layer 62, for example, a resin layer of polyimide, polyamide, epoxy, polyurethane, or silicon and the like, is layered on the upper surface of the SiOx layer 60. It should be noted that the resin layer 62 is made so as to not be layered on the portions joining the bumps 78 (contact holes 64) and the portions positioned at the upper portion of the pressure chamber 86 (free spaces 66). The reason the resin layer 62 is not layered on the upper portion of the pressure chambers is to prevent inhibition of deformation of the diaphragm 52 by the resin layer 62. Specifically, this is formed by coating a resin material, hardening it with curing processing, resist forming with a photolithographic method (resist including Si), patterning it (RIE), and peeling the resist with oxygen plasma.

Figure 22I:
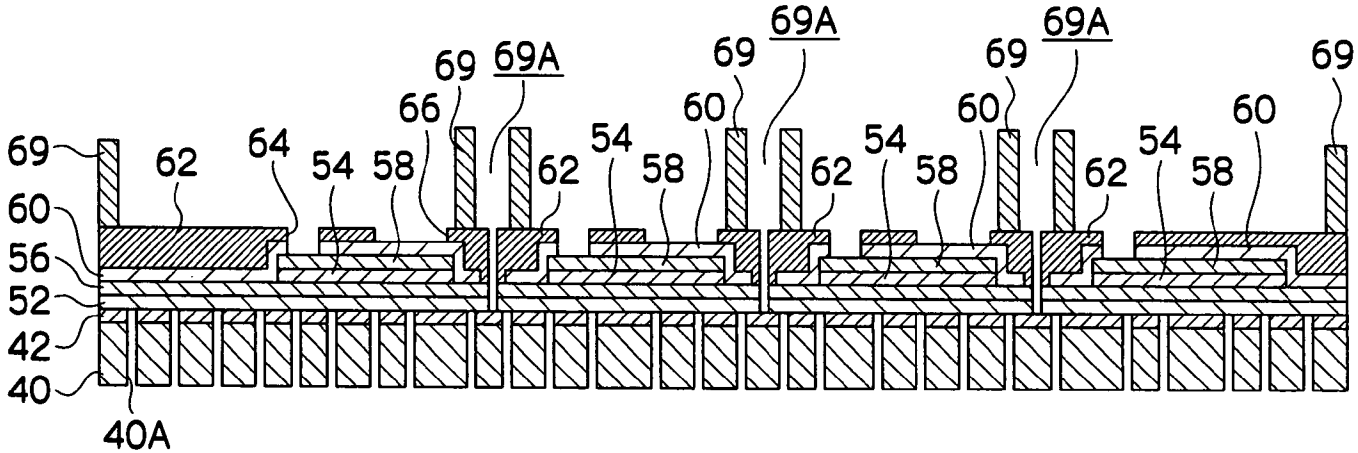

After that, as shown in FIG. 22I, the rib dividing walls 69 are formed on the resin layer 62. The rib dividing wall 69 is a photosensitive resin having ink resistance and flexibility, for example, a resin layer of polyimide, polyamide, epoxy, polyurethane, or silicon and the like, and is layered on the resin layer 62 and patterned by exposure and developing.

This concludes the explanations on how the second piezoelectric element substrate 51 (attached to the first support substrate 40) is manufactured.

Figures 23A, 23B, 23C, 23D, 23E:
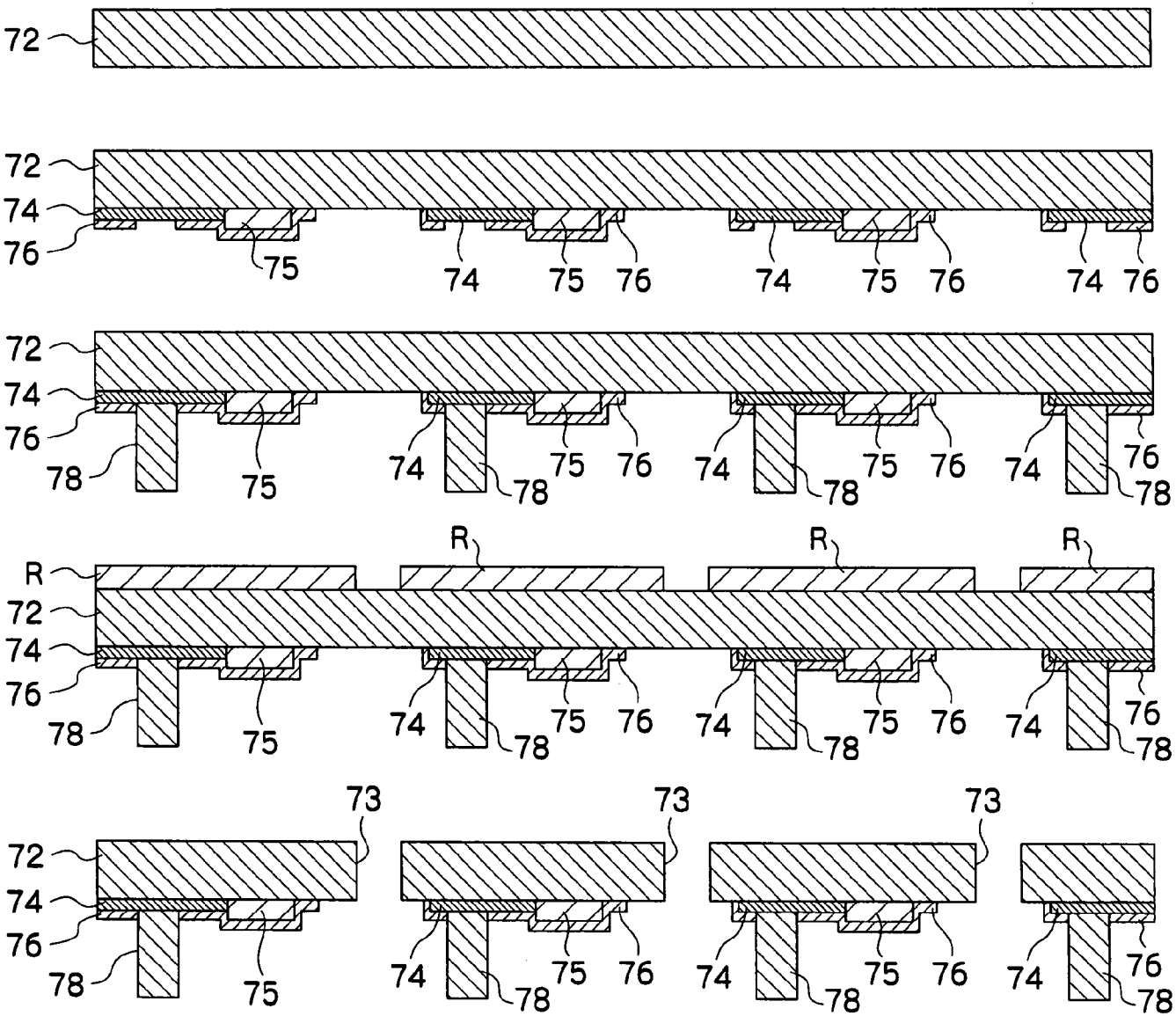
FIGS. 23A-FIG. 23E are explanatory diagrams showing the processes of manufacturing of the second upper substrate.

Next, the manufacturing method of the second upper substrate 71 will be explained. As shown in FIG. 23A, first a glass substrate 72 is prepared. This is not limited to being made of glass, as long as the glass substrate 72 does not flex and is thick enough to act as a support, however glass is preferable in that it is both hard and cost-effective. Notably, in the manufacturing of this second upper substrate 71, the glass substrate 72 is thick enough in itself to ensure the degree of strength necessary to serve as a support (0.3 mm to 1.5 mm), so it is unnecessary to provide a separate support.

Next, as shown in FIG. 23B, metal wiring 74 is layered on the bottom surface (surface) of the glass substrate 72 and the metal wiring 74 is patterned. Specifically, processing is performed where an A1 layer (thickness of 1 μm) is coated with a sputter method, a resist is formed with a photolithographic method, the A1 layer is etched with an RIE method using a chlorine-based gas, and the resist layer is removed with oxygen plasma.

Further, thin film transistors 75 are formed on the facing surface 72A that is the surface on which the metal wiring 74 is formed. The thin film transistors 75 are generally formed with a low-temperature Poly Si TFT process.

Next, the resin layer 76 is formed on the metal wiring 74 and the thin film transistor 75. Notably, the resin layer 76 is made so as to not be layered on the portions joining the upper electrode 58 to the connecting bumps 78. Specifically, a photosensitive resin having resistance to ink and flexibility, for example, a resin layer of polyimide, polyamide, epoxy, polyurethane, or silicon and the like, is layered as the resin layer 76, and patterned by exposure and developing (e.g., the photosensitive polyimide Durimide 7320 made by FUJIFILM Arch Co., Ltd.).

Then as shown in FIG. 23C, bumps 78 connecting to the metal wiring 74 are formed. Processes such as electrical coating, non-electrical plating, ball bump processing, screen printing and the like can be applied to the formation of the bumps 78. The bumps 78 are made to be taller than the rib dividing walls 68 in order to make joining with the upper electrode 58 at the time of joining with the second piezoelectric element substrate 51 easier. Next, through-holes 73 that allow ink to pass through are formed in the glass substrate 72. With regard to the formation of the through-holes 73, firstly, as shown in FIG. 23D, the resist on the upper surface of the glass substrate 72 is patterned. Next, holes are opened with sand-blast processing and resist removing performed, whereby, as shown in FIG. 23E, the through-holes 73 are formed.

This concludes the explanations on how the second upper substrate 71 is manufactured Next, the process for bonding (i.e., joining) the second piezoelectric element substrate 51 and the second upper substrate 71 will be explained.

Figure 24A:
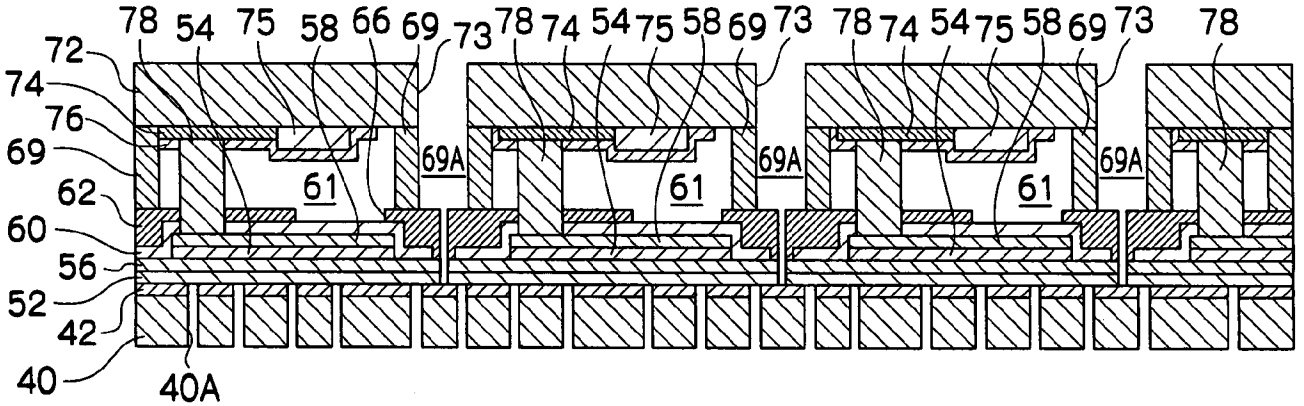
FIGS. 24A-FIG. 24C are explanatory diagrams showing the processes of joining the piezoelectric substrate and the second upper substrate.

As shown in FIG. 24A, the side of the second piezoelectric element substrate 51 and rib dividing walls 69 is made to face the side on which the second upper substrate 71 and bumps 78 are formed, and these are both connected (i.e., bonded together) with thermocompression. That is, the rib dividing walls 69 are bonded to the glass substrate 72 and resin layer 76, and the bumps 78 to the upper electrode 58.

At this time, the bumps 78 are taller than the rib dividing walls 69 so by joining the rib dividing walls 69 to the glass substrate 72 and resin layer 76, the bumps 78 are automatically joined to the upper electrode 58. Stated differently, height adjustment of the bumps 78 is simple (i.e., they are easily deformed) so forming the intersecting dividing spaces 68A and spaces 61 and the connecting of the bumps 78 can be performed easily.

Figure 24B:
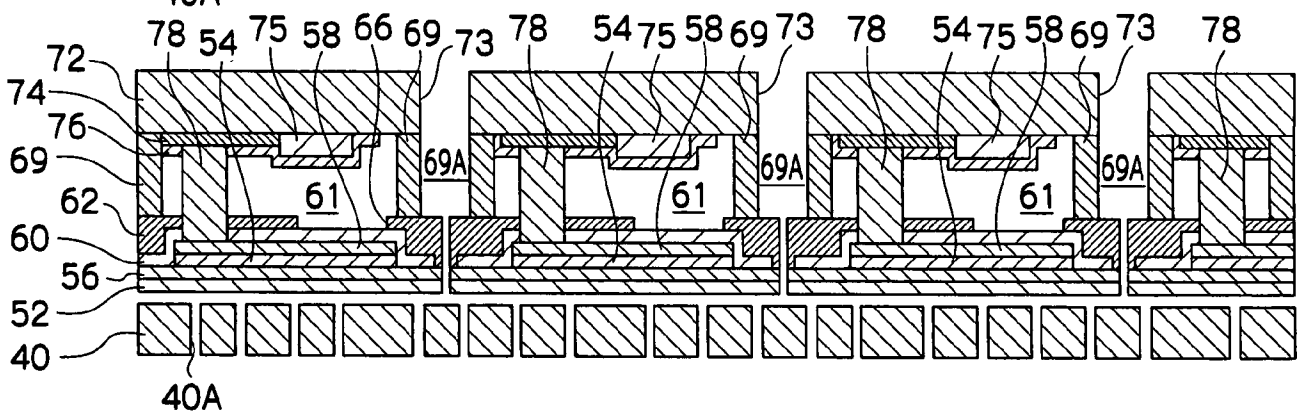
Figure 24C:
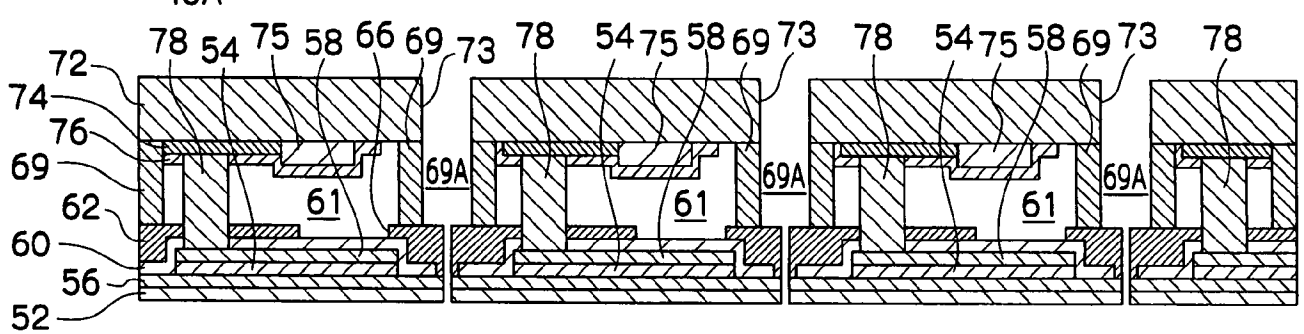

Next, as shown in FIG. 24B, a removable adhesive solution (e.g., an organic ethanol amine solvent) is injected from the through-holes 40A of the first support substrate 40, and removing processing of the first support substrate 40 from the second piezoelectric element substrate 51 is performed by selectively dissolving the resin adhesive 42. Due to this, as shown in FIG. 24C, the joined substrate of the second upper substrate 71 and second piezoelectric element substrate 51 is completed.

Next, the joining of the joined body of the channel substrate 80 and the second piezoelectric element substrate 51 and second upper substrate 71 will be explained.

Figure 25A:
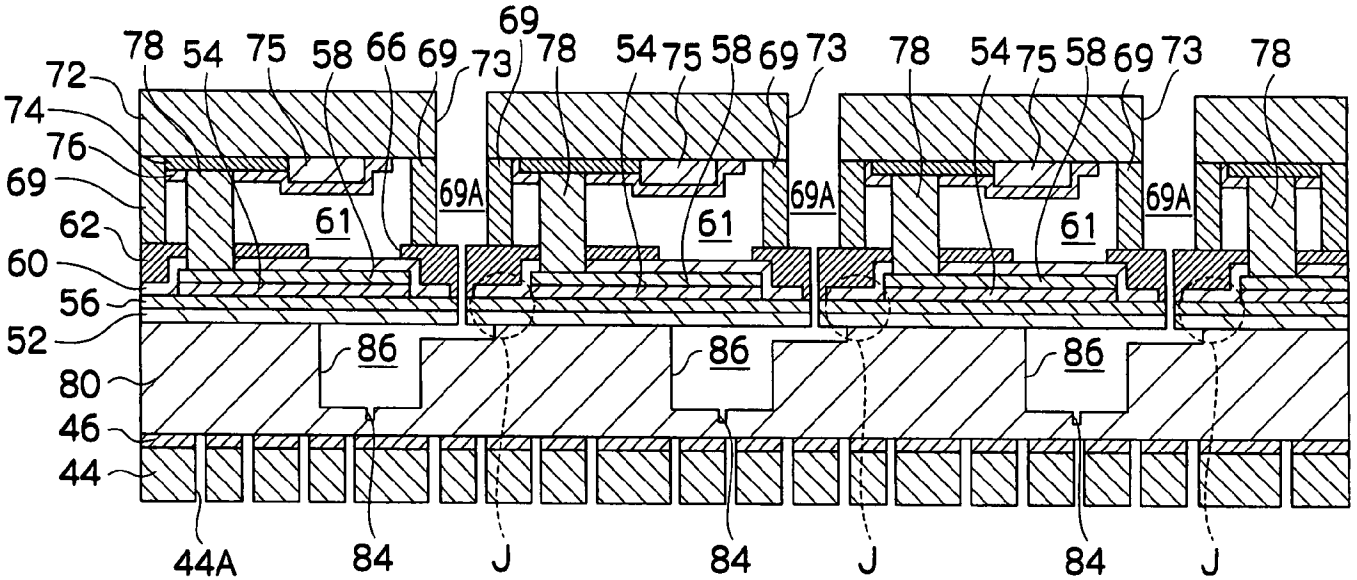
FIGS. 25A-FIG. 25F are explanatory diagrams showing the processes of joining the channel substrate to the joined bodies of the piezoelectric element substrate and the second upper substrate.

As shown in FIG. 25A, the side of the diaphragm 52 of the second piezoelectric element substrate 51 and the side at which the pressure chamber 86 of the channel substrate 80 were formed are bonded (i.e., joined) with thermocompression. At this time, the rib dividing walls 69 are provided between the second upper substrate 71 and the second piezoelectric element substrate 51 so as to be in contact with both of these so the pressure chamber dividing wall 82 of the channel substrate 80 and the diaphragm 52 of the second piezoelectric element substrate 51 are pressed together. When compared to a case where there are no rib dividing walls 69, a good state of joining in the joined portion J in FIG. 25A can be obtained.

Figure 25B:
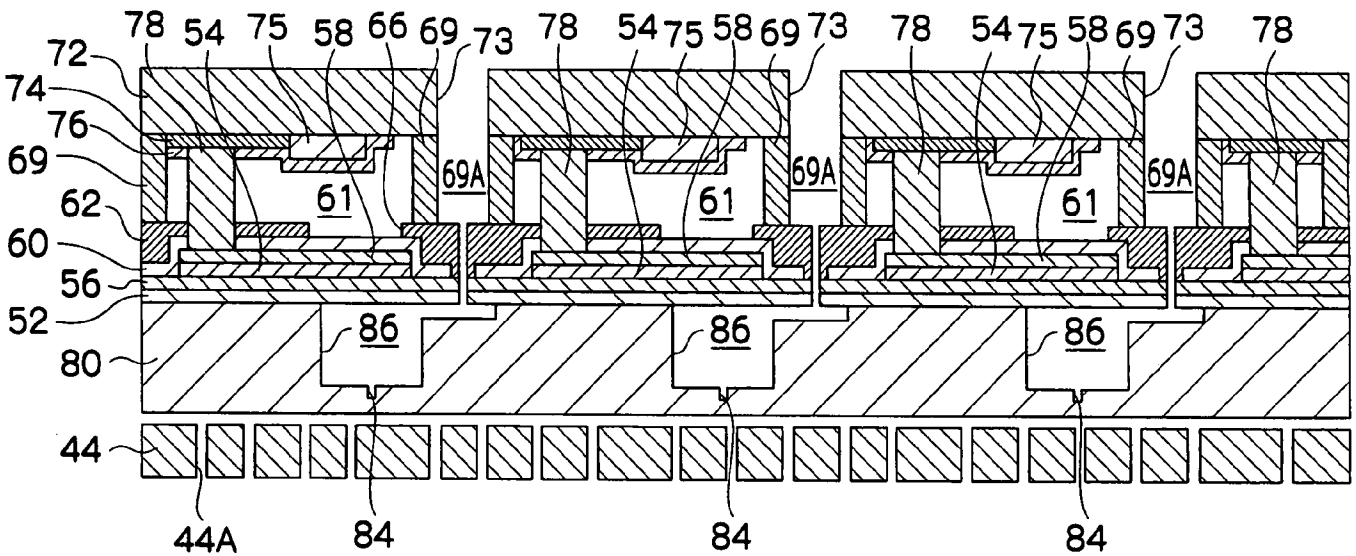

Next, as shown in FIG. 25B, a removable adhesive solution (e.g., an organic ethanol amine solvent) is injected in from the through-holes 44A of the second support substrate 44, and peeling processing of the second support substrate 44 from the channel substrate 80 is performed by selectively dissolving the resin adhesive 46.

Figure 25C:
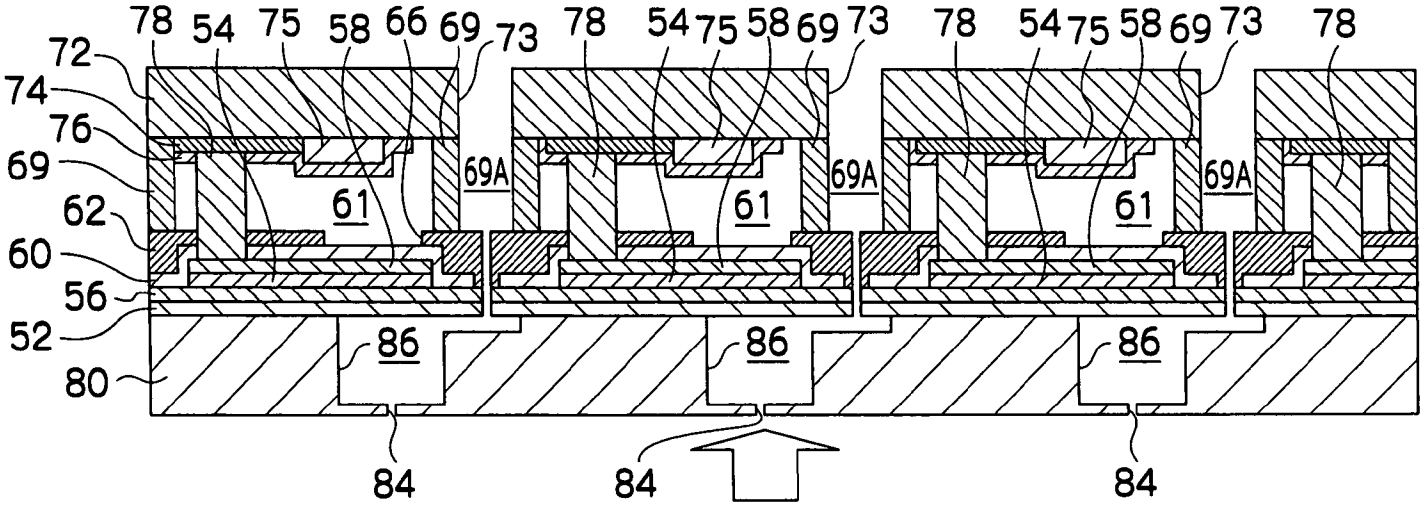
Figure 25D:
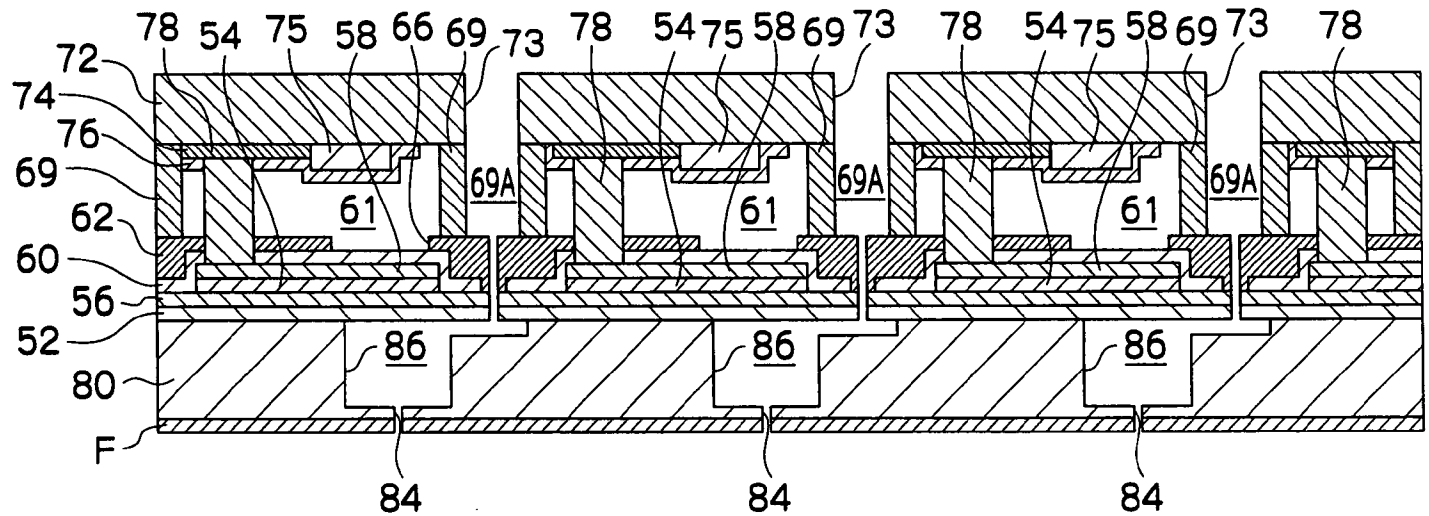

After that, as shown in FIG. 25C, a surface layer of the surface from which the second support substrate 44 was removed is removed with grinding processing using a grinding material having alumina as its principal component, or with RIE processing using oxygen plasma, whereby the nozzles 84 are opened. Then, as shown in FIG. 25D, a fluorine material F (e.g., Cytop produced by the Asahi Glass Co., Ltd.) is coated as a water repellent on the bottom surface where the nozzles 84 were opened.

Figure 25E:
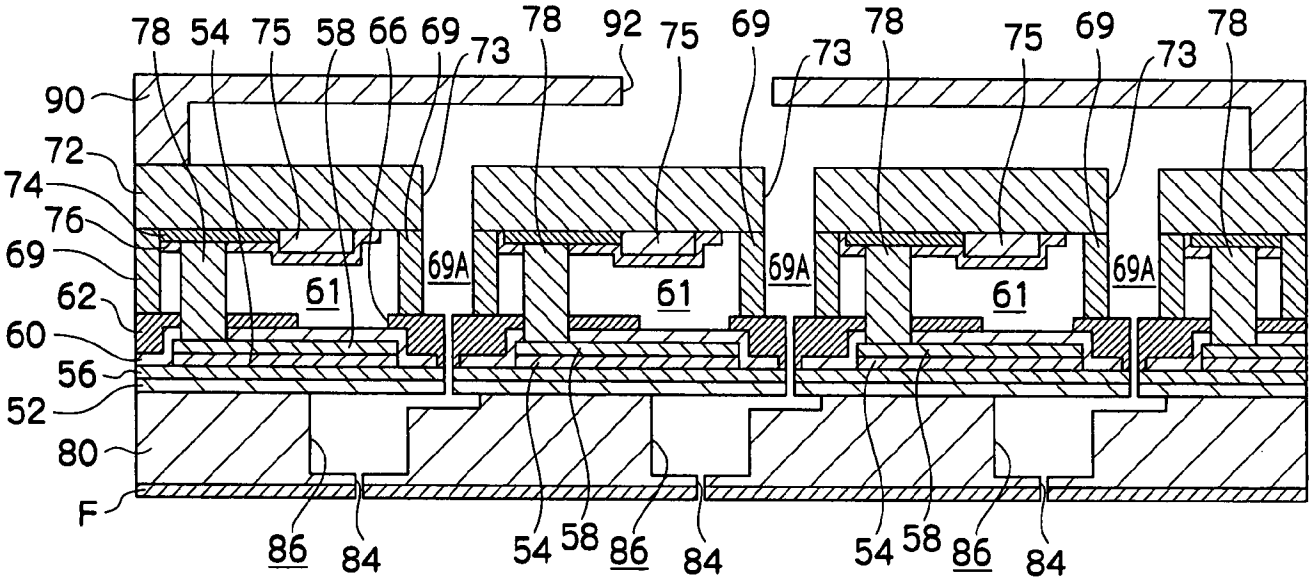
Figure 25F:
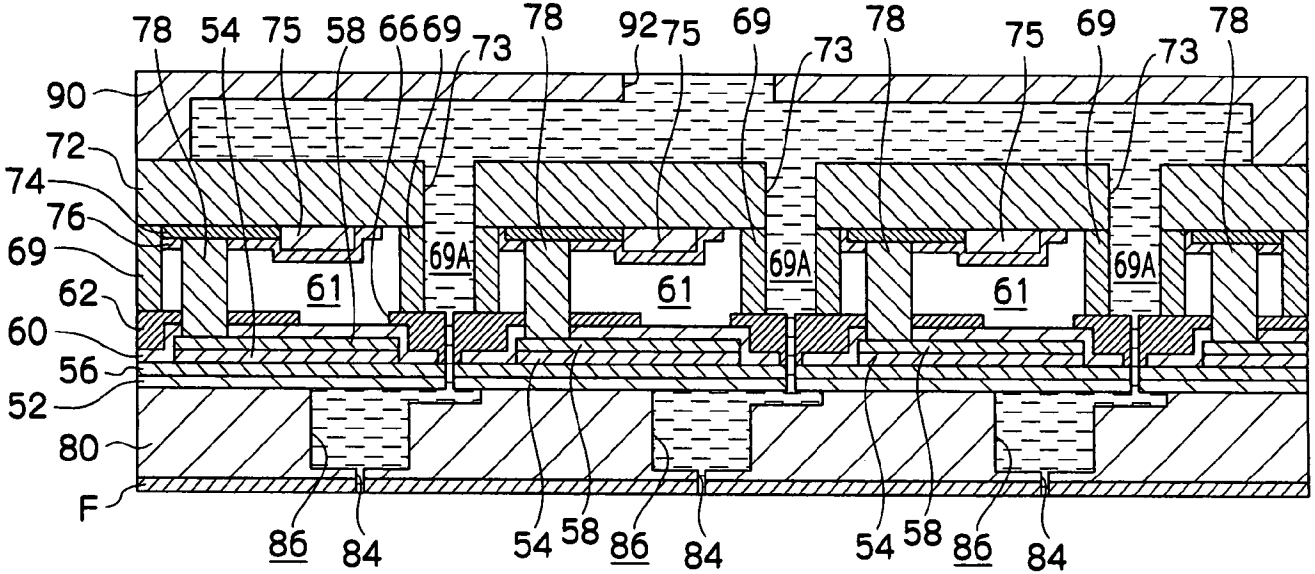

Then as shown in FIG. 25E, by joining the ink pool component 90 to the upper surface of the second upper substrate 71, the inkjet recording head 32 is completed and, as shown in FIG. 25F, ink can be filled inside the common ink pool chamber 94 and the pressure chamber 86.

Figure 26:
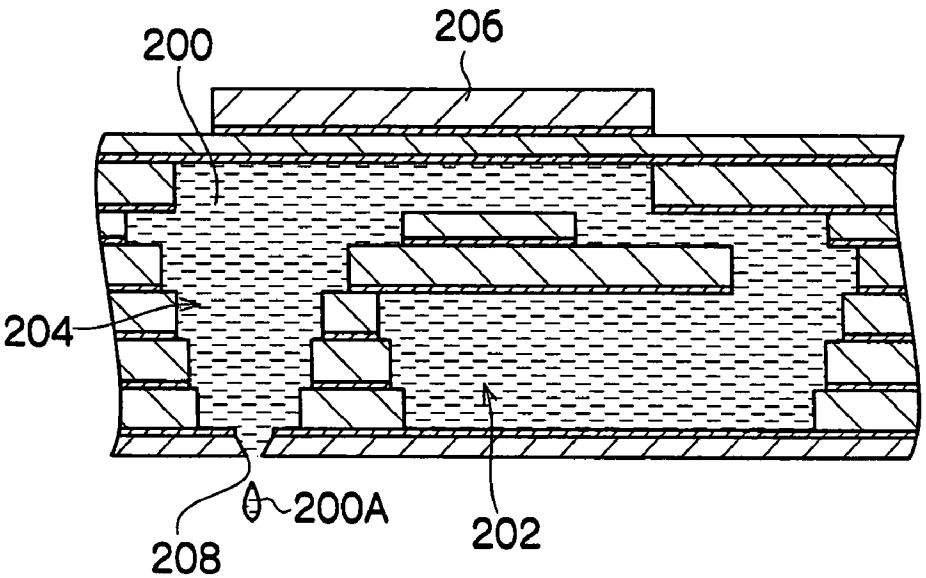
FIG.26 RELATED ART
FIG. 26 is a schematic cross-sectional diagram showing the structure of a conventional inkjet recording head.
Figure 27:
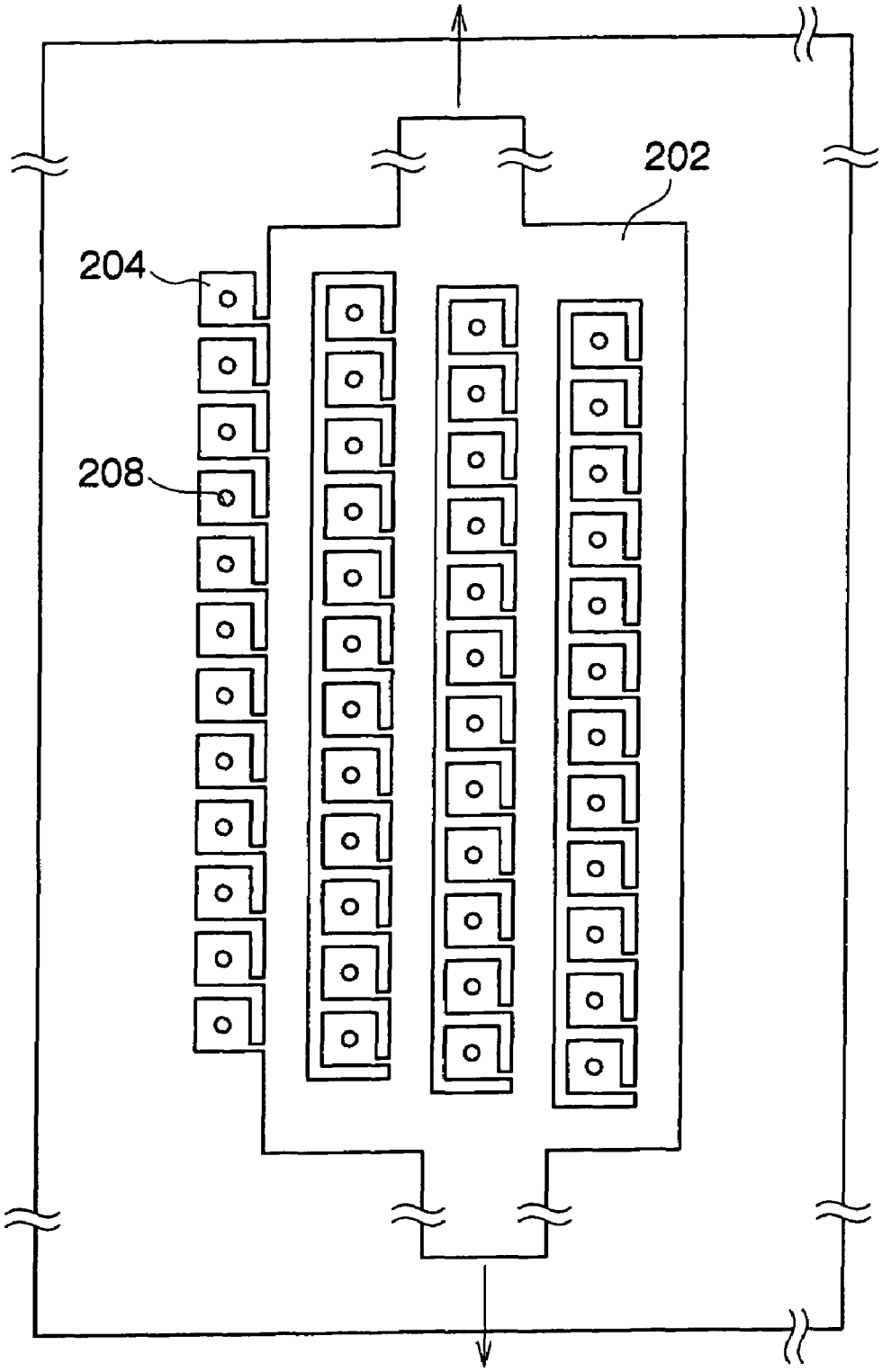
FIG.27 RELATED ART
FIG. 27 is a schematic planar diagram showing the structure of a conventional inkjet recording head.
Figure 28A:
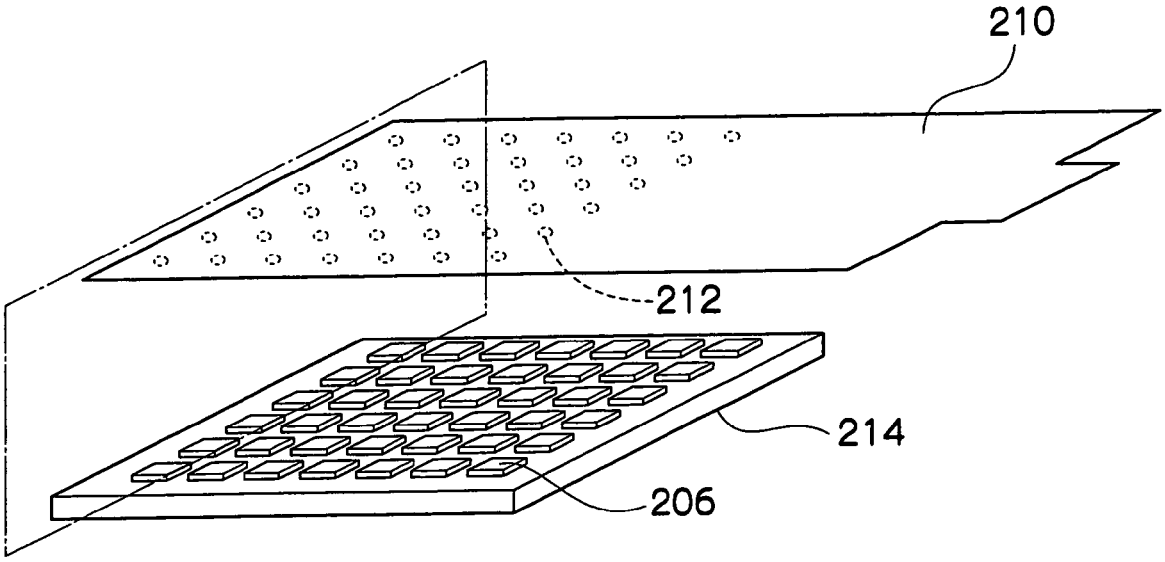
FIG.28A RELATED ART
FIG. 28A and FIG. 28B are schematic inclined diagrams showing the structure of a conventional inkjet recording head.
Figure 28B:
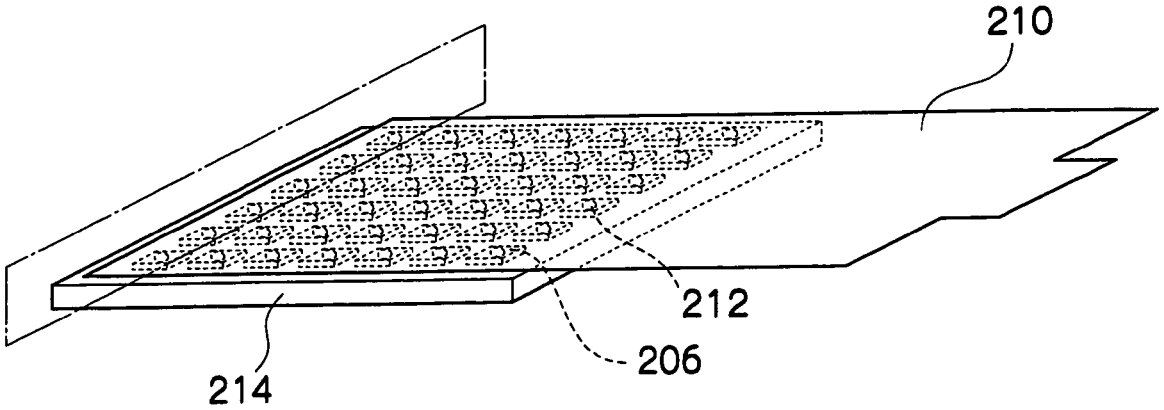
FIG.28B RELATED ART

It should be noted that with the above-described embodiment, an example was explained involving an SOG substrate where a thin film transistor 75 is formed at the bottom surface side of the glass substrate 72. Nonetheless, this can be configured such that the piezoelectric element 54 is not driven by the thin film transistor 75, rather, as shown in FIG. 26, the drive IC 77 can be mounted on the second upper substrate 71 so as to drive the piezoelectric element 54.

The operation of the inkjet recording device 100 set in the inkjet recording head 34 as configured above is the same as that described in the first embodiment so detailed explanations thereon have been omitted.

In the present embodiment as in the first, the explanations involved an example corresponding to FWA paper width, however, the inkj et recording head of the present invention is not limited thereto and can be applied to PWA devices as well.

Further, the recording medium is not limited to paper and the ejected liquid is not limited to ink. The inkjet recording head 32 of the present invention can be applied to, for example, general liquid-discharging (i.e., spraying) devices used industrially, such as those used when discharging ink onto polymer films and glass when making color filters for displays, or those used when discharging solder in a molten state on a substrate when forming bumps for mounting parts.

As explained above, the liquid droplet ejecting head of the present invention comprises: a channel substrate in which a nozzle, which ejects liquid droplets, and a pressure chamber, which is partitioned off by a pressure chamber dividing wall and communicated with the nozzle and filled with a liquid, are formed; a piezoelectric element substrate having a diaphragm that forms a part of the pressure chamber and a piezoelectric element that displaces this diaphragm; a liquid pool chamber that is formed opposite from the pressure chamber with the piezoelectric element substrate being disposed therebetween and which pools liquid supplied to the pressure chamber; an upper substrate disposed opposite from the pressure chamber with the piezoelectric element substrate being disposed therebetween so as to be separated from and face the piezoelectric element substrate; and a dividing wall component provided, when viewing the channel substrate in plane view, along a position corresponding to the pressure chamber dividing wall between the piezoelectric element substrate and the upper substrate so as to contact the piezoelectric element substrate and the upper substrate.

Accordingly, due to the liquid droplet ejecting head of the present invention, the liquid pool chambers are provided so as to be placed between the piezoelectric element substrates on the opposite side of the pressure chambers, so the pressure chambers can be arranged in a state where they are in close proximity with each other, and the nozzles provided at each of the pressure chambers can be arranged with high density.

Further, the space between the upper substrate and the piezoelectric element substrate is separated so after the upper substrate and the piezoelectric element substrate are joined, there are portions that cannot be pressed and there is a tendency for the bonding of the two to be inadequate when joining the channel substrate to the piezoelectric element substrate. However, with the liquid droplet ejecting head configured as described above, the dividing wall component is provided along positions corresponding to the pressure chamber dividing walls, so the channel substrate and the piezoelectric element are pressed together and a good bond can be obtained.

Notably, in the liquid droplet ejecting head of the present invention, the liquid pool chamber is formed between the piezoelectric element substrate and the upper substrate.

In this manner, the liquid droplet ejecting head can be made to be compact due to the formation of the liquid pool chamber between the piezoelectric element substrate and the upper substrate.

Further, the liquid droplet ejecting head of the present invention is further provided with a common pool chamber that supplies liquid to the liquid pool chamber, and is formed opposite from the piezoelectric element substrate with the upper substrate being disposed therebetween, wherein a through-hole is formed in the upper substrate to supply liquid to the liquid pool chamber from the common pool chamber.

With the liquid droplet ejecting head of the present invention, the dividing wall component is arranged so that the entire region of the liquid pool chamber is communicated.

Due to this configuration, liquid can flow in the liquid pool chamber and it becomes easier to extract bubbles.

Further, with the liquid droplet ejecting head of the present invention, one through-hole is formed for multiple pressure chambers.

In this manner, by forming one through-hole for multiple pressure chambers, the liquid resistance can be equalized well than in cases where one through-hole is provided per pressure chamber.

Furthermore, with the liquid droplet ejecting head of the present invention, the dividing wall component is arranged so as to surround exterior sides of each of the piezoelectric element and individual chambers, when the piezoelectric element substrate is viewed in plane view.

Due to this configuration, more places on the upper substrate and the piezoelectric element substrate can be contacted with the dividing wall component. As a result, the channel substrate and the piezoelectric element substrate can be pressed together with more certainty and a good state of juncture can be obtained.

Moreover, with the liquid droplet ejecting head of the present invention, the liquid pool chamber is formed opposite from the piezoelectric element substrate with the upper substrate placed therebetween, and a liquid supply channel that supplies liquid to the pressure chamber from the liquid pool chamber and a space between the upper substrate and the piezoelectric element substrate are formed by a portion of the dividing wall component.

With the above-described configuration, a portion of the dividing wall component forms a space between the liquid supply channel and the upper substrate and piezoelectric element substrate. For this reason, liquid can easily be supplied to the pressure chamber and a space that does not inhibit the deformation of the diaphragm can be formed. Further liquid can be easily kept away from the piezoelectric element.

Notably, it is preferable that the space be communicated to the air because by doing so, variations in air pressure that would otherwise occur within the space when the space is sealed can be prevented.

Also, the nozzles in the liquid droplet ejecting head of the present invention are arranged in a matrix pattern.

By setting the nozzles in this manner, high-resolution recording can be achieved.

Further, the liquid droplet ejecting device of the present invention is characterized in that it is provided with the above-described liquid droplet ejecting head.

With the liquid droplet ejecting device of the present invention, the nozzles can be set in a highly dense arrangement so high-resolution recording can be achieved. Further, the channel substrate and the piezoelectric element substrate are pressed together via the dividing wall component providing a good bond, which in turn ensures a highly reliable liquid droplet ejecting device.

As explained above, the nozzles can be arranged more densely and the head made to be more compact due to the present invention, and suitable joining during the manufacturing process is achieved.

What is claimed is:

1. A liquid droplet ejecting head comprising:

a channel substrate in which a nozzle, which ejects liquid droplets, and a pressure chamber, which is partitioned off by a pressure chamber dividing wall and communicated with the nozzle and filled with a liquid, are formed;

a piezoelectric element substrate having a diaphragm that forms a part of the pressure chamber and a piezo electric element that displaces this diaphragm;

a liquid pool chamber that is formed opposite from the pressure chamber with the piezoelectric element substrate being disposed therebetween and which pools liquid supplied to the pressure chamber;

an upper substrate disposed opposite from the pressure chamber with the piezoelectric element substrate being disposed therebetween so as to be separated from and face the piezoelectric element substrate; and a dividing wall component provided, when viewing the channel substrate in plane view, along a position corresponding to the pressure chamber dividing wall between the piezoelectric element substrate and the upper substrate so as to contact the piezoelectric element substrate and the upper substrate.

2. The liquid droplet ejecting head of claim 1, wherein the liquid pool chamber is formed between the piezoelectric element substrate and the upper substrate.

3. The liquid droplet ejecting head of claim 2, further provided with a common pool chamber that supplies liquid to the liquid pool chamber, and is formed opposite from the piezoelectric element substrate with the upper substrate being disposed therebetween, wherein a through-hole is formed in the upper substrate to supply liquid to the liquid pool chamber from the common pool chamber.

4. The liquid droplet ejecting head of claim 3, wherein the dividing wall component is arranged so that the entire region of the liquid pool chamber is communicated.

5. The liquid droplet ejecting head of claim 4, wherein one through-hole is formed per a plurality of pressure chambers.

6. The liquid droplet ejecting head of claim 2, wherein the dividing wall component is arranged so that the entire region of the liquid pool chamber is communicated.

7. The liquid droplet ejecting head of claim 2, wherein the dividing wall component is arranged so as to surround exterior sides of each of the piezoelectric element and individual chambers, when the piezoelectric element substrate is viewed in plane view.

8. The liquid droplet ejecting head of claim 2, wherein the nozzles are arranged in a matrix pattern.

9. The liquid droplet ejecting head of claim 3, wherein the dividing wall component is arranged so as to surround exterior sides of each of the piezoelectric element and individual chambers, when the piezoelectric element substrate is viewed in plane view.

10. The liquid droplet ejecting head of claim 1, wherein the dividing wall component is arranged so as to surround exterior sides of each of the piezoelectric element and individual chambers, when the piezoelectric element substrate is viewed in plane view.

11. The liquid droplet ejecting head of claim 1, wherein the liquid pool chamber is formed opposite from the piezoelectric element substrate with the upper substrate placed therebetween, and a liquid supply channel that supplies liquid to the pressure chamber from the liquid pool chamber and a space between the upper substrate and the piezoelectric element substrate are formed by a portion of the dividing wall component.

12. The liquid droplet ejecting head of claim 11, wherein the space is communicated to the outside air.

13. The liquid droplet ejecting head of claim 11, wherein the nozzles are arranged in a matrix pattern.

14. The liquid droplet ejecting head of claim 1, wherein the nozzles are arranged in a matrix pattern.

15. A liquid droplet ejecting device having a liquid droplet ejecting head comprising:

a channel substrate in which a nozzle, which ejects liquid droplets, and a pressure chamber, which is partitioned off by a pressure chamber dividing wall and communicated with the nozzle and filled with a liquid, are formed;

a piezoelectric element substrate having a diaphragm that forms a part of the pressure chamber and a piezoelectric element that displaces this diaphragm;

a liquid pool chamber that is formed opposite from the pressure chamber with the piezoelectric element substrate being disposed therebetween and which pools liquid supplied to the pressure chamber;

an upper substrate disposed opposite from the pressure chamber with the piezoelectric element substrate being disposed therebetween so as to be separated from and face the piezoelectric element substrate; and a dividing wall component provided, when viewing the channel substrate in plane view, along a position corresponding to the pressure chamber dividing wall between the piezoelectric element substrate and the upper substrate so as to contact the piezoelectric element substrate and the upper substrate.

16. The liquid droplet ejecting device of claim 15, wherein the liquid pool chamber is formed between the piezoelectric element substrate and the upper substrate.

17. The liquid droplet ejecting device of claim 15, wherein the liquid pool chamber is formed opposite from the piezoelectric element substrate with the upper substrate placed therebetween, and a liquid supply channel that supplies liquid to the pressure chamber from the liquid pool chamber and a space between the upper substrate and the piezoelectric element substrate are formed by a portion of the dividing wall component.

* * * * *